US005670286A

United States Patent [19]

Takei et al.

[11] Patent Number: 5,670,286

[45] Date of Patent: Sep. 23, 1997

[54] ELECTROPHOTOGRAPHIC LIGHT RECEIVING MEMBER HAVING AN OUTERMOST SURFACE WITH A SPECIFIC METAL ELEMENT-BEARING REGION AND A REGION SUBSTANTIALLY FREE OF SAID METAL ELEMENT WHICH ARE TWO-DIMENSIONALLY DISTRIBUTED

[75] Inventors: Tetsuya Takei, Nagahama; Junichiro Hashizume, Nara, both of Japan

[73] Assignee: Canon Kabushiki Kaisha, Tokyo, Japan

[21] Appl. No.: 618,302

[22] Filed: Mar. 18, 1996

[30] Foreign Application Priority Data

| | | | |
|---|---|---|---|
| Mar. 17, 1995 | [JP] | Japan | 7-084558 |
| Mar. 17, 1995 | [JP] | Japan | 7-084558 |
| Mar. 15, 1996 | [JP] | Japan | 8-085967 |

[51] Int. Cl.[6] ..... G03G 15/04

[52] U.S. Cl. ..... 430/66; 430/63; 430/57; 399/159

[58] Field of Search ..... 430/66, 63, 57; 399/159

[56] References Cited

U.S. PATENT DOCUMENTS

| | | | |
|---|---|---|---|
| 4,265,991 | 5/1981 | Hirai et al. | 430/64 |
| 4,650,736 | 3/1987 | Saitoh et al. | 430/57 |
| 4,659,639 | 4/1987 | Mizuno et al. | 430/65 |
| 4,668,599 | 5/1987 | Yamazaki et al. | 430/84 |
| 4,696,884 | 9/1987 | Saitoh et al. | 430/58 |
| 4,705,733 | 11/1987 | Saitoh et al. | 430/57 |
| 4,735,833 | 4/1988 | Honda et al. | 430/69 |
| 4,764,448 | 8/1988 | Yoshitomi et al. | 430/120 |
| 4,788,120 | 11/1988 | Shirai et al. | 430/66 |
| 4,845,001 | 7/1989 | Takei et al. | 430/66 |
| 5,273,851 | 12/1993 | Takei et al. | 430/66 |

FOREIGN PATENT DOCUMENTS

| | | | |
|---|---|---|---|
| 3343911 | 6/1984 | Germany | G03G 5/14 |
| 56-104348 | 8/1981 | Japan | G03G 15/02 |
| 57-67951 | 4/1982 | Japan | G03G 15/02 |
| 59-133569 | 7/1984 | Japan | G03G 15/02 |
| 63-268878 | 8/1988 | Japan | G03G 15/02 |
| 57-115556 | 7/1992 | Japan | G03G 5/08 |

*Primary Examiner*—Mark Chapman

*Attorney, Agent, or Firm*—Fitzpatrick, Cella, Harper & Scinto

[57] ABSTRACT

An electrophotographic light receiving member having an outermost surface portion comprised of a non-single crystal material, characterized in that a region (a) containing at least a metal element selected from the group consisting of metal elements belonging to groups 13, 14, 15 and 16 of the periodic table and a region (b) substantially not containing said metal element are two-dimensionally distributed at said outermost surface of said light receiving layer. An electrophotographic apparatus provided with said electrophotographic light receiving member and an electrophotographic process using said electrophotographic light receiving member.

98 Claims, 21 Drawing Sheets

ELECTROPHOTOGRAPHIC LIGHT RECEIVING MEMBER HAVING AN OUTERMOST SURFACE WITH A SPECIFIC METAL ELEMENT-BEARING REGION AND A REGION SUBSTANTIALLY FREE OF SAID METAL ELEMENT WHICH ARE TWO-DIMENSIONALLY DISTRIBUTED

BACKGROUND OF THE INVENTION

1. Field of the Invention

The present invention relates to an electrophotographic light receiving member sensitive to electromagnetic waves such as light (light in a broad meaning such as UV-rays, visible rays, infrared rays, X-rays and γ-rays). More particularly, the present invention relates to an electrophotographic light receiving member having an outermost surface composed of a non-single crystal material which has (a) a region containing at least a specific metal element selected from the group consisting of metal elements belonging to group 13, 14, 15 and 16 of the periodic table and (b) a region substantially substantially not containing said metal element, wherein said regions (a) and (b) are two-dimensionally distributed at said outermost surface. The present invention also relates to an electrophotographic apparatus provided with said light receiving member and an electrophotographic image-forming process using said light receiving member.

2. Related Background Art

For photoconductive materials to constitute a light receiving layer of an electrophotographic light receiving member for use in the image-forming field, it is requited that they have high sensitivity, high S/N ratio (photocurrent (IP)/dark current (ID)), absorption spectrum characteristics suited to electromagnetic waves to be irradiated, rapid responsibility to light and desired dark resistance, as well as they are not harmful to human bodies. In particular, for light receiving members to be employed in electrophotographic apparatus which are used as business machines at the office, it is important that they cause no public pollution during use.

In recent years, photoconductive materials comprising amorphous silicon (hereinafter referred to "a-Si") have been evaluated to satisfy these requirements. Particularly, there are a number of proposals for the use of such a-Si photoconductive material in an electrophotographic light receiving member. For example, U.S. Pat. No. 4,265,991 discloses an electrophotographic light receiving member in which such a-Si photoconductive material is used.

Japanese Unexamined Patent Publication No. 115556/1982 discloses a technique of improving a photoconductive member comprising a photoconductive layer formed of an a-Si deposited film with respect to its electric, optical and photoconductive characteristics including dark resistance, photosensitivity, and responsibility to light, use environmental characteristics including moisture resistance, and durability upon repeated use by disposing a surface barrier layer composed of a non-photoconductive amorphous material containing silicon and carbon atoms on a photoconductive layer composed an amorphous material containing silicon atoms as a matrix.

U.S. Pat. No. 4,659,639 discloses a photosensitive member comprising a photoconductive layer comprising an a-Si material and a transparent insulating overcoat layer comprising an a-Si material and containing carbon, oxygen and fluorine atoms. U.S. Pat. No. 4,788,120 discloses an electrophotographic light receiving member having a photoconductive layer composed of an amorphous material containing silicon atoms as a matrix and at least either hydrogen atoms or halogen atoms and a surface layer composed of an amorphous material containing silicon atoms, carbon atoms and hydrogen atoms in an amount of 41 to 70 atomic %. Offenlegungsschrift No. 3343911 discloses an amorphous silicon series photosensitive member having a surface treated by means of a Friedel-Crafts catalyst, wherein said Friedel-Crafts catalyst and/or a metal element constituting said Friedel-Crafts catalyst are adsorbed or joined to said surface. This German publication also discloses an amorphous silicon series photosensitive member having a surface treated by means of an organometallic compound, wherein said organometallic compound and/or a metal element constituting said organometallic compound are adsorbed or joined to said surface.

U.S. Pat. No. 4,668,599 discloses an amorphous silicon series photosensitive member having an amorphous silicon series surface protective layer containing metal atoms and/or metal ions, wherein as the metal element, there are mentioned transition metal elements belonging to group IIIb, IVb, Vb, VIb, VIIb VIII, Ib or IIb of the periodic table, and metal elements constituting a Friedel-Crafts catalyst. U.S. Pat. No. 4,764,448 discloses an electrophotographic photosensitive member produced by providing an electrophotographic photosensitive member, contacting a material, which can cause solid phase reaction with the surface constituent material of the photosensitive member, with the surface of the photosensitive member to cause solid phase reaction to produce a solid phase reaction product, and mechanically removing a part of the reaction product. Japanese Unexamined Patent Publication No. 246120 discloses an amorphous silicon film containing a bivalent metal such as Mg or Ca which can be used as a photosensitive film for a copying machine.

According to the techniques described in the above documents, it is possible to attain electrical, optical and photoconductive characteristics, use-environmental characteristics, and durability at a certain level for an electrophotographic light receiving member. But, there still exists a room for a further improvement in view of overall characteristics.

Now, in recent years, electrophotographic apparatus have been improving so as to function to satisfy various demands for an image reproduced. Particularly, there have been commercialized various so-called full-color electrophotographic copying machines. For such electrophotographic full-color copying machine (hereinafter referred to as electrophotographic color copying machine), there is an increased demand for a further improvement in the quality of an image reproduced. That is, the conventional electrophotographic color copying machines are satisfactory in terms of the gradation and reproduction of a highly dense image but are still problematic in that in the reproduction of a faint color such as the skin of a human body or blue sky, the gradation is sometimes insufficient to provide a coarse image. The gradation of the electrophotographic color copying machine is governed not only by the bit numbers of deciding the densities of three primary colors but also by the performance of the electrophotographic light receiving member used in the copying machine, i.e., the toner transferring efficiency to a transfer material on which toner is to be transferred such as paper. Particularly, in the case of reproducing a faint color, the amount of toner deposited on the electrophotographic light receiving member upon the development process is small and because of this, even a slight change should be occurred in the amount of the toner on the electrophotographic light receiving member to be transferred to the transfer material (such as paper), said slight change results in an apparent change in the density of an image reproduced from the faint color, wherein the resulting reproduced image becomes accompanied by a coarseness in the density. Therefore, in order to eliminate this problem, it is required for the electrophotographic light receiving member to be improved in terms of the toner transferring performance.

In addition, in the conventional electrophotographic copying apparatus, after having transferred toner to a transfer material such as paper, the residual toner remained on the photosensitive drum (that is the electrophotographic light receiving member) is retrieved to store in a toner storing box or a given space provided in the inside of the photosensitive drum and the toner thus stored is eventually dumped out. However, not only in view of preservation of the environment and conservation of resources but also in view of promotion of the utilization efficiency of toner, there is an increased demand for the reduction in the amount of the toner dumped out. In order to comply with this demand, there is a subject also for the conventional electrophotographic light receiving member to be designed so as to exhibit an improved toner transferring performance.

Further, in the conventional electrophotographic copying apparatus, the charging process is conducted by using a corona charging device comprising a wire electrode such as a gold-plated tungsten wire and a shielding plate. Particularly, a high voltage is impressed to the wire electrode of the corona charging device to generate a corona discharge, followed by effecting to the electrophotographic light receiving member whereby charging the light receiving at a desired surface electric potential. In this charging process, the generation of the corona discharge causes a remarkable amount of ozone. The ozone thus produced oxidizes nitrogen in the air to produce oxides such as nitrogen oxide ($NO_x$). When the light receiving member is continuously exposed to such oxide products over a long period of time, the surface of the light receiving member becomes sensitive to moisture so that it readily absorbs moisture. This becomes a cause to entail a charge drift on the surface of the light receiving member, resulting in causing a smeared image.

In order to prevent the occurrence of the smeared image, Japanese Utility Model Publication No. 34205/1989 proposes a manner of reducing the amount of moisture at the surface of the light receiving member by heating the light receiving member by means of a heater. However, this manner is still problematic in that particularly under high humidity environment, it is required that the heater is maintained without switching off its power source at night when no image reproduction is conducted in the case where a person wishes to reproduce an original soon after his arrival at an office early in the morning where no one is present before his arrival, because soon after the electrophotographic copying apparatus is made to be under operational condition, an image accompanied by a smeared image is liable to reproduce and it is difficult to obtain a desirable clearly reproduced image. In addition, this manner is not economical in view of energy saving.

Now, the foregoing ozone generated in the conventional electrophotographic copying apparatus entails a further problem, in addition to causing a smeared image as above described, in that it has a tendency of providing a negative influence of injuring the health of a person or other living things present near the apparatus. In order to prevent the occurrence of this problem, it usually takes a measure of making the ozone to be harmless by means of an ozone filter and exhausting it outside the apparatus. In any case, it is required to minimize the amount of ozone generated upon the charging process in the electrophotographic copying apparatus as little as possible, particularly in the case where it is personally used. In addition to this, there is a societal demand to greatly reduce the amount of the ozone generated.

As a measure in order to eliminate the drawbacks entailed due to the generation of ozone in the case of using the corona charging device, there is known the use a contact electrification device in replacement of the corona charging device. For instance, Japanese Unexamined Patent Publication No. 208878/1988 discloses a contact electrification device which is used for charging the surface of an electrophotographic photosensitive member at a desired electric potential by contacting the photosensitive member with a charging member impressed with a desired voltage. Other than this, there are also known other manners of charging an electrophotographic photosensitive member (or an electrophotographic light receiving member) at a desired electric potential by way of contact electrification, i.e., a manner of charging an electrophotographic photosensitive member at a desired electric potential by contacting the surface of the photosensitive member with a brush impressed with a desired voltage (see, Japanese Unexamined Patent Publications Nos. 104348/1981 and 67951/1982), a manner of charging an electrophotographic photosensitive member at a desired electric potential by contacting the surface of the photosensitive member with an electrically conductive rubber roller impressed with a desired voltage, and a manner of charging an electrophotographic photosensitive member at a desired electric potential by contacting the surface of the photosensitive member with a magnetic brush comprising a magnetic body and a powdery magnetic material having been impressed with a desired voltage (see, Japanese Unexamined Patent Publication No. 133569/1984).

These contact electrification manners have such advantages as will be described in the following, which can not be attained in the case of using the corona charging device. That is, a first advantage is that the voltage impressed in order to attain a desired electric potential at the surface of the electrophotographic light receiving member can be reduced; a second advantage is that no ozone or a slight amount of ozone is generated in the charging process and therefore, it is not necessary to use the ozone filter which is used in the case of using the corona charging device; and a third advantage is that neither ozone nor such ozone-related products cased in the case of using the corona charging device are deposited on the surface of the electrophotographic light receiving member and therefore, there is no occasion for the surface of the light receiving member to be sensitive to moisture to afford a smeared image as in the case of using the corona charging device, and in addition, it is not necessary to use the heater used in the case of using the corona charging device wherein a reduction in the power consumed can be attained. It is expected that the use of the contact electrification manner will make it possible to miniaturize the size of the electrophotographic copying apparatus.

However, as for these contact electrification manners having such advantages as above described, there are such problems as will be described in the following. That is, an unevenness is liable to occur for the contact state of the rubber roller or brush or mismatching is liable to occur in the selection of the resistance of the electrophotographic light receiving member and that of the contact element, wherein uneven charging is liable to occur under certain condition; and when an abnormally grown portion such as a so-called spherical protrusion is present at the surface of the electrophotographic light receiving member, uneven charging based on such portion is liable to occur under certain condition. In view of this, there is a demand for providing an improved electrophotographic light receiving member which is desirable suitable for the contact electrification manner without the occurrence of these problems.

SUMMARY OF THE INVENTION

The present invention is aimed at eliminating the foregoing disadvantages involved in the conventional amorphous silicon series electrophotographic light receiving member (that is, the conventional electrophotographic light receiving member having a light receiving layer composed of an amorphous silicon series material) and providing an improved electrophotographic light receiving member having an improved light receiving layer composed of a non-single crystal material containing silicon atoms as a matrix which meets the foregoing demands.

Another object of the present invention is to provide an improved electrophotographic light receiving member which exhibits an improved toner transferring efficiency of efficiently transferring toner deposited on the electrophotographic light receiving member upon the development process to a transfer material.

A further object of the present invention is to provide an improved electrophotographic light receiving member which exhibits an improved toner transferring efficiency and which realizes a color reproduction with an excellent gradation in an electrophotographic color copying machine (that is, an electrophotographic full-color copying machine).

A further object of the present invention is to provide an improved electrophotographic light receiving member which exhibits an improved toner transferring efficiency and which realizes effective reproduction of a high quality image with no coarseness from a faint color original such as the skin or blue sky.

A further object of the present invention is to provide an improved electrophotographic light receiving member which excels in electric, optical and photoconductive characteristics to always ensure the reproduction of a high quality image while reducing the generation of a waste toner and attaining resources saving, energy saving and preservation of the environment.

A further object of the present invention is to provide an improved electrophotographic light receiving member which hardly causes uneven charging even when used in an electrophotographic apparatus provided with a charging device of the contact electrification system, wherein the charging process can be effectively conducted while preventing the generation of ozone, and the light receiving member exhibits excellent electrophotographic characteristics of always reproducing a high quality sharp image with nether an uneven halftone nor an uneven density.

A further object of the present invention is to provide an improved electrophotographic light receiving member which makes it unnecessary to use a corona charging device of causing the generation of ozone and makes it possible to use a charging device of the contact electrification system in replacement of the corona charging device in an electrophotographic apparatus, in the electrophographic apparatus, no heater for heating the light receiving member is used, a reduction in the power consumption is attained, the charging process can be efficiently conducted while preventing the generation of ozone, and the reproduction of a high quality sharp image with nether an uneven halftone nor an uneven density is assurred.

A further object of the present invention is to provide an electrophotographic apparatus provided with the above-described improved electrophotographic light receiving member which enables to continuously conduct desirable image formation with a sufficient image reproducibility and an excellent gradation and which excels in space utilization efficiency wherein in particular, the space for storing retrieved toner can minimized.

A further object of the present invention is provide an electrophotographic process using the above-described improved electrophotographic light receiving member which enables to continuously conduct desirable image formation with a sufficient image reproducibility and an excellent gradation.

DETAILED DESCRIPTION OF THE INVENTION

Figure 1B:
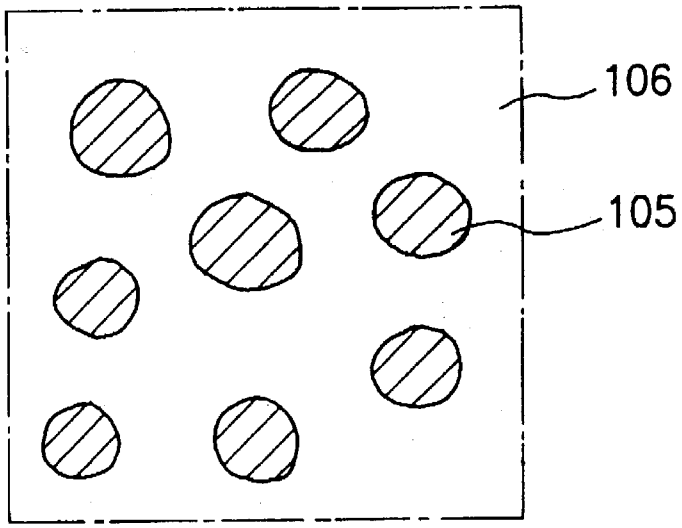
FIGS. 1(*a*) and 1(*b*) are schematic views for illustrating a first embodiment of an electrophotographic light receiving member according to the present invention, wherein FIG. 1(*a*) is a schematic cross-sectional view of said light receiving member and FIG. 1(*b*) is a schematic plan view of said light receiving member, observed from above.

A typical embodiment of an electrophotographic light receiving member according to the present invention comprises a substrate and a light receiving layer disposed on said substrate, said light receiving layer having an outermost surface portion comprising a non-single crystal material containing at least silicon atoms, characterized in that a region (a) containing atoms of at least a metal element selected from the group consisting of metal elements belonging to groups 13, 14, 15 and 16 of the periodic table and a region (b) substantially not containing said metal atoms are two-dimensionally distributed in the outermost surface of said light receiving layer.

The electrophotographic light receiving member exhibits an improved toner transferring efficiency of efficiently transferring toner deposited on the electrophotographic light receiving member upon the development process to a transfer material.

In addition, the electrophotographic light receiving member realizes a color reproduction with an excellent gradation in an electrophotographic color copying machine (that is, an electrophotographic full-color copying machine).

Further in addition, the electrophotographic light receiving member realizes effective reproduction of a high quality image with no coarseness from a faint color original such as the skin or blue sky.

Further, the electrophotographic light receiving member excels in electric, optical and photoconductive characteristics to always ensure the reproduction of a high quality image while reducing the generation of a waste toner and attaining resources saving, energy saving and preservation of the environment.

A typical embodiment of an electrophotographic apparatus according to the present invention comprises the above-described electrophotographic light receiving member, an exposure means, a charging means, and a development means.

An typical embodiment of an electrophotographic process according to the present invention comprises applying an electric field to the above-described electrophotographic light receiving member, and applying an electromagnetic wave to said light receiving member thereby forming an electrostatic image.

The present invention has been accomplished based on the below-described findings obtained by the present inventors as a result of extensive studies in order to eliminate the foregoing disadvantages found in the prior art and in order to attain the above described objects.

Firstly, in order to eliminate the foregoing disadvantages found in the prior art, the present inventors conducted experimental studies of the interrelation between the conventional electrophotographic light receiving member and its toner transferring efficiency. As a result, there were obtained the following findings. That is, in the case of forming a light receiving layer composed of an a-Si material at a conventional deposition rate upon producing an electrophotographic light receiving member by a CVD process, there is a tendency in that during the layer formation, a certain physical pattern is liable to repeat, resulting in making the resulting layer to have a columnar cross section pattern. This phenomenon becomes significant as the the layer thickness increases. Particularly, the conventional electrophotographic light receiving member has a 20 to 50 μm thick light receiving layer (that is, photoconductive layer). In the formation of the light receiving layer having such thickness by the CVD process, the phenomenon of causing the above columnar pattern sometimes becomes significant, often resulting in making the resulting light receiving layer to have a surface accompanied by cauliflower-like minute irregularities.

Based on these findings, the present inventors presumed that when the electrophotographic light receiving member having such minute irregularities at the surface thereof is employed in electrophotographic image formation, said minute irregularities would a factor of making the light receiving member insufficient in terms of the toner transferring efficiency to a copying paper, for the reasons that toner deposited at portions having different physical properties or/and in recesses present at the minute irregularities-possessing surface of the light receiving member upon the development process are remained without transferring to the copying paper.

As for the mechanism of growing the above columnar pattern depending upon the thickness of a light receiving layer formed, the present inventors consider as will be described in the following. That is, when the light receiving layer is formed by a plasma CVD process, raw material gas is decomposed by means of plasma caused as a result of glow discharge to generate active species (including ions and radicals) which contribute to forming a film, and the active species thus generated randomly fly to deposit on the surface of a film previously deposited on a substrate whereby causing the growth of a film to be said light receiving layer. In this case, when irregularities should be present at the surface of the film previously deposited on the substrate, said irregularities become obstacles for the active species, wherein the probability for the active species to arrive at valley portions of the irregularities is smaller than the probability for the active species to arrive at peak portions of the irregularities. This situation makes the resulting film to have an uneven physical property and to have irregularities at the surface thereof.

In order to reduce or eliminate such irregular structure at the surface of the deposited film due to the generation of the foregoing columnar pattern, the present inventors conducted studies.

Now, it is considered that the reduction or elimination of said irregular structure at the surface of the deposited film may be conducted by a manner of structurally reducing or eliminating the irregular structure or a manner of filling recesses of the irregular structure. Particularly, there are considered two manners A and B which will be described in the following.

The manner A is to subject a deposited film having an irregular structure at the surface thereof to a knock-on process wherein ion bombarding treatment using argon gas is conducted against the deposited film to thereby reduce or eliminate the irregular structure of the deposited film. The manner A is very effective only for the purpose of eliminating the irregular structure of the deposited film. However, the manner A entails problems in that the deposited film is unavoidably damaged due to ion bombardment to cause an increase in the number of dangling bonds present in the deposited film, and wherein foreign matters such as argon atoms are contaminated into the deposited film. The deposited film treated by the manner A is therefore poor in characteristics, although the irregular structure of the deposited film is eliminated.

In this respect, it was found that the manner A is impossible to attain the reduction or elimination of the foregoing irregular structure present at the surface of the deposited film as the light receiving layer for an electrophotographic light receiving member without hindering the electrophotographic characteristics thereof.

The manner B is to form a deposited film composed of a glassy material such as Se on a substrate at a substrate temperature approximate to the glass transition temperature of said material by a CVD process, wherein a film is grown while behaving like a liquid droplet on the substrate. The resulting deposited film according to the manner B has a very even surface.

In view of this, the present inventors considered that the manner B would be effective for solving the foregoing problems relating to the irregular structure of the deposited film composed of an a-Si material. And experimental studies were conducted. As a result, it was found that in the case of forming an a-Si deposited film while introducing a relatively large amount of a specific metal element selected from metal elements belonging to group 13, 14, 15 and 16 of the periodic table thereinto, the deposited film behaves like a glassy material during the growth thereof to result in making the resulting deposited film to have an even structure at the surface thereof. Therefore, it was found that the manner B will be effective to solve the foregoing problems relating to the irregular structure of the deposited film.

Now, in order to find out an optimum condition for the light receiving layer of the electrophotographic light receiving member to exhibit a toner transferring efficiency as desired, the present inventors conducted experimental studies, wherein the amount of a given metal element contained in the light receiving layer was varied. As a result, it was found that when the metal element is contained in the light receiving layer in such an amount that the electrophotographic light receiving member exhibits a sufficient toner transferring efficient, problems as will be described below newly occur. One of the problems is to cause a change in the spectral sensitivity of the electrophotographic light receiving member. That is, due to the metal element contained in the surface of the electrophotographic light receiving member, a phenomenon is occurred in the light receiving member such that light having a specific wavelength in a given wavelength range is absorbed to vary the color sensitivity of the light receiving member. This situation entails such problems as will be described in the following. That is, in the monochromatic copying, it is difficult to always obtain a high quality reproduced image having a sufficient image density from an original containing a red character or a blue character. And in the color copying, it is difficult to always attain sufficient color reproduction of a color original comprising three primary colors because the color sensitivity of the light receiving member to the three primary colors is varied to be poor in color balance.

Another problem is to cause the occurrence of a a ghost on the surface of the light receiving member due to light fatigue. That is, photocarriers are trapped by the metal element contained in the surface of the electrophotographic light receiving member to often cause a change in the bond state of the surrounding atoms constituting the light receiving layer of the light receiving member whereby forming a localized level in the energy space, wherein when the light receiving member is subjected to relatively intense light exposure, a ghost is occurred and remained on the surface of the light receiving member without being extinguished over a long period of time. The ghost occurrence herein means a phenomenon in which a latent image formed in the previous image-forming process is remained as a memory on the surface of the light receiving member and it appears in a halftone region or the like in the following image-forming process.

In order to eliminate the above problems, the present inventors experimental studies, wherein a given metal element was incorporated in a neighborhood region of the surface of the light receiving layer of the electrophotographic light receiving member while varying the distribution state of the metal element. As a result, it was found that when the electrophotographic light receiving member is designed to have a surface having a region containing a specific metal element and another region substantially not containing said metal element which are two-dimensionally distributed on the surface thereof, the above problems are eliminated. Particularly, when at least a metal element selected from the group consisting metal elements belonging to group 13, 14, 15 and 16 of the periodic table as said metal element is locally contained in the surface of the light receiving member so as to have a two-dimensional distribution on said surface, the above problems are more desirably eliminated.

Separately, in order for the foregoing irregular structure-bearing deposited film (composed of an a-Si material) as the light receiving layer for an electrophotographic light receiving member to exhibit a toner transferring efficiency as desired, as previously described, there is considered a manner of eliminating the irregular structure at the surface of the deposited film by filling recesses of the irregular structure of the deposited film with a given material to make the deposited film to have a flat surface. In this case, as the filling material, it is required to selectively use a material which can selectively deposit in the recesses of the deposited film.

As a result of experimental studies of this manner, it was found that although as the toner transferring efficiency is increased as the irregular structure is reduced, a problem entails on the other hand in that the electrophotographic light receiving member cannot be sufficiently cleaned in the cleaning process. The reason for the occurrence of this problem is considered due to a friction coefficient of the material deposited in the recesses with a cleaning blade used for cleaning the light receiving member in the cleaning process. Particularly, it is considered that when the friction coefficient is great, the sliding property of the cleaning blade is deteriorated to suffer from a craze, wherein toner passes through a clearance of the cleaning blade which is formed due the craze.

Therefore, it is important to selectively use a proper material in order to fill the recesses of the irregular structure of the deposited film while having a due care so that an optimum condition of attaining an improved toner transferring efficiency for the light receiving member and a sufficient cleaning performance for the cleaning blade is established.

In order to attain this object, the present inventors conducted experimental studies to find out a filling material which can deposit selectively in the recesses of the irregular structure of the deposited film and exhibit a lubricating property to the cleaning blade. As a result, it was found that any of resin materials which were originally considered to be usable does not desirably deposit in the recesses because of its wetting property and is not compatible with the material by which the cleaning blade is constituted, and in addition, it is difficult to prevent the occurrence of the foregoing craze at the cleaning blade. In addition, it was found that the use of the resin material entails another problem in that because the resin material has a hardness which is excessively lower than that of the constituent material (a-Si material) of the light receiving layer of the electrophotographic light receiving member, the resin material is readily worn upon the cleaning by the cleaning blade.

The present inventors further various experimental studies. As a result, it was found that at least a specific metal element selected from metal elements belonging to group 13, 14, 15 and 16 of the periodic table, which have never been applied at the surface of an electrophotographic light receiving member in the prior art, desirably and selectively deposits in the recesses of the irregular structure of the deposited film wherein said specific metal element deposited in the recesses exhibits a desirable lubricating property and it exhibits a specially high lubricating property to the cleaning blade. The reason for this is considered as will be described in the following. That is, the formation of a light receiving layer comprising an a-Si deposited film upon producing an electrophotographic light receiving member is conducted usually at a relatively high deposition rate. Under the film forming condition of such high deposition rate, film deposition proceeds before a structural relaxation sufficiently occurs in a film previously deposited, wherein a distortion is liable to occur in the film deposited and columnar structures are eventually grown in the film so as to extinguish the distortion, whereby recesses depending on the columnar structures are afforded at the outermost surface of the film. In this situation, it is considered that a number of dangling bonds which are generated as a result of Si—Si bonds having been broken in order to relax the distortion are present in boundary regions of the columnar structures and they are convergently present in the recesses at the surface of the film. Hence, the outermost surface of the a-Si deposited film as the light receiving layer has a high localized level and has a number of dangling bonds exposed thereon. When the above metal element is applied to the outermost surface of the light receiving layer in a state that it has a sufficient energy, the metal element results in having a high surface mobility and behaves to freely mobilize on said outermost surface, and the metal element exhibits a desirable wetting property to the a-Si material constituting the light receiving layer and a desirable surface tension, wherein the metal element eventually moves into the recesses which are stable in terms of energy and have a number of dangling bonds convergently gathered therein, and the metal element preferentially bonds to the dangling bonds. By this, the metal element selectively deposit in the recesses to fill the recesses. Therefore, when the amount of the metal element to be applied to the outermost surface of the light receiving layer is properly controlled, the recesses at the outermost surface of the light receiving layer can be entirely filled by the metal element to make the outermost surface of the light receiving layer to be desirably flat. In addition, the surface of the metal element thus filled in the recesses of the light receiving layer has no structural defect such as a dangling bond and the metal element is therefore poor in compatibility with the constituent resin material of the cleaning blade. Because of this, the metal element exhibits a desirable lubricating property.

And as for the state for said at least a metal element selected from metal elements belonging to group 13, 14, 15 and 16 of the periodic table to be present in the surface of the light receiving layer of the light receiving member (this state will be referred to as the metal element's surface distribution state), the present inventors obtained a finding that the metal element's surface distribution state is preferred to be made such that the metal element is two-dimensionally localized in the recesses of the irregular structure at the surface of the light receiving layer. The present inventors obtained further findings as will be described in the following. That is, in the case where said at least a metal element selected from metal elements belonging to group 13, 14, 15 and 16 of the periodic table (hereinafter referred to as the metal element (13, 14, 15, 16) is made such that it is present uniformly on the surface of the light receiving member, although reasonable advantages are obtained, problems entail depending upon the amount of the metal element (13, 14, 15, 16) to be present such that a drift occurs for the electric charge in the charging process due to the low resistive property of the metal element to cause a smeared image, thus resulting in making the light receiving member to be defective in the image-forming characteristics. And it is therefore preferred that the metal element (13, 14, 15, 16) is made to be present in a region with no metal element in an island-like state at the surface of the light receiving member.

The present invention has been accomplished based on the above-described findings. Particularly, the present invention is based on the two-dimensional distribution of the metal element at the surface (that is, the outermost surface) of an electrophotophotographic light receiving member, which is never found in the prior art. That is, according to the present invention, by making an electrophotographic light receiving member to have (a) a region containing at least a metal element selected from metal elements belonging to group 13, 14, 15, 16 of the periodic table (that is, a metal element (13, 14, 15, 16)) and (b) a region substantially not containing said metal element (13, 14, 15, 16) in a state that the two regions (a) and (b) are two-dimensionally distributed at the outermost surface of the light receiving member, there can be effectively attained an improved electrophotographic light receiving member which exhibits a greatly improved toner transferring efficiency while exhibiting satisfactory electrophotographic characteristics.

In the present invention, as the metal element (13, 14, 15, 16) is two-dimensionally distributed as above described, the concentration of said metal element to be distributed may be locally heightened at the surface of the light receiving member. In addition to this, it is possible to attain an improvement not only in the amount of the metal element (13, 14, 15, 16) to be applied but also in the depth to which said metal element reaches which can not be attained by way of uniform distribution. This situation results in remarkably prolonging the lifetime of the light receiving member (this leads to remarkably prolonging the lifetime of the electrophotographic apparatus).

In the present invention, the configuration comprising the foregoing regions (a) and (b) being two-dimensionally distributed at the surface of the light receiving member (this will be referred to as two-dimensional distribution configuration) includes a two-dimensional distribution configuration in which island-like regions containing the metal element (13, 14, 15, 16) are spacedly present in a region free of said metal element and another two-dimensional distribution configuration embodiment in which island-like regions not containing the metal element (13, 14, 15, 16) are spacedly present in a region containing said metal element.

In the case where the two-dimensional distribution configuration is made such that the metal element (13, 14, 15, 16) is present to fill the recesses of the irregular structure at the surface of the light receiving layer of the electrophotographic light receiving member, said metal element in the recesses is hardly removed not only upon the contact with papers in the toner transferring process but also upon the contact with the cleaning blade in the cleaning process.

In the present invention, the surface of the light receiving layer may be the surface of a surface layer disposed on a photoconductive layer. In this case, when the surface layer is comprised of a SiC material, a pronounced effect is provided. That is, since as the surface at which the two-dimensional configuration is provided is composed of said SiC material, the abrasion resistance, moisture resistance and durability which the SiC material possesses are remarkably improved, wherein the advatages of the present invention becomes significant.

In the following, description will be made of an electrophotographic light receiving member according to the present invention while referring to the drawings.

FIGS. 1 to 10 are schematic views respectively for illustrating an example of an electrophotographic light receiving member comprising a light receiving layer provided with the foregoing two-dimensional distribution configuration provided at the outermost surface thereof according to the present invention. In each of FIGS. 1 to 10, the figure (a) is a schematic cross-sectional view of a principal part of an electrophotographic light receiving member and the figure (b) is a schematic plan view of the light receiving member shown in the figure (a), observed from above.

In FIGS. 1 to 10, reference numeral 101 indicates a substrate, reference numeral 102 a light receiving layer, reference numeral 103 a photoconductive layer, reference numeral 104 a surface layer, reference numeral 105 a region containing at least a metal element selected from metal elements belonging to group 13, 14, 15 and 16 of the periodic table (hereinafter referred to as metal element (13, 14, 15, 16)), and reference numeral 106 a region not containing the metal element (13, 14, 15, 16).

Figure 1A:
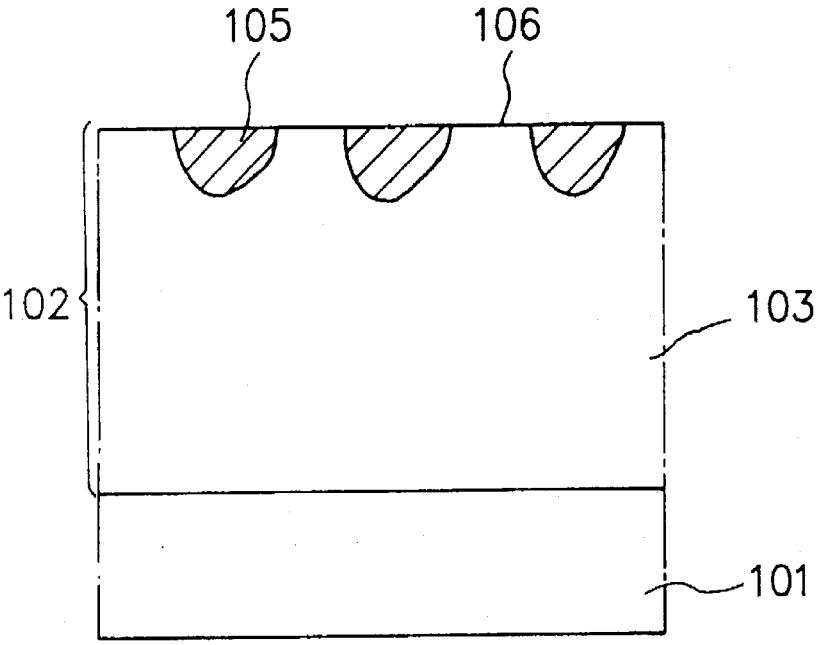

The electrophotographic light receiving member shown in FIG. 1 (that is FIGS. 1(*a*) and 1(*b*)) comprises a substrate 101 and a light receiving layer 102 (that is, a photoconductive layer 103) composed of an amorphous material containing silicon atoms as a matrix disposed on said substrate. In this case, the photoconductive layer 103 has an outermost surface provided with an irregular pattern based on columnar structures present in the photoconductive layer, wherein a plurality of regions 105 (each having such a shape as shown in the plan view (b)) each comprising a region containing the metal element (13, 14, 15, 16) present between the columnar structures and another region 106 substantially not containing said metal element are two-dimensionally distributed at the outermost surface of the photoconductive layer.

Figure 2B:
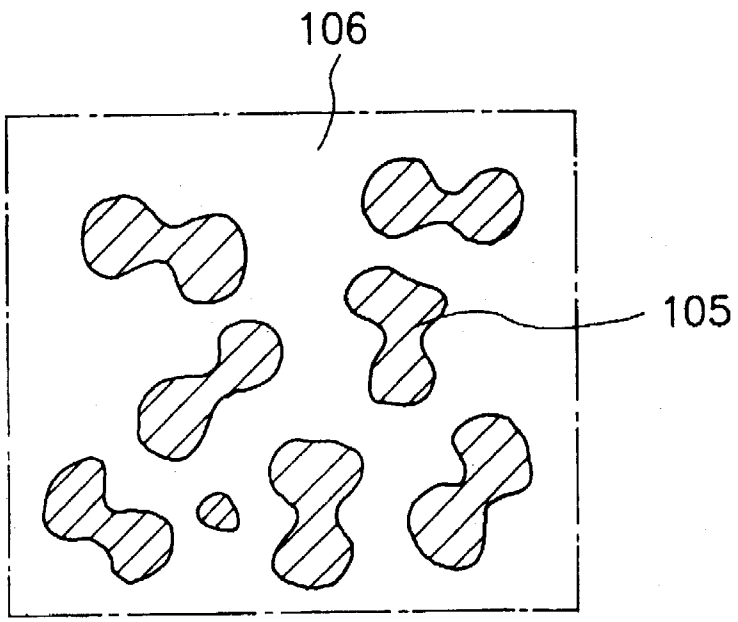
FIGS. 2(*a*) and 2(*b*) are schematic views for illustrating a second embodiment of an electrophotographic light receiving member according to the present invention, wherein FIG. 2(*a*) is a schematic cross-sectional view of said light receiving member and FIG. 2(*b*) is a schematic plan view of said light receiving member, observed from above.
Figure 2A:
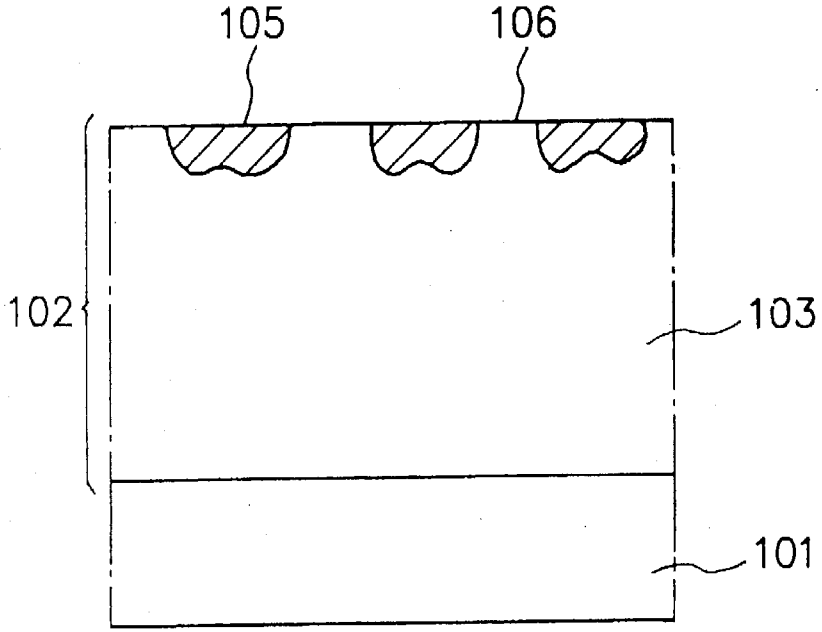

The electrophotographic light receiving member shown in FIG. 2 (that is FIGS. 2(*a*) and 2(*b*)) is a partial modification of the light receiving member shown in FIG. 1, wherein the shapes of the regions 105 in FIG. 1 are changed as shown in the plan view of FIG. 2(*b*).

Figure 3B:
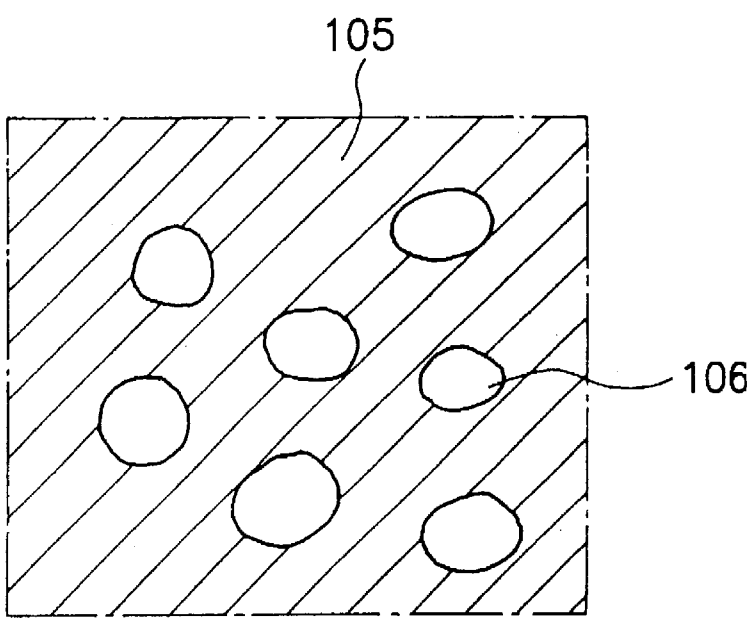
FIGS. 3(*a*) and 3(*b*) are schematic views for illustrating a third embodiment of an electrophotographic light receiving member according to the present invention, wherein FIG. 3(*a*) is a schematic cross-sectional view of said light receiving member and FIG. 3(*b*) is a schematic plan view of said light receiving member, observed from above.
Figure 3A:
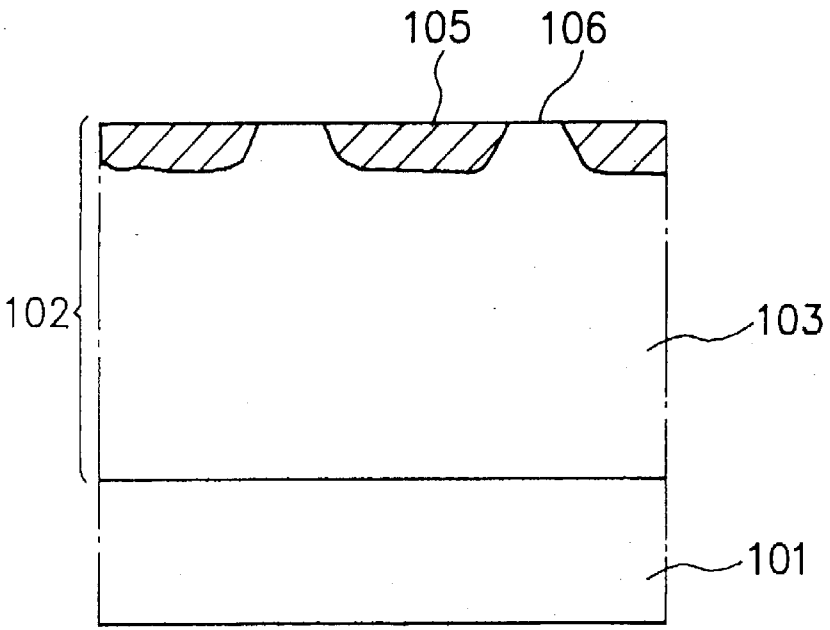
Figure 4B:
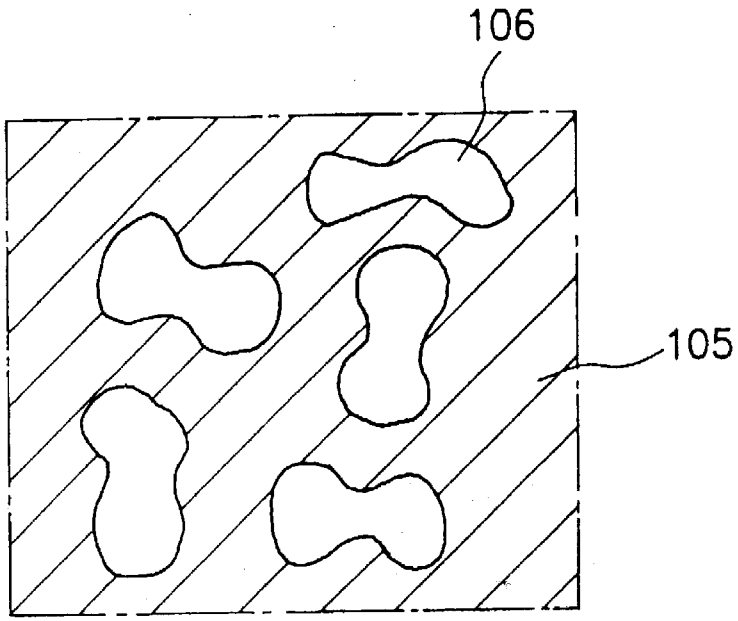
FIGS. 4(*a*) and 4(*b*) are schematic views for illustrating a fourth embodiment of an electrophotographic light receiving member according to the present invention, wherein FIG. 4(*a*) is a schematic cross-sectional view of said light receiving member and FIG. 4(*b*) is a schematic plan view of said light receiving member, observed from above.
Figure 4A:
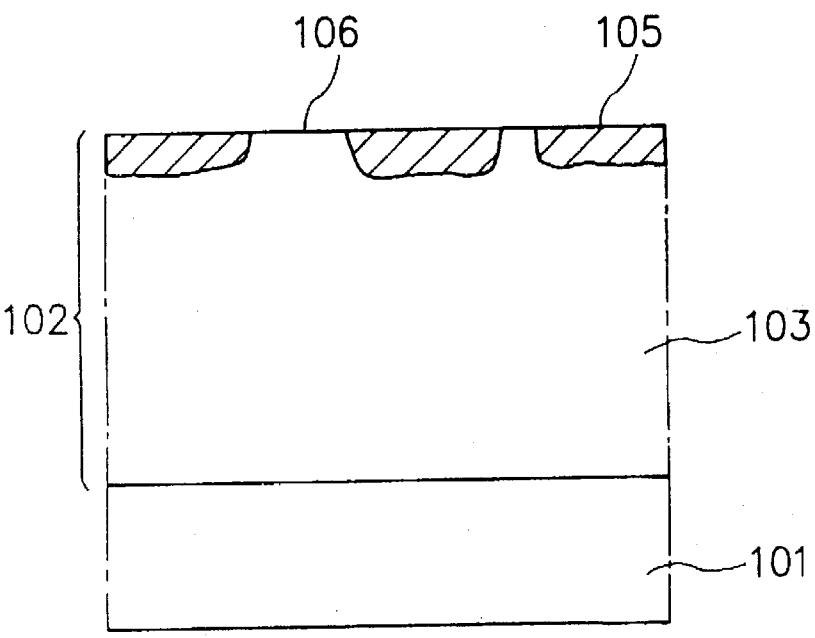

The electrophotographic light receiving members shown in FIG. 3 (that is, FIGS. 3(*a*) and 3(*b*)) and FIG. 4 (that is, FIGS. 4(*a*) and 4(*b*)) are the same as those shown in FIGS. 1 and 2 in terms of the layer constitution, except for the following point. That is, in the light receiving member shown in each of FIGS. 3 and 4, the amount of the metal element (13, 14, 15, 16) applied is made to be greater than the amount thereof required for terminating the dangling bonds present in the irregular pattern. Particularly, the relationship between the regions 105 and the region 106 in each of FIGS. 1 and 2 is reversed in each of FIGS. 3 and 4. That is, in each of the light receiving members shown in FIGS. 3 and 4, as apparent from the plan view (b), a plurality of island-like regions 106 substantially not containing the metal element (13, 14, 15, 16) are spacedly distributed in a sea as a region 105 containing said metal element.

Figure 5B:
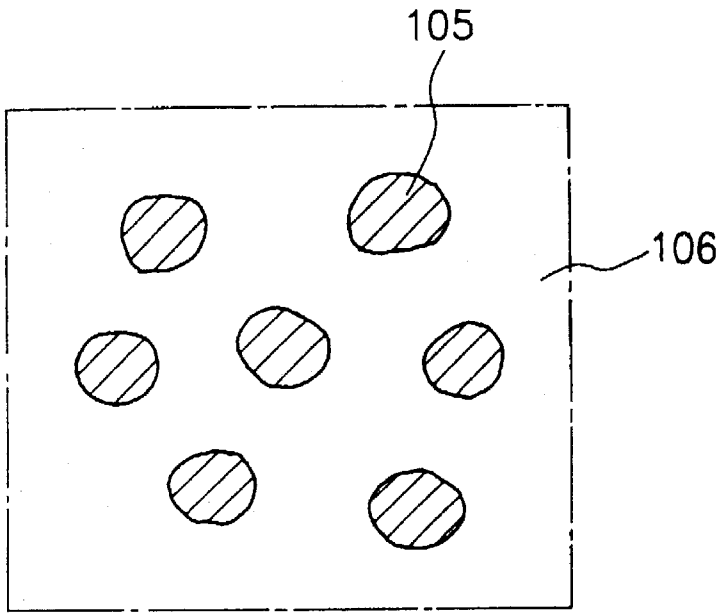
FIGS. 5(*a*) and 5(*b*) are schematic views for illustrating a fifth embodiment of an electrophotographic light receiving member according to the present invention, wherein FIG. 5(*a*) is a schematic cross-sectional view of said light receiving member and FIG. 5(*b*) is a schematic plan view of said light receiving member, observed from above.
Figure 5A:
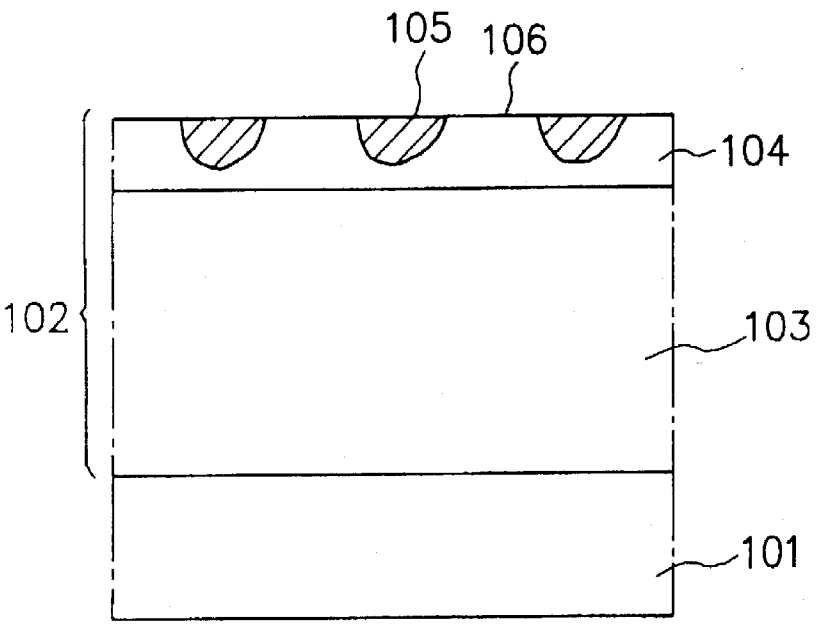

The electrophotographic light receiving member shown in FIG. 5 (that is, FIGS. 5(*a*) and 5(*b*)) comprises a substrate 101 and a light receiving layer 102 comprising a photoconductive layer 103 composed of an amorphous material containing silicon atoms as a matrix and a surface layer 104 composed of a non-single crystal material which is disposed on said substrate. In this case, the surface layer 104 has an outermost surface provided with an irregular pattern based on columnar structures present in the surface layer, wherein a plurality of regions 105 (each having such a shape as shown in FIG. 5) each comprising the metal element (13, 14, 15, 16) present between the columnar structures and another region 106 substantially not containing said metal element are two-dimensionally distributed at the outermost surface of the surface layer.

In the case of the light receiving member shown in FIG. 5, it is possible to take any of the two-dimensional distribution configurations shown in FIGS. 2 to 4.

Figure 6B:
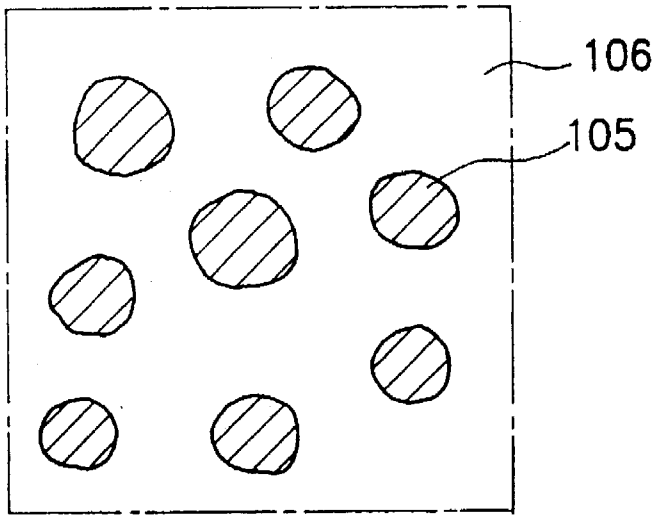
FIGS. 6(*a*) and 6(*b*) are schematic views for illustrating a sixth embodiment of an electrophotographic light receiving member according to the present invention, wherein FIG. 6(*a*) is a schematic cross-sectional view of said light receiving member and FIG. 6(*b*) is a schematic plan view of said light receiving member, observed from above.
Figure 6A:
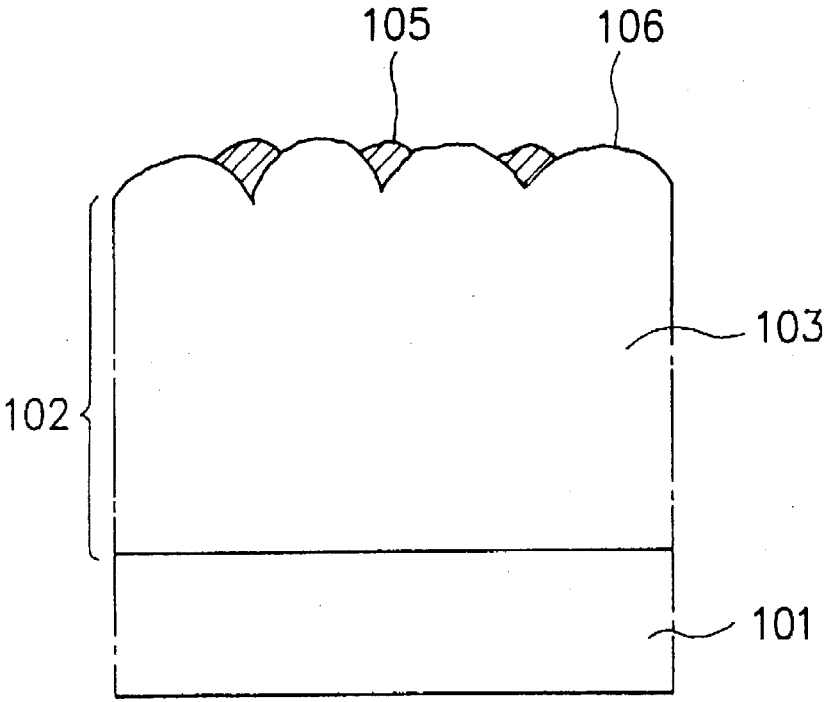

The electrophotographic light receiving member shown in FIG. 6 (that is FIGS. 6(*a*) and 6(*b*)) comprises a substrate 101 and a light receiving layer 102 (that is, a photoconductive layer 103) composed of an amorphous material containing silicon atoms as a matrix) disposed on said substrate. In this light receiving member, the photoconductive layer 103 has an outermost surface provided with an irregular pattern based on columnar structures present in the photoconductive layer, wherein the irregular pattern at the outermost surface of the photoconductive layer comprises irregularities comprising protrusions and recesses, and a plurality of regions 105 (each having such a shape as shown in the plan view (b)) each comprising a region containing the metal element (13, 14, 15, 16) present so as to fill one of the recesses and another region 106 substantially not containing said metal element are two-dimensionally distributed at the outermost surface of the photoconductive layer.

Figure 7B:
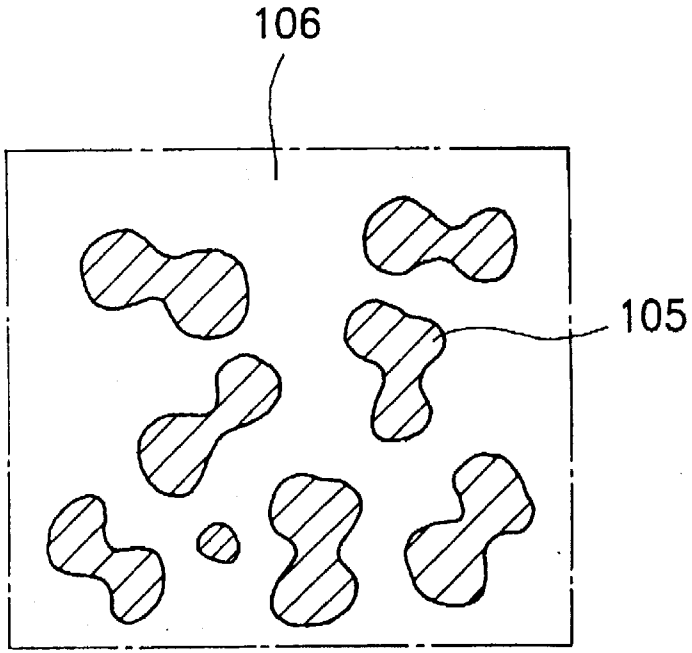
FIGS. 7(*a*) and 7(*b*) are schematic views for illustrating a seventh embodiment of an electrophotographic light receiving member according to the present invention, wherein FIG. 7(*a*) is a schematic cross-sectional view of said light receiving member and FIG. 7(*b*) is a schematic plan view of said light receiving member, observed from above.
Figure 7A:
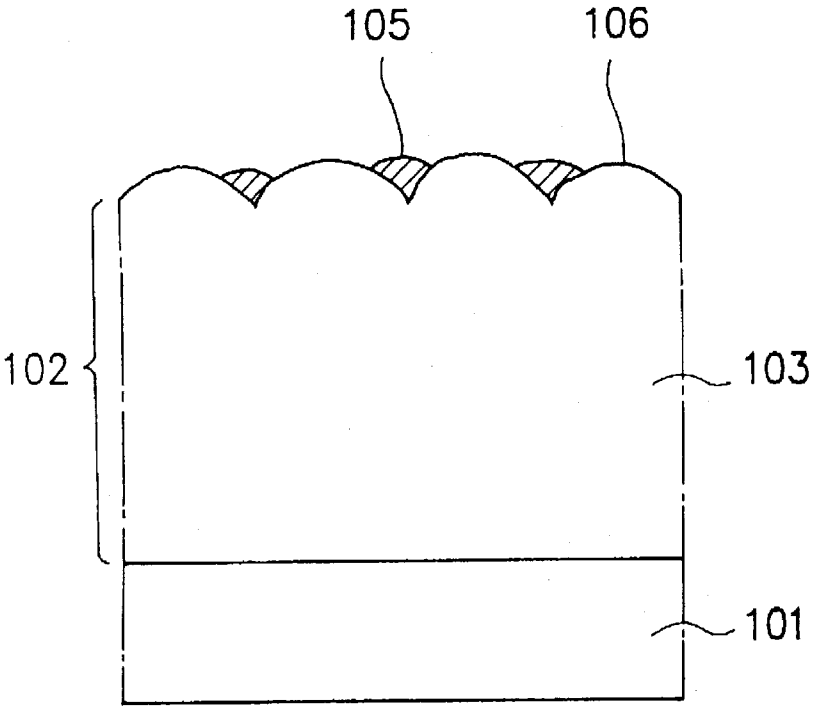

The electrophotographic light receiving member shown in FIG. 7 (that is FIGS. 7(*a*) and 7(*b*)) is a partial modification of the light receiving member shown in FIG. 6, wherein the shapes of the regions 105 in FIG. 6 are changed as shown in the plan view of FIG. 7(*b*).

Figure 8B:
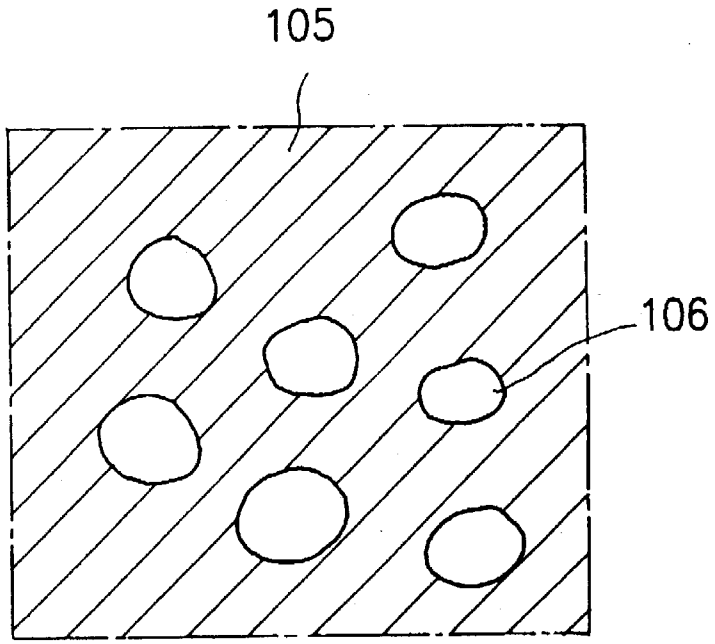
FIGS. 8(*a*) and 8(*b*) are schematic views for illustrating an eighth embodiment of an electrophotographic light receiving member according to the present invention, wherein FIG. 8(*a*) is a schematic cross-sectional view of said light receiving member and FIG. 8(*b*) is a schematic plan view of said light receiving member, observed from above.
Figure 8A:
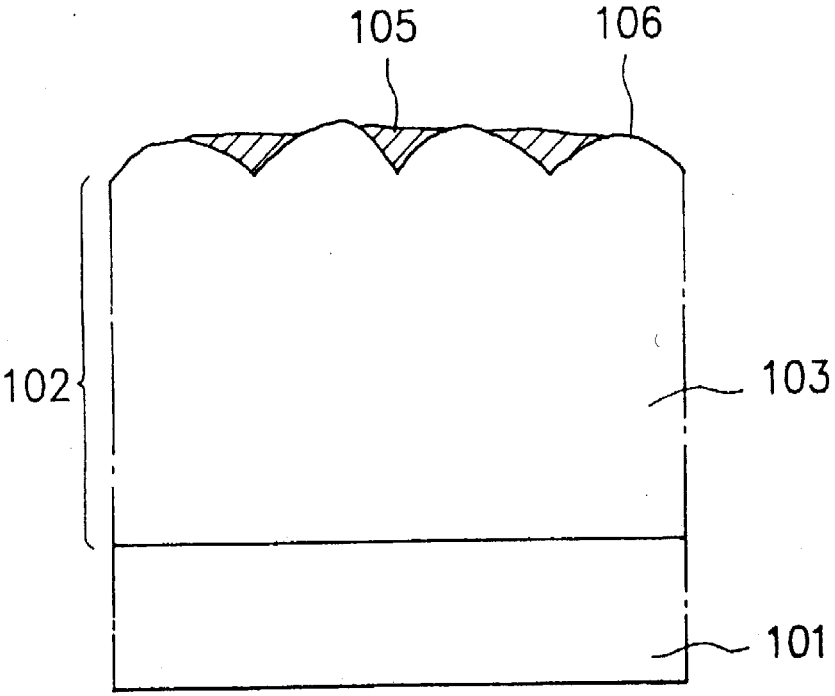
Figure 9B:
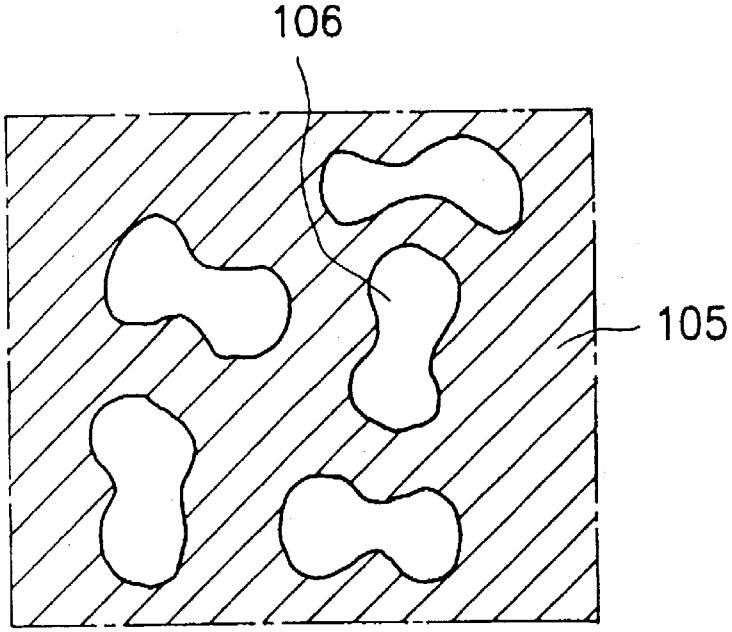
FIGS. 9(*a*) and 9(*b*) are schematic views for illustrating a ninth embodiment of an electrophotographic light receiving member according to the present invention, wherein FIG. 9(*a*) is a schematic cross-sectional view of said light receiving member and FIG. 9(*b*) is a schematic plan view of said light receiving member, observed from above.
Figure 9A:
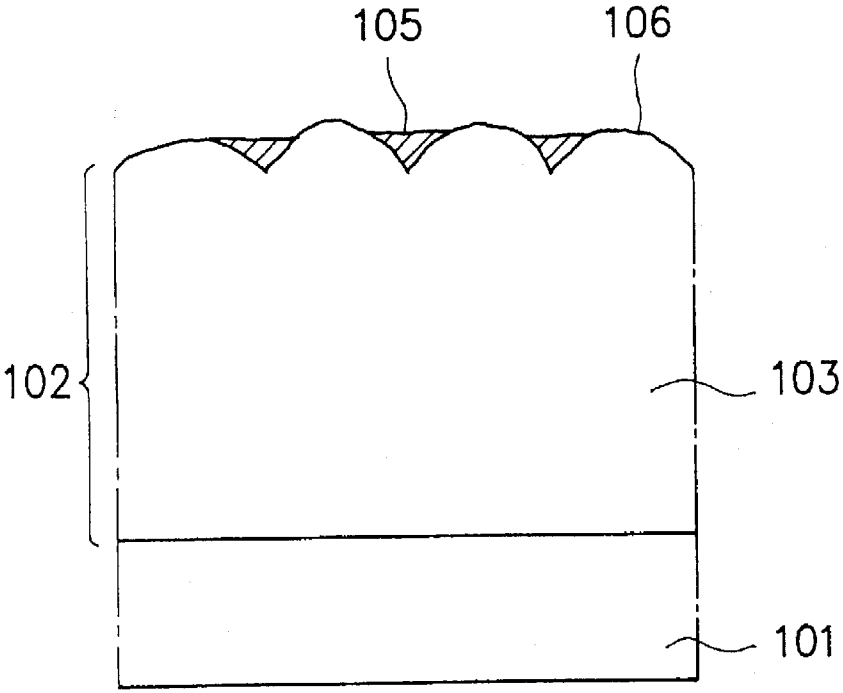

The electrophotographic light receiving members shown in FIG. 8 (that is, FIGS. 8(*a*) and 8(*b*)) and FIG. 9 (that is, FIGS. 9(*a*) and 9(*b*)) are the same as those shown in FIGS. 6 and 7 in terms of the layer constitution, except for the following point. That is, in the light receiving member shown in each of FIGS. 8 and 9, the amount of the metal element (13, 14, 15, 16) applied is made to be greater than the amount thereof required for terminating the dangling bonds present in the recesses of the irregular pattern. Particularly, in each of the light receiving members shown in FIGS. 8 and 9, as apparent from the plan view (b), a plurality of island-like regions 106 substantially not containing the metal element (13, 14, 15, 16) are spacedly distributed in a sea as a region 105 containing said metal element.

Figure 10B:
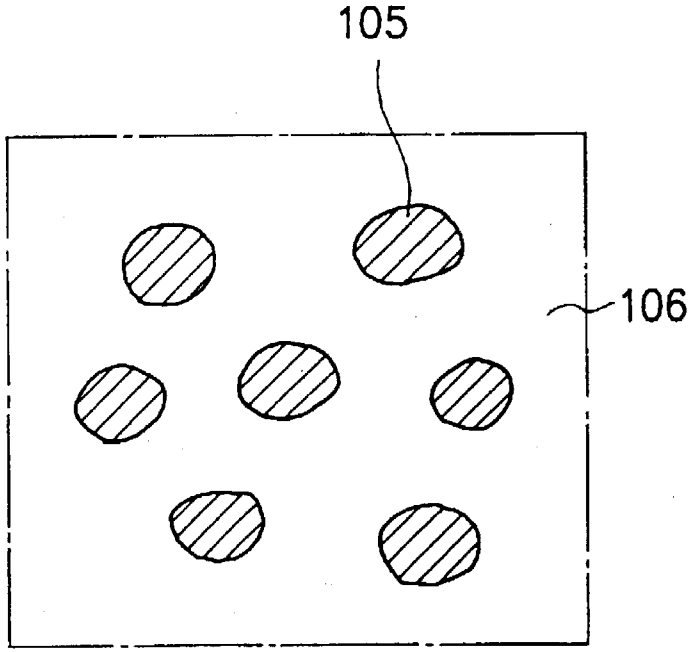
FIGS. 10(*a*) and 10(*b*) are schematic views for illustrating a tenth embodiment of an electrophotographic light receiving member according to the present invention, wherein FIG. 10(*a*) is a schematic cross-sectional view of said light receiving member and FIG. 10(*b*) is a schematic plan view of said light receiving member, observed from above.
Figure 10A:
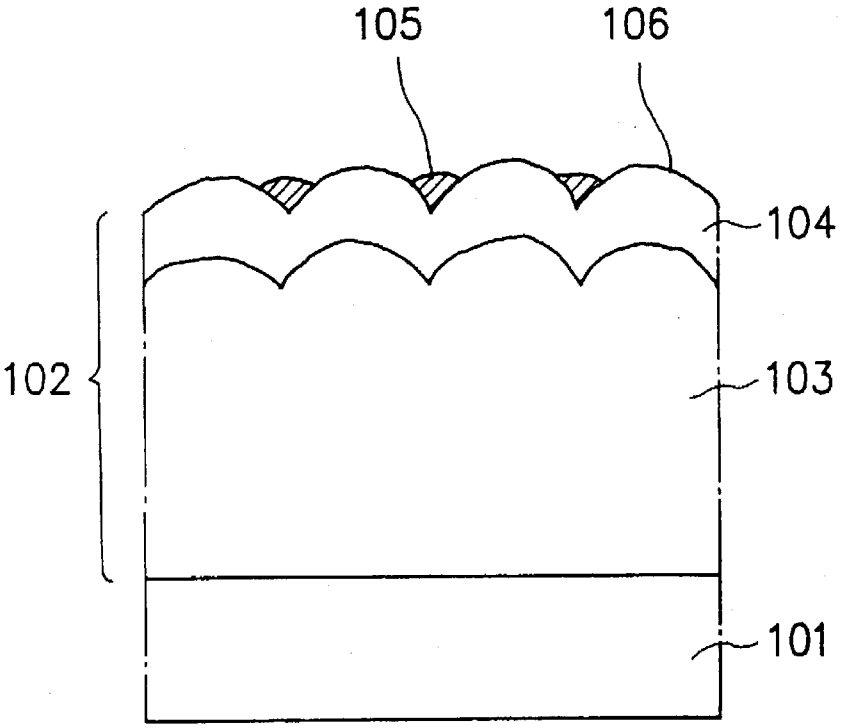

The electrophotographic light receiving member shown in FIG. 10 (that is, FIGS. 10(*a*) and 10(*b*)) comprises a substrate 101 and a light receiving layer 102 comprising a photoconductive layer 103 composed of an amorphous material containing silicon atoms as a matrix and a surface layer 104 composed of a non-single crystal material which is disposed on said substrate. In this light receiving member, the surface layer 104 has an outermost surface provided with an irregular pattern based on columnar structures present in the photoconductive layer, wherein the irregular pattern at the outermost surface of the surface layer comprises irregularities comprising protrusions and recesses, and a plurality of regions 105 (each having such a shape as shown in the plan view (b)) each comprising a region containing the metal element (13, 14, 15, 16) present so as to fill one of the recesses and another region 106 substantially not containing said metal element are two-dimensionally distributed at the outermost surface of the surface layer.

In the case of the light receiving member shown in FIG. 10, it is possible to take any of the two-dimensional distribution configurations shown in FIGS. 7 to 9.

In any of the above described electrophotographic light receiving members, the light receiving layer 102 may have a barrier layer (not shown in the figure) on the substrate side for the purpose of preventing a charge from injecting from the substrate side.

As apparent from the foregoing description, the electrophotographic light receiving member according to the present invention is characterized by having a specific two-dimensional distribution configuration comprising (a) a region containing at least a metal element selected from metal elements belonging to group 13, 14, 15, 16 of the periodic table (that is, a metal element (13, 14, 15, 16)) and a region substantially not containing said metal element (13, 14, 15, 16) in a state that the two regions (a) and (b) are two-dimensionally distributed at least at the outermost surface of the light receiving member. The two-dimensional distribution configuration can include (i) an embodiment in which a plurality of island-like regions containing the metal element (13, 14, 15, 16) are spacedly present in a region substantially not containing the metal element (13, 14, 15 16) (see, FIGS. 1, 2, 5, 6, 7, and 10), (ii) an embodiment in which the amount of the metal element (13, 14, 15, 16) applied is increased, and a plurality of island-like regions substantially not containing the metal element (13, 14, 15, 16) are spacedly present in a region containing the metal element (13, 14, 15, 16) (see, FIGS. 3, 4, 8 and 9), and (iii) an embodiment in which a region containing the metal element (13, 14, 15, 16) in a mosaic state and a region substantially not containing the element (13, 14, 15, 16) are present in a mingled state. Of these, the embodiment (i) is the most desirable.

Description will be made of specific examples of the metal element (13, 14, 15, 16) usable in the present invention. That is, specific examples of the group 13 metal element are Al, Ga, In, and Tl. Specific examples of the group 14 metal element are Sn and Pb. Specific examples of the group 15 metal element are As, Sb, and Bi. Specific examples of the group 16 metal element are Se and Te. In any case, it is possible to contain other metal element as long as its amount is slight (that is, less than 1 atomic %).

As for the proportion of the region containing the metal element (13, 14, 15, 16) (hereinafter referred to as metal element-bearing region) to the region substantially not containing said metal element (hereinafter referred to as metal-free region) in the two-dimensional configuration, it is desired to be preferably in the range of 5% to 60% or more preferably in the range of 10% to 50%.

In the case of the two-dimensional distribution configuration in which a plurality of island-like metal element-bearing regions are spacedly present in a metal element-free region, the size of the island-like metal element bearing region when the region is in a round form or a ellipsoidal-like form is desired to be preferably in the range of 200 Å to 5000 Å or more preferably in the range of 500 Å to 2000 Å in terms of diameter or major axis.

In the case of the two-dimensional distribution configuration in which a plurality of island-like metal element-free regions are spacedly present in a metal element-bearing region, the size of the island-like metal element-free region when the region is in a round form or a ellipsoidal-like form is desired to be preferably in the range of 2000 Å to 8000 Å or more preferably in the range of 3000 Å to 5000 Å in terms of diameter or major axis.

As for the concentration of the metal element (13, 14, 15, 16) in the two-dimensional distribution configuration, it is desired to be preferably in the range of 10 atomic ppm to 10000 atomic ppm or more preferably in the range of 50 atomic ppm to 2000 atomic ppm in the vicinity of the outermost surface of the light receiving layer.

In any case, the distribution state for the metal element (13, 14, 15, 16) to be contained in the metal element-bearing region of the two-dimensional distribution configuration should be decided while having a due care about the strength, transparency, and resistance to weather of the light receiving layer while having a due care so that the occurrence of a smeared image is prevented.

The incorporation of at least a metal element selected from metal elements belonging to group 13, 14, 15 and 16 of the periodic table (that is, a metal element (13, 14, 15, 16)) into the surface of a light receiving layer (formed of a deposited film) of an electrophotographic light receiving member by a manner of directly incorporating said metal element into the deposited film by means of ion implantation, thermal-induced CVD, vacuum evaporation, sputtering, plasma CVD, coating or plasma spraying or another manner of disposing a metal film comprising said metal element on the surface of the deposited film and thermally diffusing said metal film into the deposited film. In the latter manner, if necessary, after the film diffusion, the remaining metal film is removed.

The establishment of the foregoing two-dimensional configuration comprising a region containing the metal element (13, 14, 15, 16) and a region substantially not containing said metal element being two-dimensionally distributed at the outermost surface of a light receiving layer (formed of a deposited film) of an electrophotographic light receiving member may be conducted by (i) a manner by means of a vacuum evaporation process wherein said two-dimensional distribution is obtained by properly controlling the related conditions including the substrate temperature, pressure, and evaporation time; (ii) a manner wherein after having imparted energy to a given metal element (13, 14, 15, 16) to have a surface mobility, the metal element is moved to specific points in terms of defect level or the like at the surface of the deposited film as the light receiving layer to thereby locally deposit the metal element there; (iii) a manner of conducting a step of depositing a metal film comprising said metal element and a step of etching the metal film at the same time or alternately, whereby attaining the local deposition of the metal element; (iv) a manner of depositing a metal film comprising said metal element uniformly on the surface of the deposited film as the light receiving layer and subjecting the metal film to ion beam treatment to thereby locally remove the metal film; or (v) a manner of locally implanting said metal element by an ion implantation process using a patterning mask.

According to the manner by the vacuum evaporation process, a desired island-like distribution can be readily for the metal element (13, 14, 15, 16) by utilizing the phenomenon in that upon forming a deposited film on a substrate, no uniform deposited film is formed at the beginning stage of film deposition but a deposited film is locally formed convergently at specific points on the substrate (that is, points having a strong attracting force to active species of mobilizing on the substrate).

When it is intended to form an island-like distribution of the metal element (13, 14, 15, 16) with a relatively high concentration, this purpose can be attained by a manner wherein after forming the above island-like distribution by the vacuum evaporation process, while making the island-like distribution thus formed to be a core, a step of forming a metal film comprising said metal element and a step of etching said metal film are conducted alternately or at the same time thereby forming a metal film comprising said metal element only at the core.

When it is intended to form an island-like distribution of the metal element (13, 14, 15, 16) which is relatively difficult to be etched, this purposes can be attained by a manner wherein after forming a island-like distribution of said metal element by the above described vacuum evaporation process, while making the island-like distribution thus formed to be a core and utilizing the three-dimensional structure of the island-like distribution, a step of conducting film formation by the introduction of said metal element from the oblique direction and a step of conducting film removal from the vertical direction by means of sputtering are conducting at the same time, whereby forming a desired island-like distribution of said metal element based on the previously formed island-like distribution.

The formation of a metal film of the metal element (13, 14, 15, 16) as as to form a region containing said metal element in a state of two-dimensionally distributing at the outermost surface of a light receiving layer of an electrophotographic light receiving member may be conducted using a conventional vacuum evaporation apparatus (said region will be hereinafter referred to as metal element-bearing region). As such vacuum evaporation apparatus, there can be mentioned a vacuum evaporation apparatus shown in FIG. 11.

Figure 11:
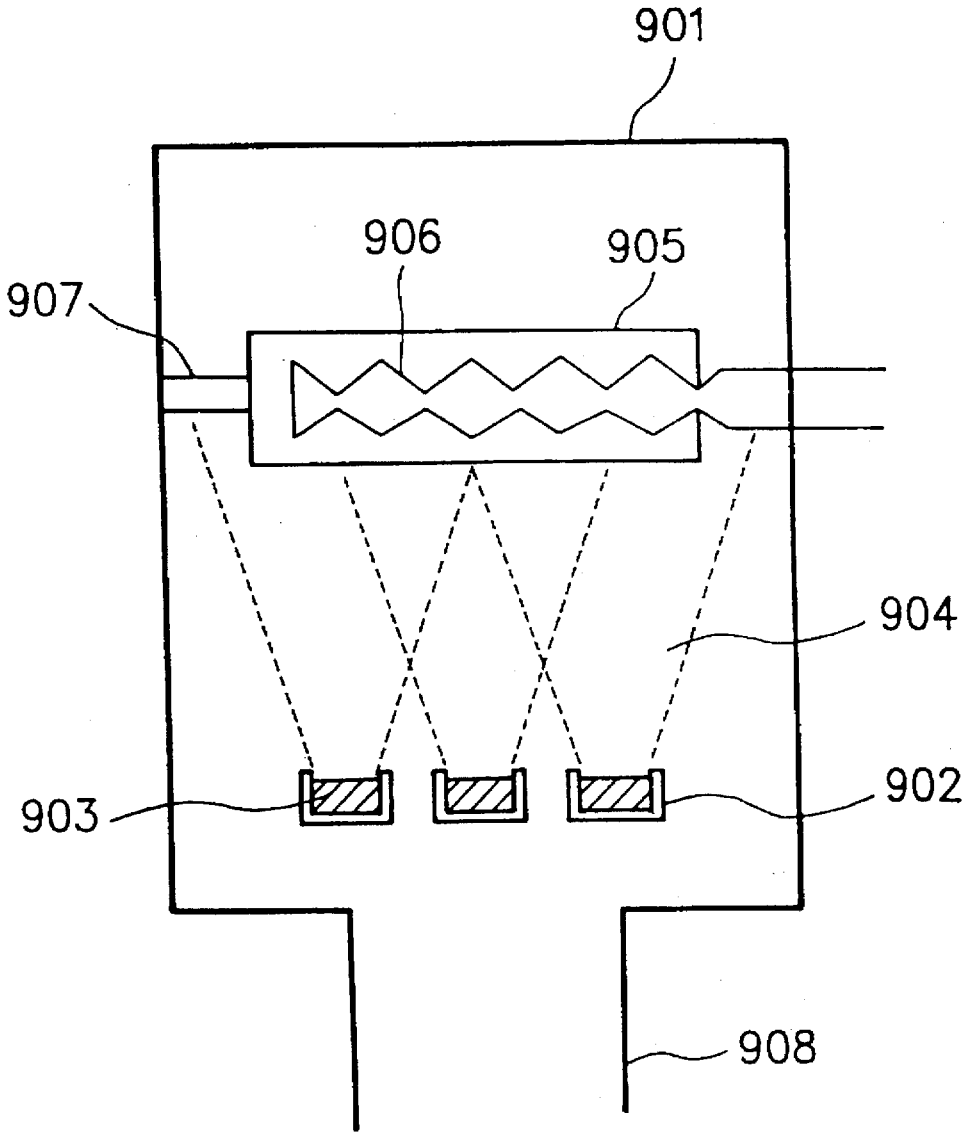
FIG. 11 is a schematic diagram illustrating a vacuum evaporation apparatus for depositing a metal atom on a light receiving layer of an electrophotographic light receiving member according to the present invention.

In FIG. 11, reference numeral 901 indicates a vacuum vessel, reference numeral 902 a crucible, reference numeral 903 is a metal source, reference numeral 904 is a metal vapor flow, reference numeral 905 a substrate (that is, a cylindrical electrophotographic light receiving member having a light receiving layer), reference numeral 906 a heater, reference numeral 907 a rotation axis connected to a motor (not shown), and reference numeral 908 an exhaust pipe.

In the vacuum evaporation apparatus shown in FIG. 11, the inside of the vacuum vessel 901 is evacuated through the exhaust pipe 908 by operating a vacuuming pump (not shown). The crucible 902 containing the metal source 903 therein is positioned in the vacuum vessel 901. The metal source 903 in the crucible 902 is fused by means of a heater (not shown) upon the film formation. The substrate 905 is held on a substrate holder (not shown) connected to the rotation axis 907 so that it can be rotated. The heater 906 is installed in the substrate holder and it serves to heat to and maintain the substrate 905 at a desired temperature.

The formation of the metal element-bearing region using the vacuum evaporation apparatus shown in FIG. 11 may be conducted, for example, as will be described below.

That is, first, the inside of the vacuum vessel 901 is evacuated to a gas pressure of $1\times10^{-7}$ Torr or less through the exhaust pipe 908 by operating the vacuum pump (not shown). The substrate 905 is heated to and maintained at a desired temperature by means of the heater 906 while rotating the substrate 905 by rotating the rotary axis 907. Then, the metal sources 903 contained in the crucibles 902 are heated to a desired temperature to generate metal vapor flows 904. By this, a metal thin film is formed on the entire surface of the substrate 905 (that is, on the entire surface of the electrophotographic light receiving member). During the film formation, by controlling the related film-forming conditions including the substrate temperature, inner pressure, film deposition rate, and film deposition time as desired, it is possible to make the metal thin film deposited on the surface of the light receiving member to have a desired two-dimensional distribution. Then, the light receiving member thus treated is subjected to heat treatment so that the metal thin film is thermally diffused into the light receiving layer of the light receiving member. By this, the light receiving member results in having a two-dimensional distribution configuration comprising a region containing a desired metal element and a region substantially not containing said metal element being two-dimensionally distributed at the outermost surface thereof.

If necessary, the resultant may be subjected to surface polishing treatment to remove metal thin film portions not related to the two-dimensional distribution configuration by means of a polishing apparatus.

Figure 16:
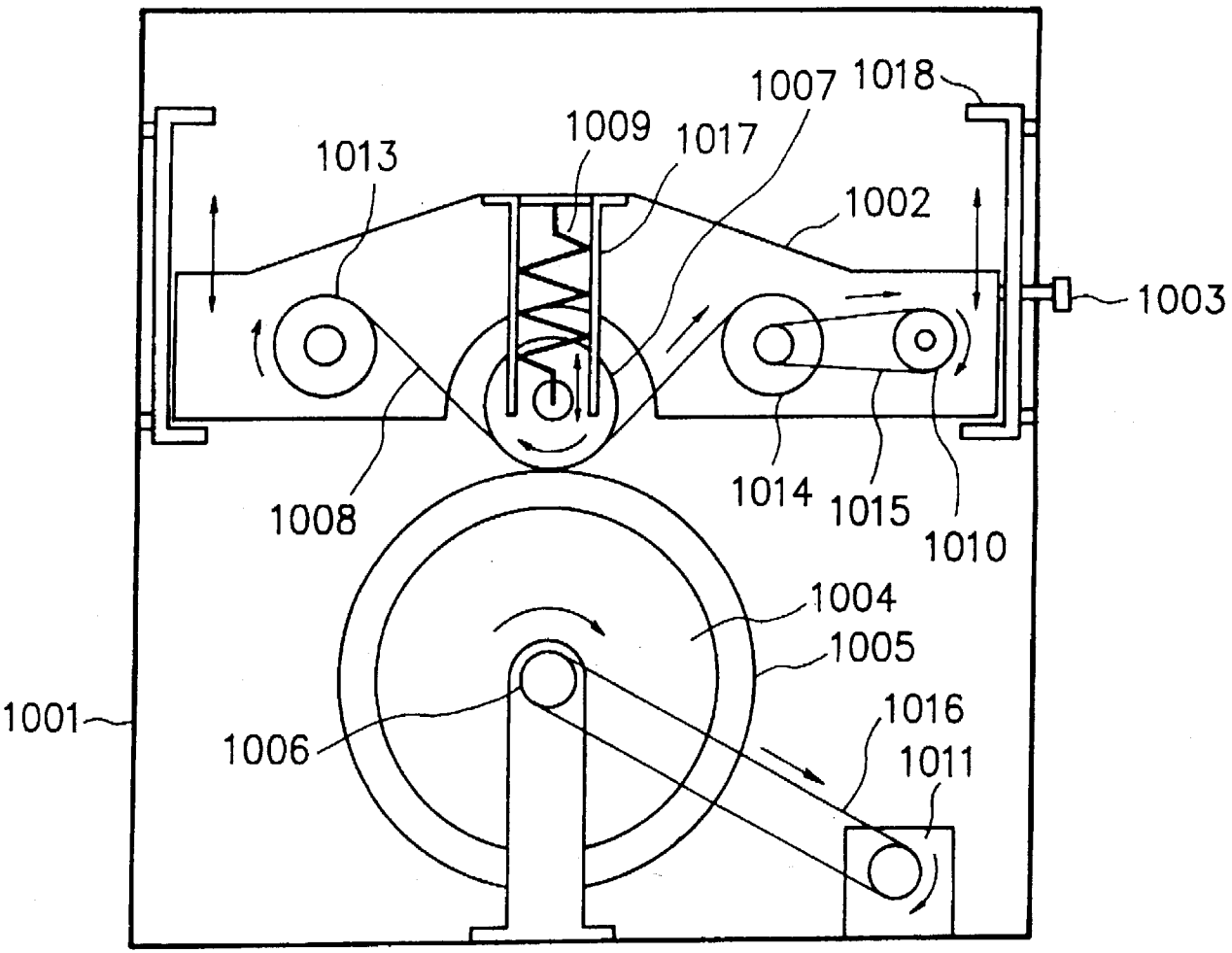
FIG. 16 is a schematic diagram illustrating a polishing apparatus for polishing the surface of an electrophotographic light receiving member according to the present invention.

FIG. 16 shows an example of such polishing apparatus. The polishing apparatus shown in FIG. 16 is for polishing the surface of an electrophotographic light receiving member by fixing the light receiving member to a rotary shaft and rotating the light receiving member while press-contacting an abrasive tape to the surface of the light receiving member. Particularly, the surface polishing treatment by the polishing apparatus is conducted, for example, in the following manner. That is, a polishing unit 1002 in the polishing apparatus 1001 is lifted upward and it is secured by a clamp 1003. Then, the light receiving member 1005 is assembled with a supporting table 1004 and the assembly is fixed to a rotary shaft 1006. The clamp 1003 is then loosed to lower the polishing unit 1002, and an abrasive tape 1008 is press-contacted with the surface of the light receiving member 1005 by means of a pressure roller 1007. The related conditions upon press-contacting the abrasive tape 1008 with the surface of the light receiving member 1005 through the pressure roller are controlled by regulating a pressure contacting spring 1009. The surface treatment of the light receiving member is conducted by actuating variable speed motors 1010 and 1011, wherein the abrasive tape 1008 is moved at a desired speed and the light receiving member 1005 is rotated at a desired rotation speed. In this way, the surface of the light receiving member can be treated in a desired state.

Now, in the present invention, as previously described, the deposition of at least a metal element selected from metal elements belonging to group 13, 14, 15, and 16 of the periodic table (hereinafter referred to as the metal element (13, 14, 15, 16)) on the outermost surface of an electrophotographic light receiving member in order to establish the foregoing two-dimensional distribution configuration may be conducted by a proper manner wherein conditions that make the metal element (13, 14, 15, 16) to convergently deposit in recesses of an irregular structure of the outermost surface of the light receiving member can be established. As such manner, there can be mentioned (i) a manner by means of plasma CVD or sputtering, wherein by precisely controlling the related conditions such that after having imparted energy to said metal element to have a sufficient surface mobility, upon the arrival at the surface of the light receiving member, the metal element mobilizes on the surface of the light receiving member to move into the recesses thereby locally depositing on the surface of the light receiving member; (ii) a manner of forming a metal thin film of said metal element on the surface of the light receiving member by means of plasma CVD, sputtering, thermal-induced CVD, vacuum evaporation or coating and subjecting the metal thin film to heat annealing treatment to cause island-like condensations of the metal element at the metal thin film; and (iii) a manner of conducting the formation of a metal thin of said metal element on the surface of the light receiving member by means of plasma CVD, sputtering, thermal-induced CVD, vacuum evaporation or coating while maintaining the substrate temperature at a high temperature and while precisely controlling other related conditions including the pressure and deposition time to thereby conduct the film formation and the condensation of the metal element at the same time. In the case of the manner (iii), when the light receiving member is heated at a high temperature over an excessively long period of time, terminators such as hydrogen atoms or/and halogen atoms are liable to release from the light receiving layer of the light receiving member to deteriorate the characteristics thereof and therefore, the film formation period is necessary to be shortened as shorter as possible.

Other than these manners, there can be also mentioned the foregoing manner of alternately conducting a step of film formation and a step of etching the film formed in the former step. In addition, there can be mentioned the foregoing manner of depositing the metal element on the surface of the light receiving member and polishing the surface of the resultant by the polishing apparatus to remove the metal element deposited at the protrusions.

As previously described, in the case of employing the vacuum evaporation process, a desired island-like distribution can be readily for the metal element (13, 14, 15, 16) by utilizing the phenomenon in that upon forming a deposited film on a substrate, no uniform deposited film is formed at the beginning stage of film deposition but a deposited film is locally formed convergently at specific points on the substrate (that is, points having a strong attracting force to active species of mobilizing on the substrate). When it is intended to form an island-like distribution of the metal element (13, 14, 15, 16) with a relatively high concentration, this purpose can be attained by a manner wherein after forming the above island-like distribution by the vacuum evaporation process, while making the island-like distribution thus formed to be a core, a step of forming a metal film comprising said metal element and a step of etching said metal film are conducted alternately or at the same time thereby forming a metal film comprising said metal element only at the core.

When it is intended to form an island-like distribution of the metal element (13, 14, 15, 16) which is relatively difficult to be etched, this purposes can be attained by a manner wherein after forming a island-like distribution of said metal element by the above described vacuum evaporation process, while making the island-like distribution thus formed to be a core and utilizing the three-dimensional structure of the island-like distribution, a step of conducting film formation by the introduction of said metal element from the oblique direction and a step of conducting film removal from the vertical direction by means of sputtering are conducting at the same time, whereby forming a desired island-like distribution of said metal element based on the previously formed island-like distribution.

In the following, explanation will be made of the substrate and each constituent layer in the electrophotographic light receiving member of the present invention.

SUBSTRATE

As the electrically conductive substrate used in the present invention, there can be mentioned, for example, metals such as stainless steel, Al, Cr, Mo, Au, In, Nb, Te, V, Ti, Pt, Pd and Fe, as well as alloys thereof. In addition, an insulative substrate made of a film or a sheet of a synthetic resin such as polyester, polyethylene, polycarbonate, cellulose acetate polyvinyl chloride, polystyrene and polyamide, glass or ceramic which has been applied with electrically conductive treatment at least to the surface thereof on which a light receiving layer is to be formed may be also used.

The substrate may be of any configuration such as cylindrical, plate-like or belt-like shape having a smooth or unevened surface, which can be properly determined depending upon the application use. The thickness of the substrate is properly determined so that the electrophotographic light receiving member can be formed as desired. In the case where flexibility is required for the electrophotographic light receiving member, it can be made as thin as possible within a range capable of sufficiently providing the function as the substrate. However, the thickness is usually greater than 10 μm in view of fabrication, handling and mechanical strength of the substrate.

It is possible for the surface of the substrate to be uneven in order to eliminate the occurrence of defective images caused by so-called interference fringe patterns being apt to appear in images formed in the case where image-formation is carried out using coherent monochromatic light such as laser beams. In this case, the uneven surface shape of the substrate can be formed by a known method as described, for example, in U.S. Pat. Nos. 4,650,736, 4,696,884 and 4,705,733.

In an alternative, the uneven surface shape of the substrate may be composed of a plurality of fine spherical dimples which are more effective in eliminating the occurrence of defective images caused by the interference fringe patterns especially in the case of using the foregoing coherent monochromic light. In this case, the scale of each of the irregularities composed of a plurality of fine spherical dimples is smaller than the resolving power required for the electrophotographic light receiving member. The irregularities composed of a plurality of fine spherical dimples at the surface of the substrate can be formed by a known method, for example, as described in U.S. Pat. No. 4,735,883.

PHOTOCONDUCTIVE LAYER

In the present invention, the photoconductive later as the light receiving layer or as a constituent of the light receiving layer disposed on the substrate is composed of a non-single crystal silicon-containing material (typically, an amorphous silicon series material such as an a-Si material). The photoconductive layer may be formed by a vacuum deposition film-forming process while adjusting the conditions for the numerical values of film-forming parameters properly so as to obtain desired characteristics. Specifically, the photoconductive layer may be formed by various ways of film deposition processes, for example, glow discharge process (that is, alternating current discharge CVD process such as low frequency discharge CVD, high frequency discharge CVD (that is, RF discharge CVD) or microwave discharge CVD, or direct current discharge CVD process), sputtering process, vacuum evaporation process, ion plating process, light-induced CVD process and thermal-induced CVD process. These film deposition processes may be properly selected and adopted depending on factors such as production conditions, installation cost, production scale and characteristics desired for an electrophotographic light receiving member to be produced. Among these film deposition processes, the glow discharge process, sputtering process and ion plating process are suitable since conditions for producing an electrophotographic light receiving member having desired characteristics can be controlled relatively easily. The layer may be formed by using these film deposition processes in combination in one identical system.

Herein, description will be made of a typical example of forming a photoconductive layer composed of an a-Si material by the glow discharge process. The formation of the photoconductive layer in this case may be conducted, basically, by introducing a raw material gas capable of supplying silicon atoms (Si) and a raw material gas capable of supplying hydrogen atoms (H) or/and halogen atoms (X) into a deposition chamber the inner pressure of which being capable of being reduced while adjusting their flow rates and causing glow discharge in the deposition chamber containing to thereby form a film composed of an a-Si(H,X) material as the photoconductive layer on a substrate positioned in the deposition chamber.

As the raw material that can be used effectively as the Si supplying gas in the present invention, there can be mentioned gaseous or gasifiable silicon hydrides (silanes) such as $SiH_4$, $Si_2H_6$, $Si_3H_8$ and $Si_4H_{10}$. Of these, $SiH_4$ and $Si_2H_6$ are most preferred in view of easy handling upon forming the layer and high Si supplying efficiency. The raw material gas supplying Si may be diluted, if required, with a gas such as $H_2$, He, Ar or Ne.

In the present invention, it is necessary for the photoconductive layer to contain hydrogen atoms or/and halogen atoms in order to compensate dangling bonds of the silicon atoms so that the photoconductive layer excels in quality and exhibits a desired photoconductive property and a desired charge-retaining property. The amount of the hydrogen atoms or halogen atoms or the total amount of the hydrogen atoms and halogen atoms contained in the photoconductive layer is desired to be preferably in the range of 1 to 40 atomic %, more preferably in the range of 3 to 35 atomic %, or most preferably in the range of 5 to 30 atomic %, versus the total amount of the silicon atoms and hydrogen atoms or/and halogen atoms.

The amount of the hydrogen atoms or/and halogen atoms contained in the photoconductive layer may be desirably adjusted by properly controlling the related film-forming conditions such as the substrate temperature, the amount of a raw material capable of supplying hydrogen atoms or/and halogen atoms to be introduced into the deposition chamber, or the discharging electric power to be applied, the gas pressure, and the like.

In the case of conducting the film formation using a gaseous hydrogen-containing silicon compound in combination with hydrogen gas, the amount of hydrogen atoms to be contained in a layer as the photoconductive layer may be easily controlled as desired.

In order to structurally introduce hydrogen atoms into the photoconductive layer, it is possible to cause glow discharge in the presence of $H_2$ or a silicon hydride such as $SiH_4$, $Si_2H_6$, $Si_3H_8$ or $Si_4H_{10}$ and silicon or a silicon compound capable of supplying Si in the deposition chamber.

As the raw material for introducing the halogen atoms into the photoconductive layer in the present invention, there can be mentioned gaseous or gasifiable halogen compounds such as gaseous halogen, halides inter-halogen compounds and halogen-substituted silane derivatives. Other than these, there can be also mentioned gaseous or gasifiable halogen atom-containing silicon hydride compounds. Specific examples of such halogen compound which is desirably usable in the present invention are fluorine gas ($F_2$); inter-halogen compounds such as BrF, ClF, $ClF_3$, $BrF_3$, $BrF_5$, $IF_3$, and $IF_7$; and halogen-substituted silicon derivatives such as $SiF_4$ and $Si_2F_6$.

It is possible for the photoconductive layer to contain at least one kind of atoms selected from the group consisting of carbon atoms (C), oxygen atoms (O), nitrogen atoms (N), and germanium atoms (Ge). The amount of one or more kinds of these atoms contained in the photoconductive layer is desired to be preferably in the range of 0.00001 to 50 atomic %, more preferably in the range of 0.01 to 40 atomic %, or most preferably in the range of 1 to 30 atomic %, versus the total amount of the silicon atoms and said one or more kinds of atoms contained in the photoconductive layer. Said one or more kinds of atoms may be contained in the photoconductive layer either in a uniform distribution state in that they are uniformly contained in the entire layer region thereof or in an uneven distribution state in that the concentration thereof is varied in the layer thickness direction.

Further, in the present invention, if necessary, it is possible for the photoconductive layer to contain atoms of an element capable of controlling the conductivity (hereinafter referred to as conductivity controlling atoms or conductivity controlling element). The conductivity controlling atoms may be incorporated such that the photoconductive layer has a partial layer region wherein said atoms are distributed uniformly in the thickness direction. Alternatively, the conductivity controlling atoms may be incorporated such that the photoconductive layer has a partial layer region wherein said atoms are distributed unevenly in the thickness direction. However, in any case, when no surface layer is disposed on the photoconductive layer, it is necessary that no conductivity atoms be contained in the vicinity of the outermost surface of the photoconductive layer.

As for the amount of the conductivity controlling atoms to be contained in the photoconductive layer, it is desired to be preferably in the range of from $1\times10^{-3}$ to $5\times10^{-4}$ atomic ppm, more preferably in the range of from $1\times10^{-2}$ to $1\times10^{4}$ atomic ppm, or most preferably, in the range of from $1\times10^{-1}$ to $5\times10^{3}$ atomic ppm respectively based on the amount of the silicon atoms.

As the conductivity controlling element, so-called impurities in the field of the semiconductor can be mentioned and those usable herein are elements belonging to group 13 of the periodic table that provide p-type conductivity (hereinafter simply referred to as group 13 element) or elements belonging to the group 15 of the periodic table that provide n-type conductivity (hereinafter simply referred to as group 15 element).

Specifically, the group 13 element can include B, Al, Ga, In and Tl, and of these, B being particularly preferred. The group 15 element can include P, As, Sb and Bi, and of these, P being particularly preferred.

In order to structurally introduce the conductivity controlling atoms of the group 13 element or the group 15 element into the photoconductive layer, a gaseous raw material capable of supplying such atoms is introduced into the deposition chamber together with other gases for forming the photoconductive layer upon forming the layer.

As the raw material capable of supplying the group 13 atoms and as the raw material capable of supplying the group 15 atoms, it is desired to adopt those which are gaseous at a normal temperature and a normal pressure or those which can be easily gasified at least under the layer-forming conditions.

Specifically, the raw material capable of supplying the group 13 atoms can include, for example, boron hydrides such as $B_2H_6$, $B_4H_{10}$, $B_5H_9$, $B_5H_{11}$, $B_6H_{10}$, $B_6H_{12}$ and $B_6H_{14}$, and boron halides such as $BF_3$, $BCl_3$, $BBr_3$ which can supply boron atoms.

As the raw materials usable effectively for introducing the group 15 atoms, there can be mentioned phosphorus hydrides such as $PH_3$ and $P_2H_4$, and phosphorus halides such as $PH_4I$, $PF_3$, $PF_5$, $PCl_3$, $PCl_5$, $PBr_3$, $PBr_5$ and $PI_3$ for introducing phosphorus atoms.

Further, these raw materials for introducing the conductivity controlling atoms may be diluted with a gas such as $H_2$, He, Ar or Ne upon use, if necessary.

As for the thickness of the photoconductive layer, it should be properly determined having due cares not only about the electrophotographic characteristics desired for the resulting electrophotographic light receiving member end but also about economical effects.

However, in general, the photoconductive layer is made to be of a thickness preferably in the range of 3 to 120 μm, more preferably in the range of from 5 to 100 μm, or most preferably in the range of 10 to 80 μm.

For forming a photoconductive layer having characteristics capable of attaining the object of the present invention, it is necessary that the temperature of the substrate and the gas pressure in the reaction chamber upon the layer formation are properly adjusted depending on he requirements.

As for the temperature of the substrate (Ts) upon the layer formation, it is properly selected within an optimum range in accordance with the design for the layer. In general, it is desired to be preferably in the range of 20° to 500° C., more preferably in the range of 50° to 480° C., or most preferably in the range of 100° to 450° C.

The gas pressure in the reaction chamber upon the layer formation is also properly selected within an optimum range in accordance with the design for the layer. In general, it is desired to be preferably in the range of $1\times10^{-5}$ to 100 Torr, more preferably in the range of $5\times10^{-5}$ to 30 Torr, or most preferably in the range of $1\times10^{-4}$ to 10 Torr.

However, the actual conditions for forming each of the photoconductive layer such as the temperature of the substrate and the gas pressure in the reaction chamber cannot usually be determined with ease independent of each other. Accordingly, the conditions optimal to the layer formation are desirably determined based on relative and organic relationships for forming the photoconductive layer having desired properties.

In the light receiving member according to the present invention, it is desired that a layer region containing at least aluminium atoms, silicon atoms, and hydrogen atoms or/and halogen atoms in a state of being distributed unevenly in the thickness direction is disposed in the layer region of the photoconductive layer which is situated on the side of the substrate.

Further, in the electrophotographic light receiving member, it is possible to dispose a contact layer between the substrate and the photoconductive layer for the purpose of improving the adhesion of the photoconductive layer with the substrate. The contact layer in this case may be composed of a material selected from the group consisting of $Si_3N_4$, $SiO_2$, SiO, and amorphous materials containing silicon atoms, at least either hydrogen atoms or halogen atoms, and at least either nitrogen atoms or oxygen atoms.

In addition, it is possible to dispose a charge injection inhibition layer capable of preventing a charge from injecting from the substrate side under the photoconductive layer. Further in addition, it is possible to dispose a light absorbing layer capable of preventing the occurrence of light interference under the photoconductive layer.

SURFACE LAYER

The light receiving layer of the electrophotographic light receiving member according to the present invention may comprise a surface layer in addition to the above described photoconductive layer. The surface layer is disposed on the photoconductive layer disposed on the substrate and it is composed of an amorphous silicon series material such as an a-Si material. The surface layer has a free surface. The surface layer is disposed for the purpose of making the electrophotographic light receiving member to excel in moisture resistance, repetitive use property, electric withstand voltage, use-environmental characteristics, and durability. In the case where the light receiving layer comprises the photoconductive layer composed of an a-Si material and the surface layer composed of an a-Si material stacked on the photoconductive layer, the layer interface between the two layers is sufficiently assured in terms of chemical stability because the constituent amorphous material of each of the two layers comprises silicon atoms.

As well as in the case of the photoconductive layer, the surface layer may be formed by a vacuum deposition film-forming process while adjusting the conditions for the numerical values of film-forming parameters properly so as to obtain desired characteristics. Specifically, the surface layer may be formed by various ways of film deposition processes, for example, glow discharge process (alternating current discharge CVD process such as low frequency discharge CVD, high frequency discharge CVD (that is, RF discharge CVD) or microwave discharge CVD, or direct current discharge CVD), sputtering process, vacuum evaporation process, ion plating process, light-induced CVD process and thermal-induced CVD. These film deposition processes may be properly selected and adopted depending on factors such as production conditions, installation cost, production scale and characteristics desired for an electrophotographic light receiving member to be produced. However, it is desired for the surface layer to be formed by the same film deposition process employed for the formation of the photoconductive layer in view of the productivity for an electrophotographic light receiving member to be produced. In this case, the film-forming procedures and the raw material gases used in the formation of the photoconductive layer can be used.

Herein, description will be made of a typical example of forming a surface layer composed of an amorphous SiC material by the glow discharge process. That is, the formation thereof may be conducted, basically, by introducing a raw material gas capable of supplying silicon atoms (Si), a raw material gas capable of supplying carbon atoms (C), and a raw material gas capable of supplying hydrogen atoms (H) or/and halogen atoms (X) into a deposition chamber the inner pressure of which being capable of being reduced while adjusting the flow rates of these raw material gases and causing glow discharge in the deposition chamber, whereby forming a film composed of an a-SiC(H, X) material as the surface layer on the photoconductive layer previously formed on the substrate which is positioned in the deposition chamber.

The surface layer may be composed of any silicon-containing amorphous material. The silicon-containing amorphous material by which the surface layer is constituted is desired to contain at least an element selected from the group consisting of carbon (C), nitrogen (N) and oxygen (O). In a most preferred embodiment, the surface layer is composed of an amorphous material containing SiC as the main constituent (hereinafter referred to as a-SiC material). The a-SiC material is desired to contain carbon atoms in an amount of 30 to 90 atomic % versus the total amount of the silicon atoms and carbon atoms.

In the present invention, the surface layer is necessary to contain at least either hydrogen atoms (H) or halogen atoms (X) not only in order to compensate dangling bonds of the silicon atoms in the surface layer but also in order to make the surface layer to excel in quality and charge retentivity. The amount of the hydrogen atoms or halogen atoms and the total amount of the hydrogen atoms and halogen atoms are desired to be in the range of 41 to 71 atomic % versus the total amount of the silicon atoms and the hydrogen atoms or/and halogen atoms.

Now, it is known that when a surface layer (composed of an a-SiC material) of an electrophotographic light receiving member contains defects chiefly based on dangling bonds of the silicon atoms or/and carbon atoms, such defects are liable to entail drawbacks for the characteristics of the light receiving member such that a charge is injected from the free surface side to deteriorate the charging property; a change is liable to occur in the surface structure under high humidity environmental condition, resulting in deteriorating the charging property; and a charge is liable to inject into the surface layer by the photoconductive layer upon conducting the corona charging or light irradiation wherein the charge thus injected is trapped at the defects in the surface layer to cause the occurrence of a ghost upon continuously repeating the electrophotographic image-forming process.

However, when the surface layer contains at least either hydrogen atoms or halogen atoms in an amount in the range of 41 to 71 atomic % as above described, the foregoing defects are markedly decreased and as a result, the electrophotographic light receiving member becomes to be free of the foregoing drawbacks. In the case where the amount of the hydrogen atoms or/and halogen atoms contained in the surface layer is exceeding 71 atomic %, the surface layer is insufficient in surface hardness and because of this, an electrophotographic light receiving member having such surface layer is liable to be insufficient in durability upon repeated use.

The amount of the hydrogen atoms or/and halogen atoms contained in the surface layer may be desirably adjusted in the above range by properly controlling the related film-forming conditions such as the amount of a raw material capable of supplying hydrogen atoms or/and halogen atoms to be introduced into the deposition chamber, the substrate temperature, the discharging electric power applied, the gas pressure, and the like.

As the raw material that can be effectively used as the silicon-supplying raw material gas, the silicon-supplying raw materials mentioned in the case of the photoconductive layer can be selectively used.

As the raw material for introducing carbon atoms (C) which is usable in the present invention is preferably a material which is gaseous at normal temperature and a normal pressure or a material which can be easily gasified at least under conditions of forming the surface layer. Specific examples of such material are $CH_4$, $C_2H_6$, $C_3H_8$, and $C_4H_{10}$. Of these, $CH_4$ and $C_2H_6$ are most preferred in view of easy handling upon forming the layer and high C-supplying efficiency. These C-supplying raw material may be diluted, if required, with a gas such as $H_2$, He, Ar or Ne.

As the raw material for introducing nitrogen atoms (N) or oxygen atoms (O) which is usable in the present invention is preferably a material which is gaseous at normal temperature and a normal pressure or a material which can be easily gasified at least under conditions of forming the surface layer. Specific examples of such material are $N_2$, $NH_3$, NO, $N_2O$, $NO_2$, $H_2O$, $O_2$, CO, and $CO_2$. These N- or O-supplying raw material may be diluted, if required, with a gas such as $H_2$, He, Ar or Ne.

In order to structurally introducing hydrogen atoms into the surface layer, it is possible to cause glow discharge in the presence of $H_2$ or a silicon hydride such as $SiH_4$, $Si_2H_6$, $Si_3H_8$ or $Si_4H_{10}$ and silicon or a silicon compound capable of supplying Si in the deposition chamber.

As the raw material for introducing halogen atoms into the surface layer in the present invention, the halogen-supplying raw materials mentioned in the case of the photoconductive layer can be selectively used.

In the case where the surface layer contains at least one kind of atoms selected from consisting of carbon atoms, nitrogen atoms and oxygen atoms (hereinafter referred to atoms (C,N,O)), the atoms (C,N,O) may be incorporated in a state of being distributed in the entire layer region of the surface layer. Alternatively, the atoms (C,N,O) may be incorporated such that the surface layer has a layer region where the atoms (C,N,O) being distributed unevenly in the thickness direction. However, in any case, it is necessary for the atoms (C,N,O) to be throughout distributed with a uniform state in the plane direction in parallel with the surface of the substrate in view of attaining uniformity of the characteristics in the plane direction.

As for the thickness of the surface layer, it should be properly determined having due cares about the electrophotographic characteristics desired for the resulting electrophotographic light receiving member, about the interrelation of the surface layer with the photoconductive layer, and also about economical effects. However, in general, the surface layer is made to be of a thickness preferably in the range of 20 Å to 10 μm, more preferably in the range of 100 Å to 5 μm, or most preferably in the range of 500 Å to 2 μm. In the case where the surface layer of less than 20 Å in thickness, the effects of the present invention can not be effectively attained as desired. In the case where the surface layer is of a thickness which is exceeding 10 μm, a problem is liable to entail in that a reduction is occurred in the electrophotographic characteristics, particularly wherein an increase is occurred in the residual potential.

The surface layer constituted by any of the foregoing amorphous silicon materials can be formed in the same manner as in the case of forming the photoconductive layer.

In the formation of the surface layer by means of the glow discharge process, the temperature of the substrate and the gas pressure in the deposition chamber upon film formation are important factors in order to form the surface layer which exhibits the characteristics required therefor. As for the temperature of the substrate, it is properly selected within an optimum range and it is, preferably, in the range of 20° to 500° C., more preferably, in the range of 50° to 480° C., or most preferably, in the range of 100° to 450° C. As for the gas pressure in the deposition chamber, it is, preferably, in the range of $1\times10^{-5}$ to 100 Torr, more preferably, in the range of $5\times10^{-5}$ to 30 Torr, or most preferably, in the range of $1\times10^{-4}$ to 10 Torr.

However, the actual conditions for forming the surface layer such as the temperature of the substrate, the gas pressure in the deposition chamber and the discharging electric power applied cannot usually be determined with ease independent of each other. Accordingly, the conditions optimal to the layer formation are desirably determined based on relative and organic relationships for forming the surface layer having desired properties.

In the present invention, it is possible to dispose, between the photoconductive layer and the surface layer, a layer region composed of an a-Si material containing at least one kind of atoms selected from the group consisting of carbon atoms and nitrogen atoms in a state in that their concentration is gradually decreased toward the photoconductive layer, in order to prevent the occurrence of a negative influence due to the interference of light reflected at the interface between the photoconductive layer and the surface layer.

Further, it is possible to dispose, between the photoconductive layer and the surface layer, a so-called blocking layer composed of an a-Si material containing at least one kind of atoms selected from the group consisting of carbon atoms, nitrogen atoms and oxygen atoms in an amount which is smaller than that of said atoms contained in the surface layer, in order to attain an improvement in the charging efficiency.

Description will be made of a fabrication apparatus and a method of forming a deposited film to constitute any of the foregoing layer by the RF glow discharge process (that is, the RF plasma CVD process) or the microwave discharge process (that is, the microwave plasma CVD process).

Figure 12:
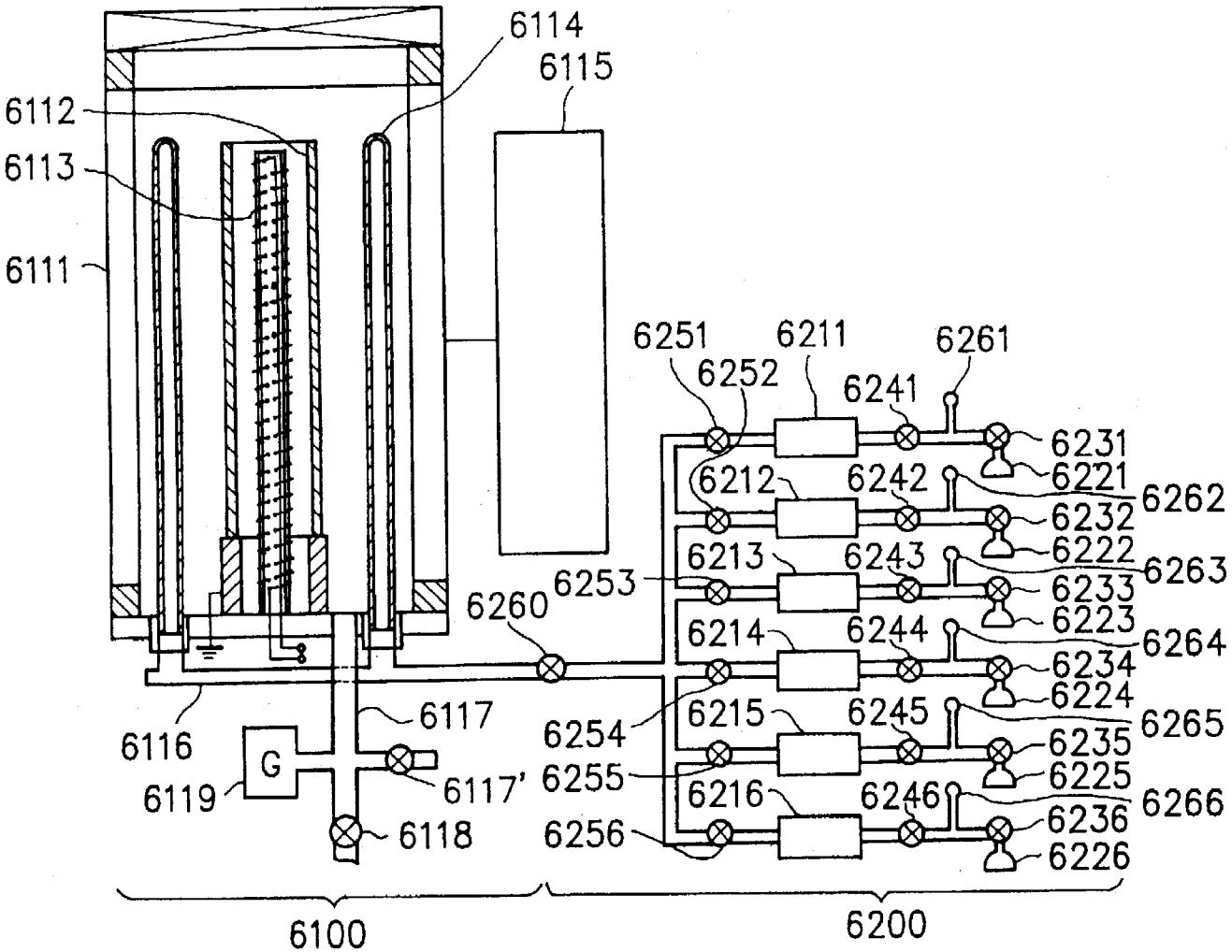
FIG. 12 is a schematic explanatory view illustrating an RF plasma CVD apparatus for producing an electrophotographic light receiving member according to the present invention.

FIG. 12 is a schematic view for illustrating an example of a fabrication apparatus for producing an electrophotographic light receiving member by the RF plasma CVD process (the fabrication apparatus will be hereinafter referred to as RF plasma CVD apparatus).

Figure 13A:
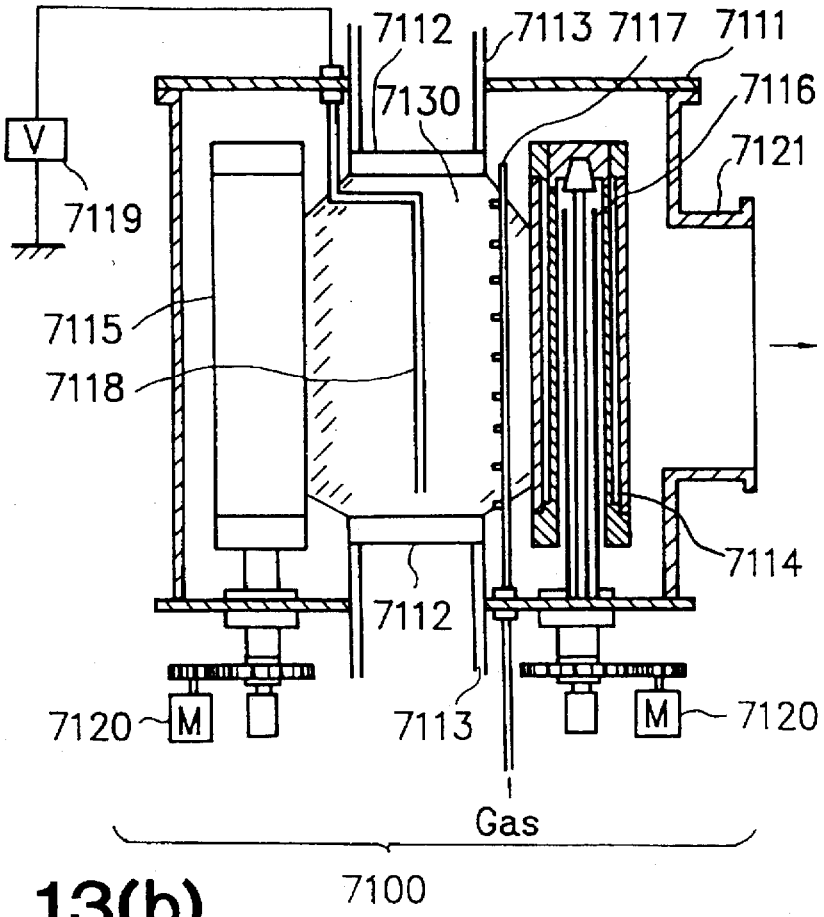
FIGS. 13(*a*) and 13(*b*) are schematic explanatory views illustrating a microwave plasma CVD apparatus for producing an electrophotographic light receiving member according to the present invention, wherein FIG. 13(*a*) is a schematic side elevational cross sectional view of said apparatus, and FIG. 13(*b*) is a schematic lateral cross sectional view of said apparatus, observed from above.
Figure 13B:
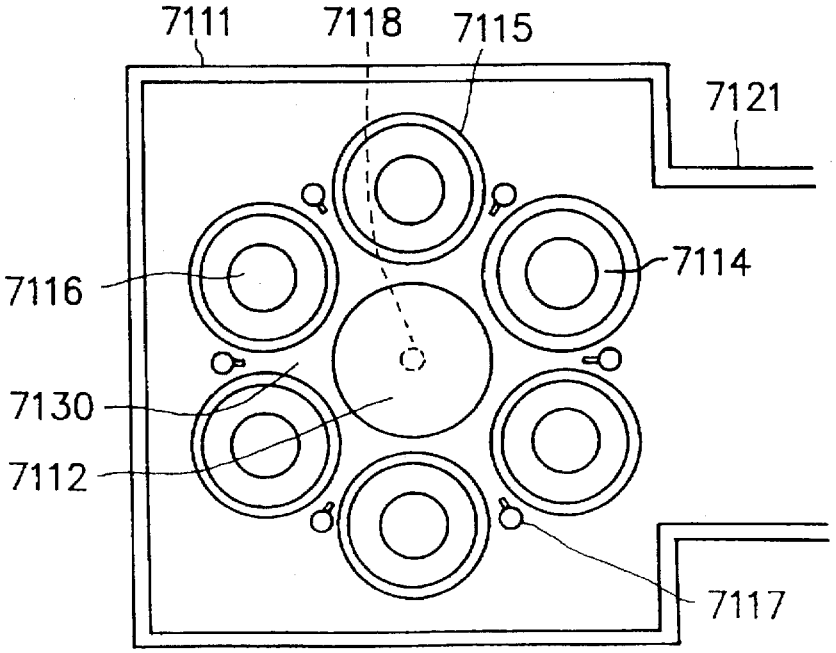

FIG. 13 is a schematic view for illustrating an example of a fabrication apparatus for producing an electrophotographic light receiving member by the microwave plasma CVD process (the fabrication apparatus will be hereinafter referred to as μW plasma CVD apparatus), wherein FIG. 13(*a*) is a schematic side elevational cross sectional view of said apparatus and FIG. 13(*b*) is a schematic lateral cross sectional view of said apparatus, observed from above.

The RF plasma CVD apparatus shown in FIG. 12 is of such constitution as will be described in the following. That is, the RF plasma CVD apparatus comprises a deposition system 6100, a raw material gas supply system 6200 and an exhaustion system (comprising an exhaust pipe 6117 connected to a vacuum pump (not shown) for evacuating the inside of a reaction chamber 6111.

The reaction chamber 6111 in the deposition system 6100 contains a cylindrical substrate 6112, a heater 6113 for heating the substrate 6112 and a raw material gas introduction pipe 6114 which are installed therein. And in the deposition system, an RF matching box 6115 is electrically connected to the reaction chamber 6111.

The raw material gas supply system 6200 comprises reservoirs 6221–6226 for raw material gases, valves 6231–6236, 6241–6246, 6251–6256, and mass flow controllers 6211–6216, in which each reservoir is connected by way of a valve 6260 to the gas introduction pipe 6114 in the reaction chamber 6111.

The formation of a deposited film as a layer constituting a light receiving layer of an electrophotographic light receiving member using the RF plasma CVD apparatus may be conducted, for example, as described below.

At first, a cylindrical substrate 6112 is disposed in the reaction chamber 6111, and the inside of the reaction chamber 6111 is evacuated to a desired vacuum degree through the exhaust pipe 6117 by operating the vacuum pump. Then, the temperature of the cylindrical substrate 6112 is controlled to and maintained at a predetermined temperature of 20° C. to 500° C. by means of the heater 6113.

For introducing raw material gases for forming the deposited film into the reaction chamber 6111, closure of the gas reservoir valves 6231–6236 and a leak valve 6117' of the reaction chamber, as well as opening of the inlet valves 6241–6246, exit valves 6251–6256 and an auxiliary valve 6260 are confirmed and then a main valve 6118 is opened to evacuate the inside of the reaction chamber 6111 and a gas pipeline 6116. When the reading on a vacuum gauge 6119 reaches about $5\times10^{-6}$ Torr, the auxiliary valve 6260 and the exit valves 6251–6256 are closed. Subsequently, each of the raw material gases in the gas reservoirs 6221–6226 is introduced by opening each of the valves 6231–6236, add the pressure for each of the raw material gases is controlled to 2 kg/cm$^2$ by pressure controllers 6261–6265. Then, the inlet valves 6241–6246 are gradually opened to introduce the raw material gases into the mass flow controllers 6211–6216 respectively.

After the preparation for the film formation has thus been completed, a deposited film as each of the photoconductive layer and the surface layer is formed on the cylindrical substrate 6112. That is, when the temperature of the cylindrical substrate 6112 reaches a predetermined temperature, the relevant exit valves 6251–6256 and the auxiliary valve 6260 are gradually opened and predetermined raw material gases from the gas reservoirs 6221–6226 are introduced into the reaction chamber 6111 through the gas introduction pipe 6114. The flow rate of each of the raw material gases is controlled to a predetermined value by means of each of the mass controllers 6211–6216. In this case, the opening of the main valve 6118 is controlled such that the inner pressure of the reaction chamber 6111 is a predetermined pressure of less than 1 Torr, while observing the reading on the vacuum gauge 6119. When the inner pressure of the reaction chamber 6111 becomes stable at said predetermined pressure, an RF power source (not shown) is switched on to apply a desired RF power into the reaction chamber 611 through the RF matting box 3115 to cause RF glow discharge in the reaction chamber 6111, wherein the raw material gases introduced into the reaction chamber are decomposed by the electric discharge energy to cause the formation of a deposited film on the cylindrical substrate 6112. After the formation of the deposited film at a desired thickness, the application of the RF power is suspended and the related exit valves are closed to terminate the introduction of the raw material gases into the reaction chamber, thereby completing the formation of the deposited film.

By repeating the above film-forming procedures several times, a desired light receiving layer having a multi-layered structure is formed.

It is a matter of course that all of other exit valves then those for the required raw material gases are closed upon forming the respective layers. Further, in order to avoid the respective raw material gases from remaining in the reaction chamber 6111 and in the pipelines from the exit valves 6251–6256 to the reaction chamber 6111, a procedure of once evacuating the inside of the system to a high vacuum by closing the exit valves 6251–6256, opening the auxiliary valve 6260 and fully opening the main valve 6118 is conducted as required.

Further, in order to uniformly forming a deposited film on the entire surface of the cylindrical substrate 6112, it is desired for the substrate to be rotated at a predetermined rotation speed by a driving means (not shown) during the film formation.

It is a matter of course that the kind of raw material gases and the operations for the valves are properly changed in accordance with the conditions for forming the respective layers.

Description will be made of the uW plasma CVD apparatus shown in FIG. 13.

The μW plasma CVD apparatus comprises a deposition system 7100 (comprising a reaction chamber 7111) and a raw material gas supply system (not shown) comprising the raw material gas supply system 6200 shown in FIG. 12.

The reaction chamber 7111 in the deposition system 7100 has a structure capable of being vacuumed, and it is provided with an exhaustion system comprising an exhaust pipe 7121 connected to a vacuuming device comprising a diffusion pump (not shown).

The reaction chamber 7111 is provided with a microwave introduction window 7112 made of a microwave transmissive material (such as quarts to which a waveguide 7113 extending from a microwave power source (not shown) through a stub tuner (not shown) and an isolator (not shown) is connected. In the reaction chamber 7111, there are spacedly arranged a plurality of cylindrical substrate holders 7114 (each having a heater 7116 for heating a substrate) each having a cylindrical substrate 7115 (on which a deposited film is to be formed) positioned thereon so as to circumscribe a discharge space 7130. The reaction chamber 7111 has a plurality of raw material gas introduction pipes 7117 each being positioned between each adjacent substrate holders, and an electrode 7118 for applying a bias voltage for controlling the potential of plasma generated. The electrode 7118 is electrically connected to a power source 7119 (comprising, for example, a D.C. power source). The raw material gas introduction pipes 7117 are connected to the gas pipe line 6116 (see, FIG. 12) extending from the raw material gas supply system 6200. Herein, description of the raw material gas supply system 6200 employed in the μW plasma CVD apparatus is omitted since the raw material gas supply system has been already detailed in the case of the RF plasma CVD apparatus.

The formation of a deposited film as a layer constituting a light receiving layer of an electrophotographic light receiving member using the μW plasma CVD apparatus may be conducted, for example, as will be described below.

At first, a plurality of cylindrical substrates 7115 are positioned on the respective substrate holders 7114 in the reaction chamber 7111, and they are rotated by means of revolving means each comprising a driving motor 7120. The inside of the reaction chamber 7111 is evacuated to a vacuum degree of less than $1\times10^{-7}$ Torr through the exhaust pipe 4121 by operating the vacuuming device (not shown). Successively, the temperature of each cylindrical substrate 115 is heated to and maintained at a predetermined temperature of 20° C. to 500° C. by the heater 7116.

For introducing raw material gases for forming the deposited film into the reaction chamber 7111, closure of he gas reservoir valves 6231–6236 and the leak valve (not shown) of the reaction chamber, as well as opening of the inlet valves 6241–6246, the exit valve 6251–6256 and the auxiliary valve 6260 are confirmed, and then the main valve (not shown) is opened to evacuate the inside of the reaction chamber 7111 and the gas pipe lines. When the reading on the vacuum gauge (not shown) reaches about $5\times10^{-6}$ Torr, the auxiliary valve 6260 and the exit valves 6251–6256 are closed.

Then each of the raw material gases is introduced from each of the gas reservoirs 6221–6226 by opening each of the valves 6231–6236, and the pressure for each of the raw material gases is controlled to 2 kg/cm$^2$ by each of the pressure controllers 6261–6266. Then, the inlet valves 6241–6246 are gradually opened to introduce the raw material gases into the mass flow controllers 6211–6216.

After the preparation for the film formation has thus been completed, a deposited film as each of the photoconductive layer and the surface layer is formed on each of the cylindrical substrates 7115. That is, when the temperature of each cylindrical substrate 7115 reaches a predetermined temperature, the relevant exit valves 6251–6256 and the auxiliary valve 6260 are gradually opened and predetermined raw material gases are introduced from the gas reservoirs 6221–6226 into the reaction chamber 7111 through the gas introduction pipe 7117. Then, the flow rate of each raw material gas is controlled to a predetermined value by means of each of the mass controllers 6211–6216. In this case, the opening of the main valve (not shown) is controlled such that the inner pressure of the discharge space 7130 is a predetermined pressure of less than 1 Torr while observing the reading on the vacuum gauge (not shown). When the inner pressure of the discharge space 7130 becomes stable at said predetermined pressure, the microwave power source (not shown) is switched on to apply a microwave power (of more than 500 MHz, preferably of 2.45 GHz) into the discharge space 7130 through the microwave introduction window 7112 to cause μW glow discharge thereby producing plasma in the discharge space 7130, and simultaneously with this, the power source 7119 is switched on to apply a predetermined bias voltage (for example, a predetermined D.C. voltage) into the discharge space 7130 through the electrode 7118 to control the potential of the plasma, wherein the raw material gases in the discharge space 7130 are decomposed by microwave energy to cause the formation of a deposited film on the surface of each cylindrical substrate 7115. In this case, the cylindrical substrates are rotated at a desired rotation speed by means of the revolving means for attaining uniform film formation on the entire surface of each cylindrical substrate.

After the deposited film having a predetermined thickness has been formed, the application of the microwave power is terminated, and the related exit valves are closed to terminate the introduction of the raw material gases into the reaction chamber, thereby completing the formation of the deposited film on each cylindrical substrate.

By repeating the above film-forming procedures several times, a desired light receiving layer having a multi-layered structure is formed on each cylindrical substrate.

It is a matter of course that all of other exit valves than those for the required raw material gases are closed upon forming the respective layers. Further, in order to avoid the respective raw material gases from remaining in the reaction chamber 7111 and in the pipelines from the exit valves 6251–6256 to the reaction chamber 7111, a procedure of once evacuating the inside of the system to a high vacuum by closing the exit valves 6251–6256, opening the auxiliary valve 6260 and fully opening the main valve (not shown) is conducted as required.

It is also a matter of course that the kind of raw material gases and the operations for the valves are properly changed in accordance with the conditions for forming the respective layers.

Figure 14A:
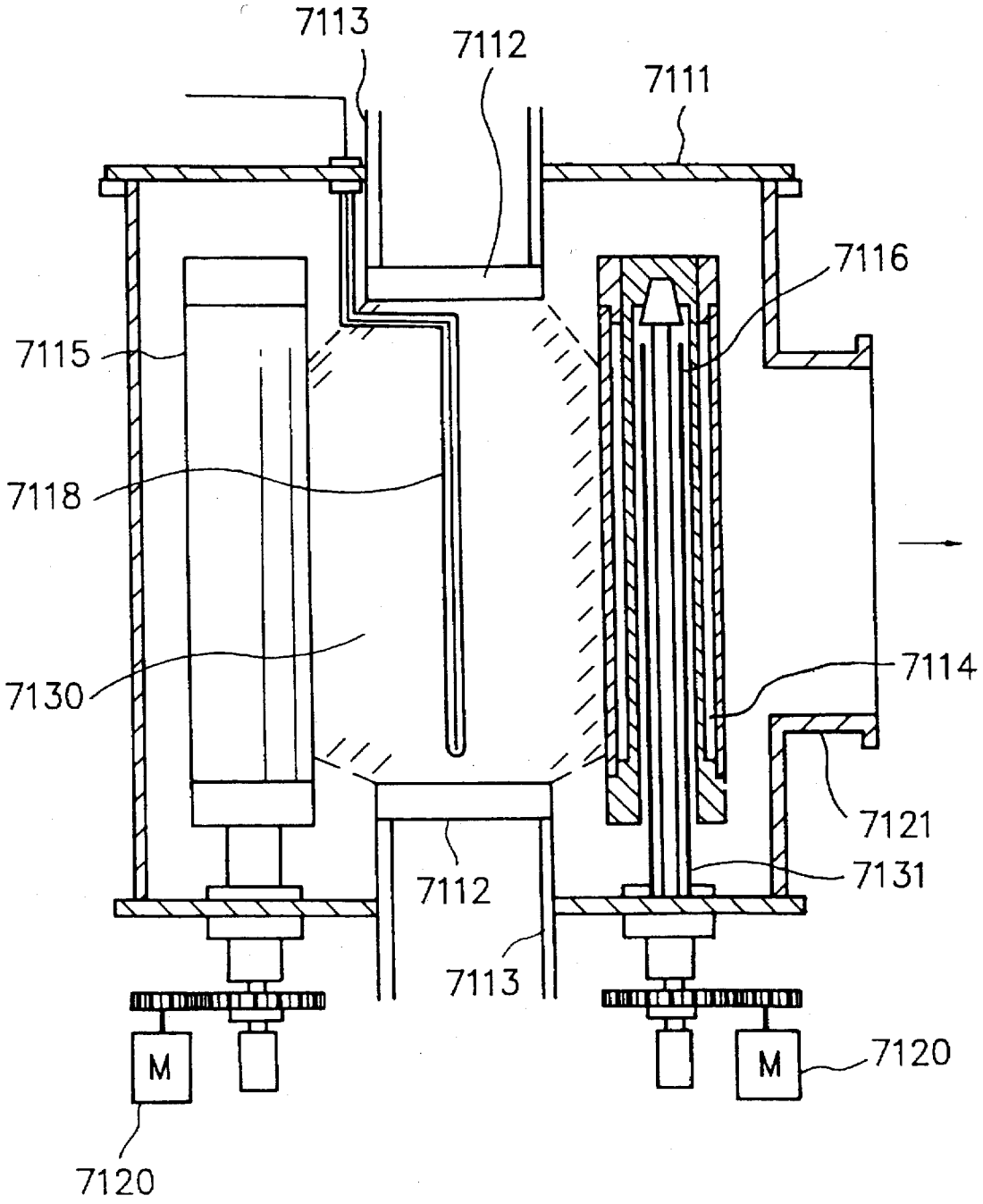
FIGS. 14(*a*) and 14(*b*) are schematic explanatory views illustrating another microwave plasma CVD apparatus for producing an electrophotographic light receiving member according to the present invention, wherein FIG. 14(*a*) is a schematic side elevational cross sectional view of said apparatus, and FIG. 14(*b*) is a schematic lateral cross sectional view of said apparatus, observed from above.
Figure 14B:
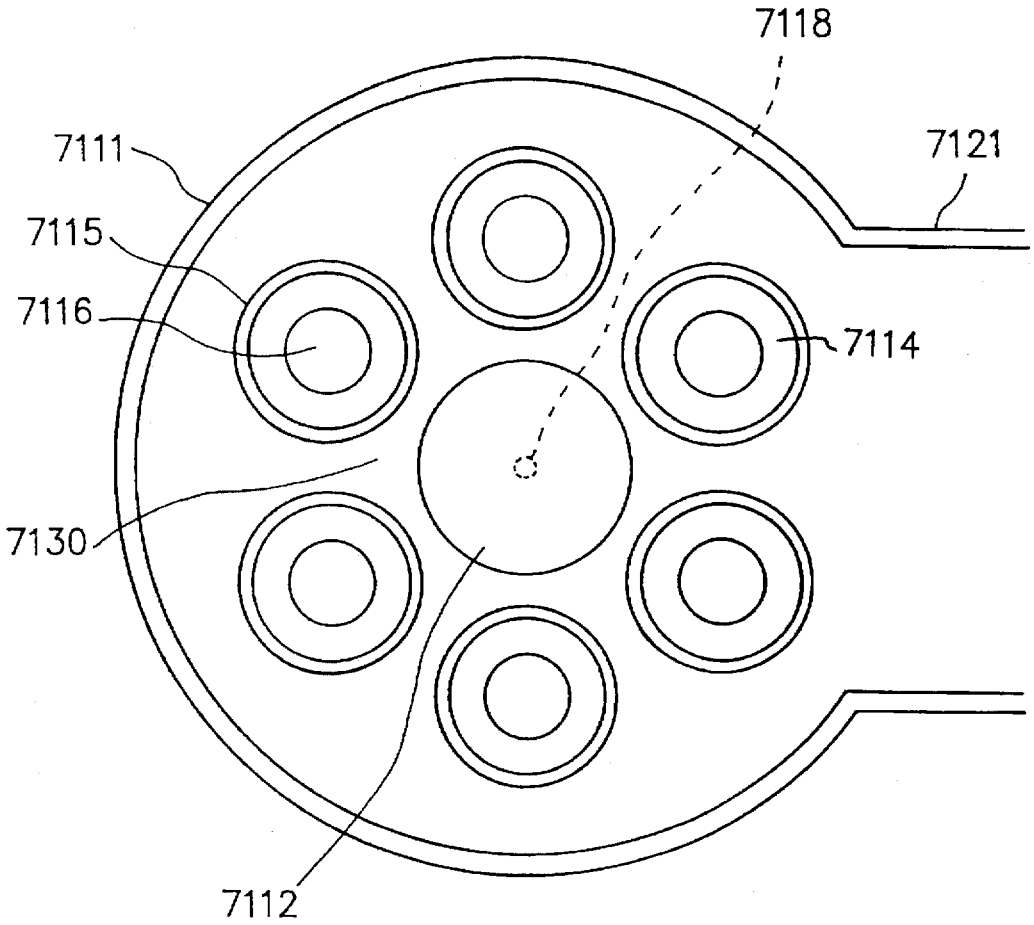

In FIGS. 14(*a*) and 14(*b*), there is shown another μW plasma CVD apparatus suitable for producing an electrophotographic light receiving member according to the present invention. FIG. 14(*a*) is a schematic side elevational cross sectional view of said μW plasma CVD apparatus, and 14(*b*) is a schematic lateral cross sectional view of said μW plasma CVD apparatus, observed from above.

The μW plasma CVD apparatus shown in FIGS. 14(*a*) and 14(*b*) comprises a reaction chamber 7111 which is connected to a raw material gas supply system (not shown) containing gas reservoirs (not shown).

The reaction chamber 7111 has a structure capable of being vacuumed, and it provided with an exhaustion system comprising an exhaust pipe 7121 connected to a vacuuming device comprising a diffusion pump (not shown).

The reaction chamber 7111 is provided with a microwave introduction window 7112 made of a microwave transmissive material (such as quarts glass or alumina ceramics) to which a waveguide 7113 extending from a microwave power source (not shown) through a stub tuner (not shown) and an isolator (not shown) is connected. The waveguide 7113 comprises a rectangular portion (extending from said microwave power source) which extends to the vicinity of the reaction chamber and a cylindrical portion positioned in the reaction chamber. The microwave introduction window 7112 is hermetically fixed to an end portion of said cylindrical portion of the waveguide. In the reaction cheer 7111, there are spacedly arranged a plurality of cylindrical substrate holders 7114 (each having a heater 7116 for heating a substrate) each having a cylindrical substrate 7115 (on which a deposited film is to be formed) positioned thereon so as to circumscribe a discharge space 7130. Each substrate holder 7114 is held on a rotation axis connected to a revolving means comprising a driving motor 7120. The reaction chamber 7111 has a raw material gas introduction means (not shown) connected to the raw material gas supply system (not shown). Reference numeral 7118 indicates a bias voltage applying electrode positioned in the discharge space 7130 of the reaction chamber. The electrode 7118 is electrically connected to a bias power source comprising, for example, a D.C. power source (not shown).

The formation of a deposited film as a layer constituting a light receiving layer of an electrophotographic light receiving member using the μW plasma CVD apparatus shown in FIGS. 14(*a*) and 14(*b*) may be conducted, for example, as will be described below.

At first, a plurality of cylindrical substrates 7115 are positioned on the substrate holders 7114 in the reaction chamber 7111, and they are rotated by means of the revolving means. The inside of the reaction chamber 7111 is then evacuated to a vacuum degree of less than $1\times10^{-7}$ Torr through the exhaust pipe 4121 by operating the vacuuming device (not shown). The temperature of each cylindrical substrate 7115 is heated to and maintained at a predetermined temperature by the heater 7116. Thereafter, raw material gases are introduced into the reaction chamber 7111 by means of the raw material gas introduction means. In the case of forming a deposited film composed of an a-Si(H,X) material as a photoconductive layer, for instance, silane gas, diborane gas as a doping gas, and He gas as a dilution gas are introduced into the reaction chamber 7111. Then, the microwave power source (not shown) is switched on to apply a microwave power (of 2.45 GHz) into the discharge space 7130 through the microwave introduction window 7112 to cause μW glow discharge thereby producing plasma in the discharge space 7130, and simultaneously with this, the power source 7119 is switched on to apply a predetermined baas voltage into the discharge space 7130 through the electrode 7118, wherein the raw material gases in the discharge space 7130 are decomposed by microwave energy to cause the formation of a deposited film on the surface of each cylindrical substrate 7115 while said substrate surface constantly receiving an ion bombardment due to an electric field caused between the electrode 7118 and the cylindrical substrates 7115. In this case, the cylindrical substrates are rotated at a desired rotation speed by means of the revolving means for attaining uniform film formation on the entire surface of each cylindrical substrate.

Figure 15:
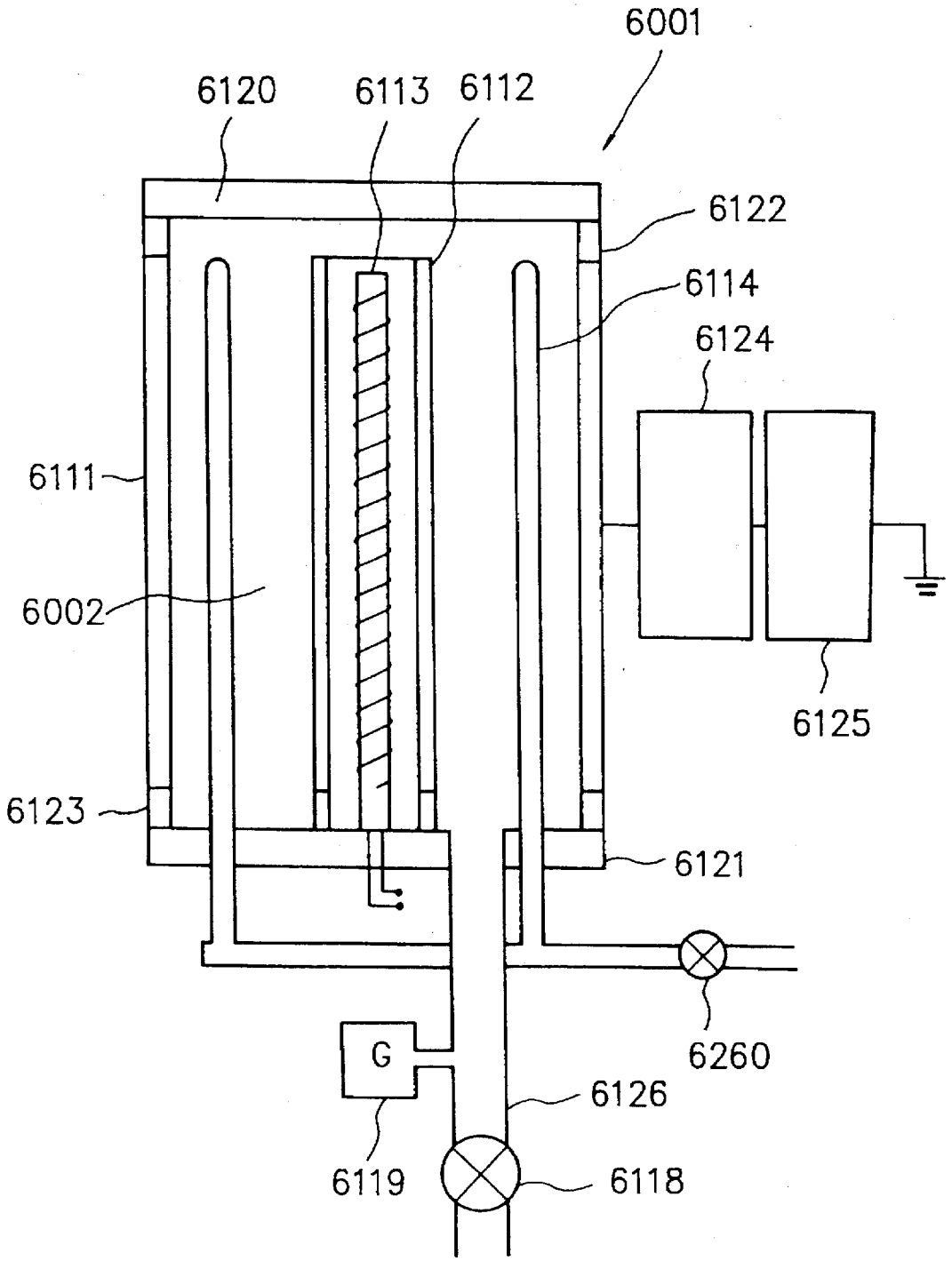
FIG. 15 is a schematic explanatory view illustrating another RF plasma CVD apparatus for producing an electrophotographic light receiving member according to the present invention.

In FIG. 15, there is shown another RF plasma CVD apparatus suitable for producing an electrophotographic light receiving member according to the present invention. FIG. 15 is a schematic diagram illustrating the constitution of said RF plasma CVD apparatus.

The RF plasma CVD apparatus shown in FIG. 15 comprises a reaction chamber 6001 connected to a raw material gas supply system (nor shown) containing gas reservoirs (not shown). The reaction chamber 6001 has a structure capable of being vacuumed. The reaction chamber 6001 is constituted by an upper wall 6120, a lower wall 6121, a circumferential wall capable serving also as a cathode electrode, and insulators 6122 and 6123 which electrically isolate the circumferential wall 6111 from the upper and lower walls. The reaction chamber 6001 contains a cylindrical substrate 6112, a heater 6113 for heating the substrate 6112 and a raw material gas introduction pipe 6114 which are installed therein. The raw material gas introduction pipe 6114 is extending from the raw material gas supply system (not shown) through a gas inflow valve 6260. The reaction chamber 6001 is provided with an exhaust pipe 6126 connected through an exhaust valve 6118 to a vacuum pump (not shown). The exhaust pipe 6126 is provided with a pressure gauge 6119. To the circumferential wall 6111 of the reaction chamber 6001, an RF power supply system comprising an RF power source 6125 and a matching box 6124 is electrically connected. Reference numeral 6002 indicates a discharge space of the reaction chamber 6001. The The formation of a deposited film as a layer constituting a light receiving layer of an electrophotographic light receiving member using the RF plasma CVD apparatus may be conducted, for example, as described below.

At first, a cylindrical substrate 6112 is disposed in the reaction chamber 6001. Then, by closing the raw material gas inflow valve 6260 and opening the exhaust valve 6118, the the inside of the reaction chamber 6001 is evacuated to a vacuum degree of less than $5\times10^{-6}$ Torr through the exhaust pipe 6126 by operating the vacuum pump (not shown) while observing the reading on the pressure gauge 6119. Then, the temperature of the cylindrical substrate 6112 is controlled to and maintained at a predetermined temperature by means of the heater 6113. Thereafter, raw material gases are introduced into the reaction chamber 6001 by means of the raw material gas introduction pipe 6114. In the case of forming a deposited film composed of an a-Si(H,X) material as a photoconductive layer, for instance, silane gas, diborane gas as a doping gas, and He gas as a dilution gas are introduced into the reaction chamber 6001. After confirming that the cylindrical substrate 6112 is maintained at said predetermined temperature, the RF power source 6125 is switched on to apply a predetermined RF power into the discharge space 6002 through the matching box 6124 to cause glow discharge thereby producing plasma in the discharge space 6002, wherein the raw material gases in the discharge space 6002 are decomposed to cause the formation of a deposited film as a photoconductive layer on the surface of of the cylindrical substrate 6112.

In the following, description will be made of an electrophotographic apparatus in which an electrophotographic light receiving member according to the present invention can be desirably used.

Figure 17:
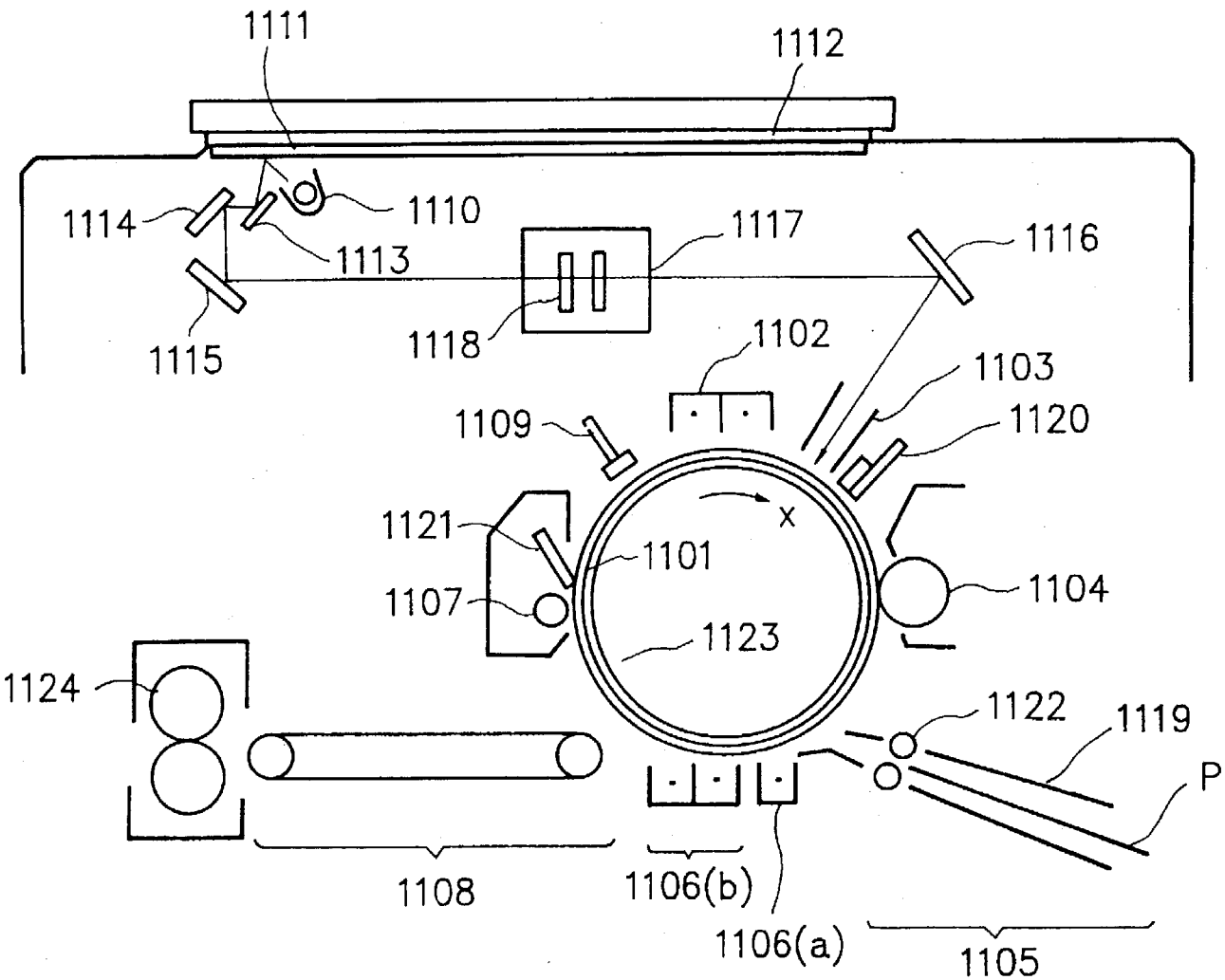
FIG. 17 is a schematic diagram of an electrophotographic apparatus in which an electrophotographic light receiving member according to the present invention can be used.

FIG. 17 is a schematic diagram of illustrating the constitution of an example of an electrophotographic apparatus provided with an electrophotographic light receiving member according to the present invention.

In the electrophotographic apparatus shown in FIG. 17, an electrophotographic light receiving member 1101 in a cylindrical form (hereinafter referred to as light receiving member) is controlled to a desired temperature by a heater (a sheet-like shaped heater) 1123, and it rotates in the direction indicated by an arrow. Near the light receiving member 1101, there are provided a main corona charger 1102, an electrostatic latent image-forming mechanism 1103, a development mechanism 1104, a transfer sheet feeding mechanism 1105, a transfer charger 1106(*a*), a separating charger 1106(*b*), a cleaning mechanism (comprising a magnet roller 1107 and a cleaning blade 1121), a transfer sheet conveying mechanism 1108 and a charge-removing lamp 1109.

The image-forming process in the electrophotographic apparatus is conducted, for example, as will be described in the following. That is, as above described, the light receiving member 1101 is maintained at a predetermined temperature by means of the heater 1123. The light receiving member 1101 is uniformly charged by the main corona charger 1102 to which a voltage of +6 to +8 kV is impressed. Then, an original 1112 to be reproduced which is placed on a contact glass 1111 is irradiated with light from a light source 1110 such as a halogen lamp or fluorescent lamp through the contact glass 1111, and the resulting reflected light is projected through mirrors 1113, 1114 and 1115, a lens system 1117 containing a filter 1118, and a mirror 1116 onto the surface of the light receiving member 1101 to form an electrostatic latent image corresponding to the original 1112. The electrostatic latent image is developed with toner supplied by the development mechanism 1104 to provide a toner image. A transfer sheet P is supplied through the transfer sheet feeding mechanism 1105 comprising a transfer sheet guide 1119 and a pair of feed timing rollers 1122 so that the transfer sheet P is brought into contact with the surface of the light receiving member 1101, and corona charging effected with the polarity different to that of the toner from the rear of the transfer sheet P by the transfer charger 1106(*a*) to which a voltage of +7 to +8 kV is impressed, whereby the toner image is transferred onto the transfer sheet P. The transfer sheet P having the toner image transferred thereon is electrostatically removed from the light receiving member 1101 by the charge-removing action of the separating charger 1106(*b*) where an A.C. voltage of 12 to 14 kVp-p and 300 to 600 Hz is impressed, and it is conveyed by the transfer sheet conveying mechanism 1108 to a fixing mechanism 1124.

The residual toner on the surface of the light receiving member 1101 is removed by the magnet roller 1107 and the cleaning blade 1121 upon arrival at the cleaning mechanism, and the removed toner is stored in a storing box (not shown). Thereafter, the light receiving member 1101 thus cleaned is entirely exposed to light by the charge-removing lamp 1109 to erase the residual charge and is recycled.

Figure 18:
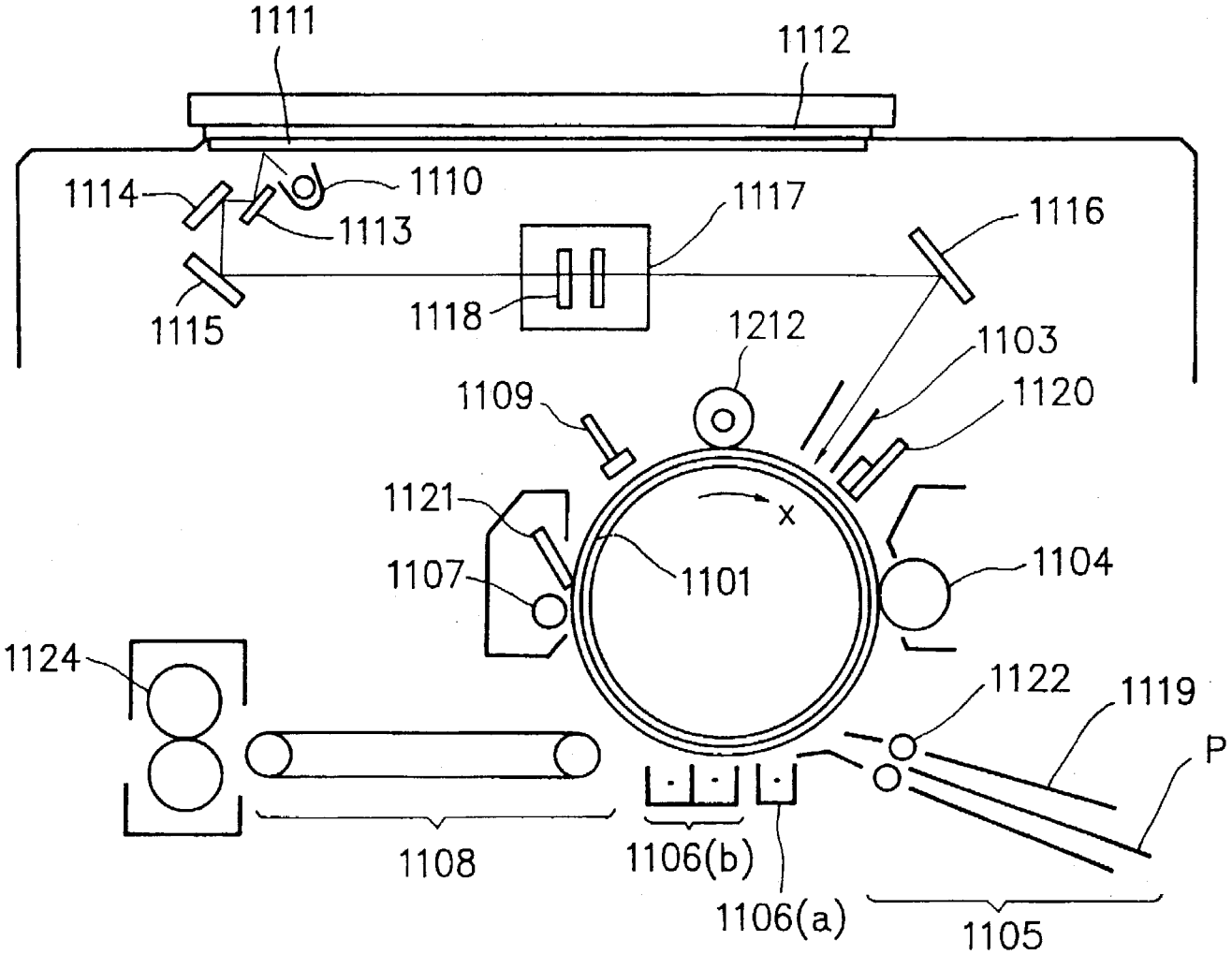
FIG. 18 is a schematic diagram of another electrophotographic apparatus in which an electrophotographic light receiving member according to the present invention can be used.

FIG. 18 is a schematic diagram of illustrating the constitution of another electrophotographic apparatus provided with an electrophotographic light receiving member according to the present invention.

The electrophotographic apparatus shown in FIG. 18 is of the constitution which is the same as that of the electrophotographic apparatus shown in FIG. 17, except for the following points that the main corona charger 1102 of the latter is replaced by a roller-shaped contact electrification device and the heater 1123 of the latter is omitted and the heater 1123 of the latter is omitted.

The image-forming process in the electrophotographic apparatus shown in FIG. 18 may be conducted in a manner similar to that in the case of the electrophotographic apparatus shown in FIG. 17.

Figure 19A:
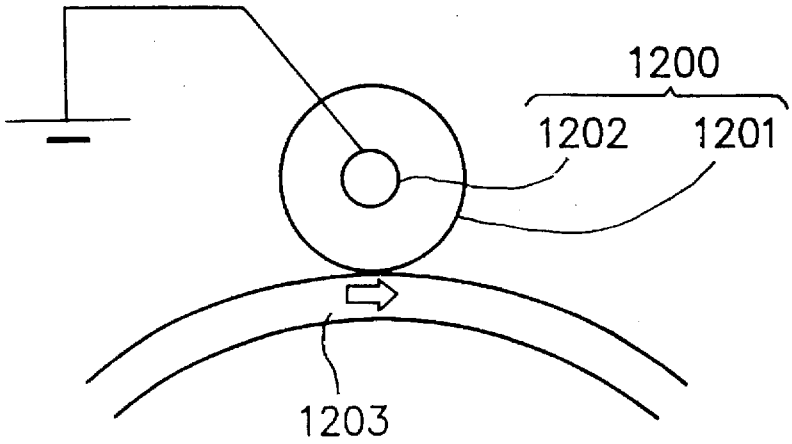
FIGS. 19(*a*), 19(*b*) and 19(*c*) are schematic explanatory views respectively illustrating a charging means used in an electrophotographic apparatus according to the present invention.
Figure 19B:
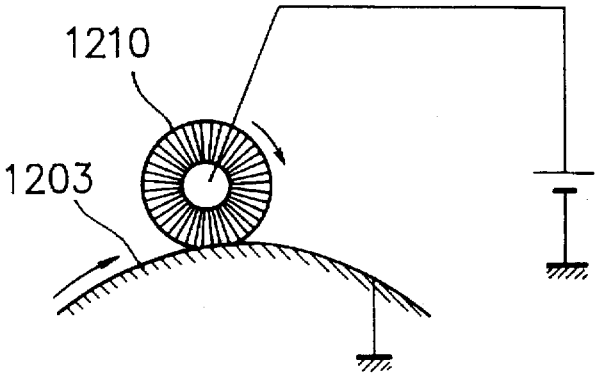
Figure 19C:
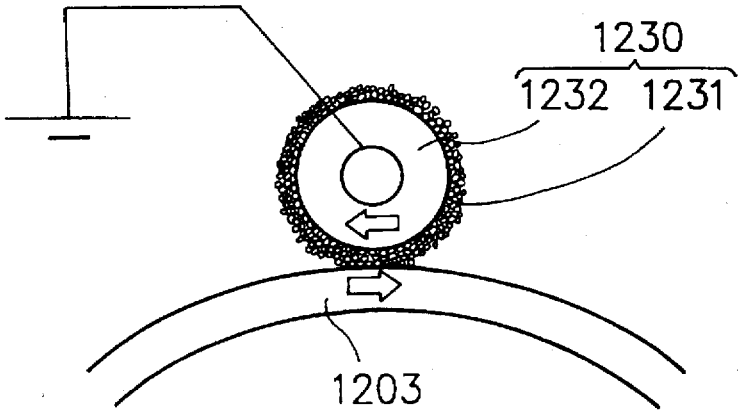

As said contact electrification device, there can be mentioned those shown in FIGS. 19(*a*) to FIG. 19(*c*).

FIG. 19(*a*) is a schematic explanatory view illustrating a roller-shaped electrically conductive contact electrification device 1200 (which is a so-called roller charger). The contact electrification device 1200 comprises a core portion 1202 made of a metal such as stainless steel and an electrically conductive and elastic layer 1201 disposed to cover said core portion. Reference numeral 1203 in the figure indicates the surface of the light receiving member 1101. In the image-forming process, the contact electrification device 1200 is maintained such that it is always press-contacted to the light receiving member's surface 1203 at a predetermined pressure and to the contact electrification device 1200, a predetermined voltage of D.C., A.C. or a combination of D.C. end A.C. from a power source is impressed. It is possible for the contact electrification device to be made such that it rotates depending on the rotation of the light receiving member. Alternatively, the contact electrification device may intentionally rotate by means of a driving means in the direction of the light receiving member to rotate or in the direction reverse to the direction of the light receiving member to rotate at a predetermined peripheral velocity while press-contacting the contact electrification device to the light receiving member. In a further alternative, it is possible for the contact electrification device to be made such that it press-contacts with the light receiving member without being rotated.

In the contact-charging process using the contact electrification device, charging is started with a given continuous gap due to a difference between the curvature of the light receiving member and that of the contact electrification device and a definite gap region serves to stably maintain the charging by the voltage impressed.

FIG. 19(*b*) is a schematic explanatory view illustrating a roller-shaped electrically conductive contact electrification device comprising a so-called wire-brush charger. The wire-brush charger is a modification of the roller charger shown in FIG. 19(*a*) in which the electrically conductive and elastic layer 1201 of the roller charger is replaced by a roller-shaped wire brush 1210.

In the image-forming process, the wire-brush charger is rotated at a peripheral velocity which is the same as or different from that of the light receiving member to rotate while impressing a predetermined voltage of D.C., A.C. or a combination of D.C. and A.C. from a power source to the wire brush and while press-contacting to the light receiving member.

FIG. 19(*c*) is a schematic explanatory view illustrating a roller-shaped electrically conductive contact electrification device comprising a so-called magnetic brush charger. The magnetic brush charger is a modification of the roller charger shown in FIG. 19(*a*) in which the electrically conductive and elastic layer 1201 of the roller charger is replaced by a roller-shaped body 1230 comprising a multipolar magnetic body 1232 and a magnetic brush layer 1231 comprising a powdery magnetic material which is retained on the surface of said magnetic body. The powdery magnetic material by which the magnetic brush layer is constituted can include powdery ferrite, powdery magnetite, and powdery magnetic materials which are used in the preparation of a toner.

In the image-forming process, the magnetic brush charger is rotated at a peripheral velocity which is the same as or different from that of the light receiving member to rotate while impressing a predetermined voltage of D.C., A.C. or a combination of D.C. and A.C. from a power source to the wire brush and while press-contacting to the light receiving member.

Figure 20:
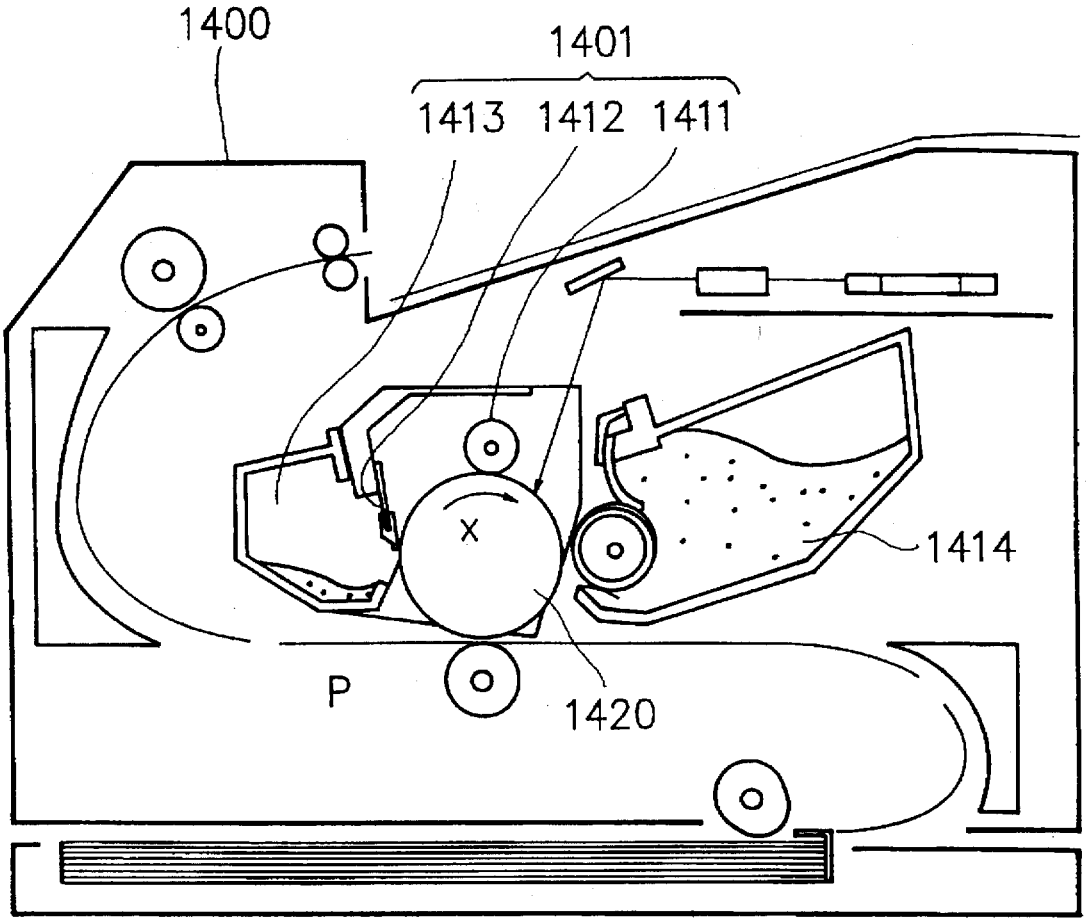
FIG. 20 is a schematic diagram of a further electrophotographic apparatus in which an electrophotographic light receiving member according to the present invention can be used.

FIG. 20 is a schematic cross sectional view illustrating a laser beam printer 1400 which has been modified for experimental purposes (produced by Canon Kabushiki Kaisha). The laser beam printer 1400 comprises a process cartridge 1401 which comprises a cylindrical electrophotographic light receiving member 1420, a charger 1411 (comprising the magnetic brush charger shown in FIG. 19(*c*)), a cleaner 1412 (comprising a cleaning blade) and a waste toner storing vessel 1413, and a development mechanism 1414. In this laser beam printer, no heater is installed in the inside of the light receiving member, and the light receiving member is maintained at a temperature near room temperature.

The present invention has been accomplished based on the findings through the following experiments by the present inventors.

Experiment A1

Preparation of Electrophotographic Light Receiving Member

There were prepared a plurality of cylindrical electrophotographic light receiving members each comprising a photoconductive layer formed on a mirror-polished surface of an aluminum cylinder as a substrate using the μW plasma CVD apparatus shown in FIGS. 14(*a*) and 14(*b*) under film-forming conditions shown in Table A1.

The cylindrical electrophotographic light receiving members were prepared in the following manner. That is, six cylindrical aluminum substrates 7115 were positioned on the respective substrate holders 7114 in the reaction chamber 7111, end they were rotated by means of the revolving means. The inside of the reaction chamber 7111 was then evacuated to a vacuum degree of less than $1\times10^{-7}$ Torr through the exhaust pipe 7121 by operating the vacuuming device. The substrates 7115 were heated to and maintained at 250° C. by the heater 7116. Thereafter, $SiH_4$ gas, $B_2H_6$ gas and He gas were introduced into the reaction chamber at respective flow rates shown in Table A1 by means of the raw material gas introduction means. After the gas pressure of the reaction chamber became stable at 8 mTorr, the microwave power source (not shown) was switched on to apply a microwave power of 800 W into the discharge space 7130 through the microwave introduction window 7112, and simultaneously with this, the power source 7119 was switched on to apply a D.C. power of 400 W into the discharge space through the electrode 7118, wherein glow discharge was occurred and the raw material gases were decomposed in the discharge space to cause the formation of a 20 μm thick film composed of an a-Si material as a photoconductive layer on the surface of each cylindrical substrate while said substrate surface constantly receiving an ion bombardment due to an electric field caused between the electrode 7118 and the cylindrical substrates 7115. During the film formation, the cylindrical substrates were rotated in order to attain uniform film formation on the entire surface of each cylindrical substrate. And in the above film formation, the flow rate of the $B_2H_6$ gas was gradually decreased so that no B-atoms were contained in a region in the vicinity of the outermost of the a-Si film as the photoconductive layer. Thus, there were obtained six cylindrical electrophotographic light receiving members.

The above film-forming procedures were repeated twice to obtain twelve cylindrical electrophotographic light receiving members. (The cylindrical electrophotographic light receiving member will be hereinafter referred to as light receiving member.)

Formation of a Two-dimensional Distribution Configuration at the Outermost Surface of the Light Receiving Member Of the twelve light receiving members obtained in the above, some were randomly elected, and as for each of the light receiving members selected, a two-dimensional distribution configuration was formed at the outermost surface thereof using the vacuum evaporation apparatus shown in FIG. 11.

The formation of the two-dimensional distribution at the outermost surface of each light receiving member using the vacuum evaporation apparatus was conducted in the following manner.

That is, the light receiving member was fixed to the rotation axis 907 of the vacuum evaporation apparatus. The inside of the vacuum vessel 901 was evacuated to a vacuum degree of less than $1\times10^{-7}$ Torr through the exhaust pipe 908 by operating the vacuum pump (not shown). The surface of the light receiving member was heated to and maintained at a predetermined temperature by means of the heater 906 while rotating the rotary axis 907. Then, a Se metal material contained in each crucible 902 was heated to generate Se-vapor flows, wherein a Se thin film was formed on the surface of the light receiving member. Then, the Se-thin film on the light receiving member in the vacuum evaporation apparatus was subjected to thermal diffusion treatment to diffuse Se-element into the dopant-free layer region of the photoconductive layer of the light receiving member, wherein a plurality of Se-containing island-like regions were provided in a state of being spacedly distributed at the outermost surface of the light receiving member.

In each case, the temperature of the light receiving member upon the formation of the Se thin film and the amount of the Se thin film deposited on the surface of the light receiving member were varied in order to attain a different coating rate for the Se-containing thin film while having a due care about the size of a Se-containing island-like region provided at the outermost surface of the light receiving member so that said size is at about 2000 Å in diameter. This was conducted in order to find out optimum conditions for Se to provide a desirable two-dimensional distribution configuration at the outermost surface of the light receiving member, based on a finding obtained by the present inventors that being different depending upon the kind of a metal used, but in general, there is a tendency that as the temperature of a light receiving member upon the formation of a metal thin film at the surface thereof by the vacuum evaporation process is heightened, the size of an island-like region comprising the metal thin film which is provided at the outermost surface of the light receiving member is decreased; and as the amount of the metal thin film deposited is increased, the size of the island-like region and the coating rate are increased.

Each of the light receiving member thus treated was subjected to surface polishing treatment using the polishing apparatus shown in FIG. 16 to remove the metal thin film.

EVALUATION

Observation of the Area Rate for the Se-containing Regions

As for each of the resultant light receiving member, the size of the Se-containing island-like region, the area of the Se-containing region (that is, the area rate for the Se-containing region) and the Se-content of the Se-containing region were examined by way of two-dimensional mapping by means of X-ray microanalysis. Based on the examined results, there was obtained an area rate for the Se-containing region. The results obtained are shown in Table A2 wherein the area rate for the Se-containing region in each case is shown.

Herein, it should be noted that the above items to be examined can be examined by way of two-dimensional mapping by means of Auger electron spectroscopy or by means of ESCA analysis (that is, electron spectroscopy for chemical analysis). And in the case where the amount of a metal element deposited is small, they can be examined by means of SIMS.

In Table A2, a case (not shown) in which the area rate for the Se-containing region is 0% means a light receiving member with no Se-containing region. And the case in which the area rate for the Se-containing region is 100% means a light receiving member in which the entire region of the outermost surface comprises a Se-containing region.

Evaluation of Electrophotographic Characteristics

Each of the resultant light receiving members was evaluated with respect to its electrophotographic characteristics, namely, (1) occurrence of coarse image, (2) toner transferring efficiency, (3) color reproduction, and (4) occurrence of ghost by setting the light receiving member to an electrophotographic copying machine NP 5060 which has been modified to be usable for experimental purposes (produced by Canon Kabushiki Kaisha) in the following manner.

Herein, there was provided a cylindrical electrophotographic light receiving member with no deposition of Se at the outermost surface thereof (as Comparative Example A1) which was prepared in the same manner described in the above preparation of electrophotographic light receiving member. This comparative light receiving member was also evaluated with respect to the above described evaluation items (1) to (4).

(1) Evaluation of the Occurrence of Coarse Image

A halftone chart was copied to obtain a plurality of reproduced halftone images. The resultant reproduced halftone images were evaluated while comparing with the original. The evaluated result is shown in Table A2 based on the following criteria:

⊙: a case wherein the reproduced image is absolutely with no coarse image and excels in quality, ○: a case wherein the reproduced image is accompanied by a few of slight coarse images but is satisfactory in quality, Δ: a case wherein the reproduced image is accompanied by a distinguishable number of coarse images but it is practically acceptable, and X: a case wherein the reproduced image is accompanied by a great many of coarse images and it is problematic in practical use.

(2) Evaluation of the Toner Transferring Efficiency

The conventional charging process and then, the conventional development process were conducted to deposit toner on the surface of the light receiving member thereby forming a toner image on said surface, and when the toner on the surface of the light receiving member was transferred onto a copying paper, the image-forming process was suspended. And the density of the residual toner on the surface of the light receiving member was measured by means of a densitometer MACBETH RD916 (trademark name, produced by Macbeth Company). The measured result is shown in Table A2 based on the following criteria:

⊙: a case wherein the toner is entirely transferred without any residual toner on the surface of the light receiving member, ○: a case wherein a slight residual toner is present on the surface of the light receiving member, Δ: a case wherein a distinguishable residual toner is present on the surface of the light receiving member but this is practically acceptable, and X: a case wherein a remarkable residual toner is present on the surface of the light receiving member and this is practically problematic.

(3) Evaluation of the Color Reproduction

An original containing black prints of 0.3 in optical density, red prints of 0.4 in optical density, and blue prints of 0.4 in optical density being mixed was subjected to reproduction to thereby reproduced images by adjusting the copying machine so that the images reproduced from the black prints of the original have an optical density of 0.6. The optical density of the reproduced images was examined by means of a densitometer MACBETH RD914 (trademark name, produced by Macbeth Company).

The evaluated result is shown in Table A2 based on the following criteria:

⊙: a case wherein the reproduced images corresponding to the red and blue prints are high enough in optical density and they are clearly distinguishable, ○: a case wherein the reproduced images corresponding to the red and blue prints are relatively low in optical density but they are distinguishable, Δ: a case wherein the reproduced images corresponding to the red and blue prints are low in optical density and they are difficult to be distinguished, and X: a case wherein the reproduced images corresponding to the red and blue prints are remarkably low in optical density and they are very difficult to be distinguished.

(4) Evaluation of the Occurrence of Ghost

An original having characters on the entire surface thereof was subjected to reproduction to obtain reproduced images. Thereafter, the image-forming process was suspended for a predetermined period of time, and then, an entirely halftone original was subjected to reproduction to obtain reproduced halftone images. As for the halftone images thus reproduced, observation was conducted of whether or not a ghost based the former original is occurred.

The evaluated result is shown in Table A2 based on the following criteria:

⊙: a case wherein no ghost is occurred,

○: a case wherein ghost is slightly occurred but this is absolutely not problematic, Δ: a case wherein ghost is distinguishably occurred but this is practically not problematic, and X: a case wherein ghost is remarkably occurred and this is sometimes problematic in practice.

From the results shown in Table A2, it was found that the light receiving members which are 5% to 60% in terms of the area rate for the Se-containing region are markedly superior with respect to the occurrence of coarse image and in the toner transfer efficiency.

Experiment A2

There were prepared six cylindrical electrophotographic light receiving members by repeating the procedures employed in the preparation of electrophotographic light receiving member in Experiment A1.

Of the six light receiving members, four light receiving members were randomly selected and they were made to be Samples A1 to A4.

As for each sample, by repeating the metal thin thin film-forming procedures using the vacuum evaporation apparatus shown in FIG. 11 in Experiment A1, a Te thin film was formed on the surface thereof while properly controlling the film deposition conditions and the deposition time so that the Te thin film is deposited in a state of having a two-dimensional distribution on the surface of the light receiving member. Said conditions upon the formation of the Te thin film were changed in each case. Then, the Te thin film thus deposited on the light receiving member in the vacuum evaporation apparatus was subjected to thermal diffusion treatment to diffuse Te-element into the dopant-free layer region of the light receiving layer of the light receiving member, wherein a plurality of Te-containing island-like regions were provided in a state of being spacedly distributed at the outermost surface of the light receiving member. Then, the light receiving member thus treated was subjected to surface polishing treatment using the polishing apparatus shown in FIG. 16 to remove the metal thin film.

As for the two-dimensional distribution configuration comprising a plurality of Te-containing island-like regions spacedly distributed at the outermost surface of the light receiving member, it was found that it is as shown in FIG. 1 in the case of Sample A1, it is as shown in FIG. 2 in the case of Sample A2, it is as shown in FIG. 3 in the case of Sample A3, and it is as shown in FIG. 4 in the case of Sample A4.

Each of the resultant light receiving members was evaluated with respect to its electrophotographic characteristics in the same evaluation manner as in Experiment A1. The results obtained are shown in Table A3. Based on the results shown in Table A3, it was found that when an electrophotographic light receiving member is made to have such two-dimensional distribution configuration as shown in FIG. 1, FIG. 2, FIG. 3, or FIG. 4 is superior in toner transferring efficiency as well as it excels or good enough in other electrophotographic characteristics.

Experiment A3

There were prepared twelve cylindrical electrophotographic light receiving members by repeating the procedures employed in the preparation of electrophotographic light receiving member in Experiment A1.

Of the twelve light receiving members, seven light receiving members were randomly selected. As for each light receiving member, by repeating the metal thin film-forming procedures using the vacuum evaporation apparatus shown in FIG. 11 in Experiment A1, an aluminum (Al) thin film was formed on the surface thereof while properly controlling the film deposition conditions and the deposition time so that the Al thin film is deposited in a state of having a two-dimensional distribution on the surface of the light receiving member while attaining a coating rate of about 30%. Said conditions upon the formation of the Al thin film were changed so that the size of an island-like Al-containing region provided is different in each case. Then, the Al thin film thus deposited on the light receiving member in the vacuum evaporation apparatus was subjected to thermal diffusion treatment to diffuse Al-element into the dopant-free layer region of the light receiving layer of the light receiving member, wherein a plurality of Al-containing island-like regions were provided in a state of being spacedly distributed at the outermost surface of the light receiving member. Then, the light receiving member thus treated was subjected to surface polishing treatment using the polishing apparatus shown in FIG. 16 to remove the residual metal thin film.

Each of the resultant light receiving members was subjected to the two-dimensional mapping analysis described in Experiment A1 to examine the size of the Al-containing island-like region. The results obtained are shown in Table A4.

And each of the resultant light receiving members was evaluated with respect to its electrophotographic characteristics in the same evaluation manner as in Experiment A1. The results obtained are shown in Table A4.

Based on the results shown in Table A4, it was found that when the size of the Al-containing island-like region constituting the two-dimensional distribution configuration at the outermost surface of the light receiving member is 200 to 5000 Å in diameter, marked electrophotographic characteristics are provided.

Experiment A4

There were prepared eighteen cylindrical electrophotographic light receiving members by repeating the procedures employed in the preparation of electrophotographic light receiving member in Experiment A1.

Of the eighteen light receiving members, fifteen light receiving members were randomly selected. As for each light receiving member, by repeating the metal thin thin film-forming procedures using the vacuum evaporation apparatus shown in FIG. 11 in Experiment A1, a metal thin film of one of the metal elements shown in Table A5 was formed on the surface thereof while properly controlling the film deposition conditions and the deposition time so that the metal thin film is deposited in a state of having a two-dimensional distribution on the surface of the light receiving member while attaining a coating rate of about 30%. Then, the metal thin film thus deposited on the light receiving member in the vacuum evaporation apparatus was subjected to thermal diffusion treatment to diffuse the metal element of the metal thin film into the dopant-free layer region of the light receiving layer of the light receiving member, wherein a plurality of metal element-containing island-like regions were provided in a state of being spacedly distributed at the outermost surface of the light receiving member. Then, the light receiving member thus treated was subjected to surface polishing treatment using the polishing apparatus shown in FIG. 16 to remove the residual metal thin film.

Each of the resultant light receiving members was subjected to the two-dimensional mapping analysis described in Experiment A1 to examine the size of the metal element-containing island-like region. As a result, it was found that the size of the metal element-containing island-like region is about 1500 Å in each case.

And each of the resultant light receiving members was evaluated with respect to its electrophotographic characteristics in the same evaluation manner as in Experiment A1. The results obtained are shown in Table A5.

Based on the results shown in Table A5, it was found that when a metal element selected from the group consisting of Al, Ga, Se, In, Sn, Sb, Te, and Pb belonging to group 13, 14, 15, or 16 of the periodic table is used in the formation of the two-dimensional distribution configuration at the outermost surface of the light receiving member, any of the light receiving members excels or good enough in electrophotographic characteristics; on the other hand, when a metal element selected from the group consisting of Mg, Sr, Mn, Fe, Ni, Cu and Au is used in the formation of the two-dimensional distribution configuration at the outermost surface of the light receiving member, any of the light receiving members causes the occurrence of a coarse image and is markedly inferior in the toner transferring efficiency.

Experiment A5

There were prepared twelve cylindrical electrophotographic light receiving members by repeating the procedures employed in the preparation of electrophotographic light receiving member in Experiment A1.

Of the twelve light receiving members, seven light receiving members were randomly selected. As for each light receiving member, by repeating the metal thin thin film-forming procedures using the vacuum evaporation apparatus shown in FIG. 11 in Experiment A1, a Bi thin film was formed on the surface thereof while properly controlling the film deposition conditions and the deposition time so that the Bi thin film is deposited in a state of having a two-dimensional distribution on the surface of the light receiving member while attaining a coating rate of about 40%. Said conditions upon the formation of the Bi thin film were changed so that the concentration of Bi of an island-like Bi-containing region provided is varied in the range of 7 atomic ppm to 13000 atomic ppm in each case. Then, the Bi thin film thus deposited on the light receiving member in the vacuum evaporation apparatus was subjected to thermal diffusion treatment to diffuse Bi-element into the dopant-free layer region of the light receiving layer of the light receiving member, wherein a plurality of Bi-containing island-like regions were provided in a state of being spacedly distributed at the outermost surface of the light receiving member. Then, the light receiving member thus treated was subjected to surface polishing treatment using the polishing apparatus shown in FIG. 16 to remove the residual metal thin film.

Each of the resultant light receiving members was subjected to the two-dimensional mapping analysis described in Experiment A1 to examine the size of the Bi-containing island-like region. As a result, it was found that the size of the metal element-containing island-like region is about 4000 Å in each case.

And each of the resultant light receiving members was evaluated with respect to its electrophotographic characteristics in the same evaluation manner as in Experiment A1. The results obtained are shown in Table A4.

Based on the results shown in Table, it was found that when the Bi-concentration of the Bi-containing island-like region constituting the two-dimensional distribution configuration at the outermost surface of the light receiving member is 10 atomic ppm to 10000 atomic ppm, any of the light receiving members excels or good enough in electrophotographic characteristics.

Experiment B1

Preparation of electrophotographic light receiving member:

There were prepared nine cylindrical electrophotographic light receiving members each comprising a photoconductive layer disposed on a mirror-polished surface of an aluminum cylinder as a substrate using the RF plasma CVD apparatus shown in FIG. 12 under film-forming conditions shown in Table B1.

Each cylindrical electrophotographic light receiving member (hereinafter referred to as light receiving member) was prepared in the following manner.

That is, a cylindrical aluminum substrate 6112 having a mirror-polished surface was positioned in the reaction chamber 6111. The inside of the reaction chamber 6111 was evacuated to a vacuum degree of about $5\times10^{-6}$ Torr through the exhaust pipe 6117 by operating the vacuum pump (not shown). The substrate 6111 was heated to and maintained at 250° C. by means of the heater 6113. Thereafter, $SiH_4$ gas, $B_2H_6$ gas and He gas were introduced into the reaction chamber at respective flow rates shown in Table B1 through the gas introduction pipe 6114. After the gas pressure in the reaction chamber became stable at 350 mTorr, the RF power source (not shown) was switched on to apply an RF power of 400 W into the reaction chamber through the RF matching box 6115, wherein glow discharge was occurred and the raw material gases were decomposed in the reaction chamber to cause the formation of a 20 μm thick film composed of an a-Si material as a photoconductive layer on the mirror-polished surface of the substrate 6112. During the film formation, the substrate was rotated in order to attain uniform film formation on the entire surface of the substrate. And in the above film formation, the flow rate of the $B_2H_6$ gas was gradually decreased so that no B-atoms were contained in a region in the vicinity of the outermost of the a-Si film as the photoconductive layer. Thus, there was obtained a cylindrical electrophotographic light receiving member.

The above film-forming procedures were repeated nine times to obtain nine cylindrical electrophotographic light receiving members. (The cylindrical electrophotographic light receiving member will be hereinafter referred to as light receiving member.)

Herein, it should be noted to the fact that each light receiving member has an uneven outermost surface having an irregular structure comprising protrusions and recesses due to the a-Si photoconductive layer with a relatively great thickness formed by the glow discharge process and dangling bonds are present in the recesses. This situation is apparent according to the information previously described.

Formation of a two-dimensional distribution configuration at the outermost surface of the light receiving member:

As for each of the nine light receiving members, a two-dimensional distribution configuration was formed at the outermost surface thereof using the vacuum evaporation apparatus shown in FIG. 11.

The formation of the two-dimensional distribution at the outermost surface of each light receiving member using the vacuum evaporation-apparatus was conducted in the following manner.

That is, the light receiving member was fixed to the rotation axis 907 of the vacuum evaporation apparatus. The inside of the vacuum vessel 901 was evacuated to a vacuum degree of less than $1\times10^{-7}$ Torr through the exhaust pipe 908 by operating the vacuum pump (not shown). The surface of the light receiving member was heated to and maintained at a predetermined temperature by means of the heater 906 while rotating the rotary axis 907. Then, an aluminum (Al) metal material contained in each crucible 902 was heated to generate Al-vapor flows, wherein an Al thin film was formed on the surface of the light, receiving member.

In this case, it is necessary for the temperature of the light receiving member's surface upon the formation of the Al thin film to be properly controlled in order for Al atoms to readily mobilize and reach the dangling bonds present in the recesses of the irregular structure at the outermost surface of the light receiving member. And during the process of forming the Al thin film, it is necessary for other film-forming conditions including the inner pressure, film deposition rate, and film formation time to be properly controlled in order to provide a plurality of Al-containing island-like regions in a state of being spacedly distributed at the outermost surface of the light receiving member.

In the formation of the Al thin film in each case, the temperature of the light receiving member's surface upon the film formation and the deposition amount of Al element were changed so as to attain a different coating rate while having a due care about the size of a Al-containing island-like region provided at the outermost surface of the light receiving member so that said size is at about 3000 Å in diameter.

Evaluation

Observation of the area rate for the Al-containing regions:

As for each of the resultant light receiving member, the size of the Al-containing island-like region, the area of the Al-containing region (that is, the area rate for the Al-containing region) and the Al-content of the Al-containing region were examined by way of two-dimensional mapping by means of X-ray microanalysis. Based on the examined results, there was obtained an area rate for the Al-containing regions. The results obtained are shown in Table B2 wherein the area rate for the Al-containing region in each case is shown.

In Table B2, a case (not shown) in which the area rate for the Al-containing region is 0% means a light receiving member with no Al-containing region. And the case in which the area rate for the Al-containing region is 100% means a light receiving member in which the entire region of the outermost surface comprises a Al-containing region.

Evaluation of electrophotographic characteristics:

Each of the resultant light receiving members was evaluated with respect to its electrophotographic characteristics, namely, (1) occurrence of coarse image, (2) toner transferring efficiency, (3) lubricating property by cleaning means, and (4) occurrence of a smeared image by setting the light receiving member to an electrophotographic copying machine NP 5060 which has been modified to be usable for experimental purposes (produced by Canon Kabushiki Kaisha) in the following manner.

(1) Evaluation of the occurrence of coarse image:

A halftone chart was copied to obtain a plurality of reproduced halftone images. The resultant reproduced halftone images were evaluated while comparing with the original. The evaluated result is shown in Table B2 based on the following criteria:

- ⊚: a case wherein the reproduced image is absolutely with no coarse image and excels in quality,
- ○: a case wherein the reproduced image is accompanied by a few of slight coarse images but is satisfactory in quality,
- Δ: a case wherein the reproduced image is accompanied by a distinguishable number of coarse images but it is practically acceptable, and
- X: a case wherein the reproduced image is accompanied by a great many of coarse images and it is problematic in practical use.

(2) Evaluation of the toner transferring efficiency:

The conventional charging process and then, the conventional development process were conducted to deposit toner on the surface of the light receiving member thereby forming a toner image on said surface, and when the toner on the surface of the light receiving member was transferred onto a copying paper, the image-forming process was suspended. And the density of the residual toner on the surface of the light receiving member was measured by means of a densitometer MACBETH RD916 (trademark name, produced by Macbeth Company). The measured result is shown in Table B2 based on the following criteria:

- ⊚: a case wherein the toner is entirely transferred without any residual toner on the surface of the light receiving member, ○: a case wherein a slight residual toner is present on the surface of the light receiving member, Δ: a case wherein a distinguishable residual toner is present on the surface of the light receiving member but this is practically acceptable, and X: a case wherein a remarkable residual toner is present on the surface of the light receiving member and this is practically problematic.

(3) Evaluation of the lubricating property by cleaning means:

In this evaluation, the copying machine was not used. This evaluation was conducted in the following manner. That is, a cleaning blade made of silicone rubber was traversed on the surface of the light receiving member while contacting said cleaning blade with the surface of the light receiving member at a pressure of 10 N/cm$^2$, wherein the state of the cleaning blade when moved on the surface of the light receiving member was evaluated.

The evaluated result is shown in Table B2 based on the following criteria:

⊙: a case wherein the state of the cleaning blade to move on the surface of the light receiving member is excellent, ○: a case wherein the state of the cleaning blade to move on the surface of the light receiving member is good, Δ: a case wherein the state of the cleaning blade to move on the surface of the light receiving member is not good but it is practically acceptable, and X: a case wherein the cleaning blade is liable to wear.

(4) Evaluation of the occurrence of smeared image:

An original comprising a test chart FY9-9058 (produced by Canon Kabushiki Kaisha) having characters comprising minute lines in the entire white background was subjected to reproduction to obtain reproduced images. Of these reproduced images, one which is worst in terms of image quality was subjected to evaluation based on the following criteria. The results thus evaluated are shown in Table B2.

⊙: a case wherein the image has no unfocused portion and it is excellent in quality, ○: a case wherein the image has a slight blurred portion but it is satisfactory in quality, Δ: a case wherein the image has some unfocused portions but the characters of the image can be easily distinguished and therefore, the image is practically acceptable, and X: a case wherein some of the characters of the image cannot be easily distinguished and therefore, the image is problematic in practical use.

From the results shown in Table B2, it was found that the light receiving members which are 5% to 60% in terms of the area rate for the Al-containing region are superior with respect to the electrophotographic characteristics.

Experiment B2

There were prepared four cylindrical electrophotographic light receiving members by repeating the procedures employed in the preparation of electrophotographic light receiving member in Experiment B1.

The four light receiving members were made to be Samples B1 to B4.

As for each sample, by repeating the metal thin thin film-forming procedures using the vacuum evaporation apparatus shown in FIG. 11 in Experiment B1, an indium (In) thin film was formed on the surface thereof while properly controlling the film deposition conditions including the substrate temperature, deposition rate, and deposition time so that the In thin film is deposited in a state of having a two-dimensional distribution on the surface of the light receiving member. Said conditions upon the formation of the In thin film were changed so as to provide a different distribution state of the In thin film on the surface of the light receiving member while attaining a coating rate of about 50%.

As for the two-dimensional distribution configuration comprising a plurality of In-containing island-like regions spacedly distributed at the outermost surface of the light receiving member, it was found that it is as shown in FIG. 6 in the case of Sample B1, it is as shown in FIG. 7 in the case of Sample B2, it is as shown in FIG. 8 in the case of Sample B3, and it is as shown in FIG. 9 in the case of Sample B4.

Each of the resultant light receiving members was evaluated with respect to its electrophotographic characteristics in the same evaluation manner as in Experiment B1. The results obtained are shown in Table B3. Based on the results shown in Table B3, it was found that when an electrophotographic light receiving member is made to have such two-dimensional distribution configuration as shown in FIG. 6, FIG. 7, FIG. 8, or FIG. 9 is superior in toner transferring efficiency as well as it excels in other electrophotographic characteristics.

Experiment B3

Each of the four electrophotographic light receiving members (Samples Nos. B1 to B4) obtained in Experiment B2 was subjected to the endurance test of conducting 100000 copying shots under environmental conditions of 40° C. in temperature and 85% in humidity. Thereafter, the light receiving member was evaluated with respect to its electrophotographic characteristics in the same manner as in Experiment B1. The evaluated results obtained are shown in Table B4. Based on the results shown in Table B4, it was found that the light receiving members of Samples Nos. B1 and B2 each having the two-dimensional distribution configuration shown in FIG. 6 or FIG. 7 are surpassing the light receiving members of Samples Nos. B3 and B4 each having the two-dimensional distribution configuration shown in FIG. 8 or FIG. 9 in the electrophotographic characteristics after the endurance test.

Experiment B4

There were prepared seven cylindrical electrophotographic light receiving members by repeating the procedures employed in the preparation of electrophotographic light receiving member in Experiment B1.

As for each light receiving member, by repeating the metal thin film-forming procedures using the vacuum evaporation apparatus shown in FIG. 11 in Experiment B1, a Sn thin film was formed on the surface thereof while properly controlling the film deposition conditions and the deposition time so that the Sn thin film is deposited in a state of having a two-dimensional distribution on the surface of the light receiving member while attaining a coating rate of about 30%. Said conditions upon the formation of the Sn thin film were changed so that the size of an island-like Sn-containing region provided is different in each case, wherein a plurality of Sn-containing island-like regions were provided in a state of being spacedly distributed at the outermost surface of the light receiving member.

Each of the resultant light receiving members was subjected to the two-dimensional mapping analysis described in Experiment B1 to examine the size of the Sn-containing island-like region. The results obtained are shown in Table B5.

And each of the resultant light receiving members was evaluated with respect to its electrophotographic characteristics in the same evaluation manner as in Experiment B1. The results obtained are shown in Table B5.

Based on the results shown in Table B5, it was found that when the size of the Sn-containing island-like region constituting the two-dimensional distribution configuration at the outermost surface of the light receiving member is 200 to 5000 Å in diameter, marked electrophotographic characteristics are provided.

Experiment B5

There were prepared fourteen cylindrical electrophotographic light receiving members by repeating the procedures employed in the preparation of electrophotographic light receiving member in Experiment B1.

As for each light receiving member, by repeating the metal thin thin film-forming procedures using the vacuum evaporation apparatus shown in FIG. 11 in Experiment B1, a metal thin film of one of the metal elements shown in Table B6 was formed on the surface thereof while properly controlling the film deposition conditions and the deposition time so that the metal thin film is deposited in a state of having a two-dimensional distribution on the surface of the light receiving member while attaining a coating rate of about 40%, wherein a plurality of metal element-containing island-like regions were provided in a state of being spacedly distributed at the outermost surface of the light receiving member.

Each of the resultant light receiving members was subjected to the two-dimensional mapping analysis described in Experiment B1 to examine the size of the metal element-containing island-like region. As a result, it was found that the size of the metal element-containing island-like region is about 5000 Å in each case.

And each of the resultant light receiving members was evaluated with respect to its electrophotographic characteristics in the same evaluation manner as in Experiment B1. The results obtained are shown in Table B6.

Based on the results shown in Table B6, it was found that when a metal element selected from the group consisting of Al, Ga, In, Sn, Pb, Bi, S, Se and Te belonging to group 13, 14, 15, or 16 of the periodic table is used in the formation of the two-dimensional distribution configuration at the outermost surface of the light receiving member, any of the light receiving members excels or good enough in electrophotographic characteristics; on the other hand, when a metal element selected from the group consisting of Fe, Cr, Mg, Zn, and Ti is used in the formation of the two-dimensional distribution configuration at the outermost surface of the light receiving member, any of the light receiving members causes the occurrence of a coarse image and is inferior in the toner transferring efficiency and the lubricating property.

In the following, the present invention will be described with reference to the following examples, which are not intended to restrict the scope of the present invention.

Example A1

There were prepared six cylindrical electrophotographic light receiving member each comprising a photoconductive layer formed on a mirror-polished surface of an aluminum cylinder as a substrate by repeating the procedures employed in the preparation of electrophotographic light receiving member in the foregoing Experiment A1.

Of the six light receiving members, one light receiving member was randomly elected. As for the light receiving member selected, a two-dimensional distribution configuration was formed at the outermost surface thereof as will be described below.

That is, by conducting the vacuum evaporation process using the vacuum evaporation apparatus shown in FIG. 11 and using the Se material as an evaporation metal source which was described in the foregoing Experiment A1, a Se thin film was formed on the surface of the light receiving member. Then, the Se-thin film on the light receiving member in the vacuum evaporation apparatus was subjected to thermal diffusion treatment to diffuse Se-element into the dopant-free layer region of the photoconductive layer of the light receiving member, whereby forming a plurality of Se-containing island-like regions having a size of about 5000 Å in diameter in a state of being spacedly distributed at the outermost surface of the light receiving member. The area rate for the Se-containing island-like regions was found to be about 50%.

The light receiving member thus treated was subjected to surface polishing treatment using the polishing apparatus shown in FIG. 16 to remove the residual metal thin film. By this, there was obtained a cylindrical electrophotographic light receiving member belonging to the present invention.

The light receiving member obtained was evaluated with respect its electrophotographic characteristics in the same manner as in Experiment A1. The evaluated results obtained are shown in Table A7.

Comparative Example A1

The procedures of Example A1 were repeated, except that the surface treatments conducted in Example A1 were not conducted, to thereby obtain a comparative cylindrical electrophotographic light receiving member.

The comparative light receiving member obtained was evaluated with respect its electrophotographic characteristics in the same manner as in Experiment A1. The evaluated results obtained are shown in Table A7.

From the results shown in Table A7, it is understood that the light receiving member obtained in Example A1 is apparently surpassing the comparative light receiving member obtained in Comparative Example A1.

Comparative Example A2

There was firstly obtained an ectrophotographic light receiving member comprising a photoconductive layer formed on a mirror-polished surface of an aluminum cylinder in the same manner as in Example A1. As for the light receiving member thus obtained, its surface was subjected to surface polishing treatment in accordance with the surface polishing manner described in Japanese Unexamined Patent Publication No. 231558/1986 and using a Se material as an abrasive material, wherein a reaction product produced as a result of the solid phase reaction between the surface of the light receiving member and the abrasive material was mechanically removed. By this, there was obtained a comparative cylindrical electrophotographic light receiving member. The distribution state of Se element at the outermost surface of the light receiving member was examined by was of two-dimensional mapping by means of X-ray microanalysis. As result, it was found that the Se element is uniformly distributed on the surface of the light receiving member without taking such two-dimensional distribution configuration as in Example A1.

The comparative light receiving member obtained was evaluated with respect its electrophotographic characteristics in the same manner as in Experiment A1. The evaluated results obtained are shown in Table A7.

From the results shown in Table A7, it is understood that the light receiving member obtained in Example A1 is apparently surpassing the comparative light receiving member obtained in Comparative Example A2.

Example A2

There were prepared six cylindrical electrophotographic light receiving members each comprising a photoconductive layer and a surface layer disposed in the named order on a mirror-polished surface of an aluminum cylinder in accordance with the procedures employed in the preparation of electrophotographic light receiving member in Experiment A1 and under film-forming conditions shown in Table A8.

Of the six light receiving members, one light receiving members was randomly selected. As for the light receiving member selected, a two-dimensional distribution configuration was formed at the outermost surface thereof as will be described below.

That is, by conducting the vacuum evaporation process using the vacuum evaporation apparatus shown in FIG. 11 and using the A1 material as an evaporation metal source which was described in the foregoing Experiment A3, an aluminum (Al) thin film was formed on the surface of the light receiving member. Then, the Al-thin film on the light receiving member in the vacuum evaporation apparatus was subjected to thermal diffusion treatment to diffuse Al-element into the dopant-free surface layer of the light receiving member, whereby forming a plurality of Al-containing island-like regions having a size of about 3000 Å in diameter in a state of being spacedly distributed at the outermost surface of the light receiving member. The area rate for the Al-containing island-like regions was found to be about 20%.

The light receiving member thus treated was subjected to surface polishing treatment using the polishing apparatus shown in FIG. 16 to remove the residual metal thin film. By this, there was obtained a cylindrical electrophotographic light receiving member belonging to the present invention.

The light receiving member obtained was evaluated with respect its electrophotographic characteristics in the same manner as in Experiment A1. As a result, the light receiving member excels in electrophotographic characteristics as well as the light receiving member obtained in Example A1.

Comparative Example A3

There were prepared six cylindrical electrophotographic light receiving members each comprising a photoconductive layer and a surface layer disposed in the named order on a mirror-polished surface of an aluminum cylinder in accordance with the procedures employed in the preparation of electrophotographic light receiving member in Experiment A1 and under film-forming conditions shown in Table A9, wherein immediately before the completion of the formation of their surface layers, aluminum powder having a particle size of an micron order was introduced together with Ar gas as a carrier gas into the reaction chamber in accordance with the technique described in Japanese Unexamined Patent Publication No. 28658/1985 to thereby introduce Al element into their surface layers. By this, there were obtained six comparative cylindrical electrophotographic light receiving members. One of these comparative light receiving members was randomly selected, and the distribution state of the Al element at the outermost surface of the light receiving member was examined by way of two-dimensional mapping by means of X-ray microanalysis. As result, it was found that the Al element is uniformly distributed on the surface of the light receiving member without taking such two-dimensional distribution configuration as in Example A2.

This comparative light receiving member was evaluated with respect its electrophotographic characteristics in the same manner as in Experiment A1. As a result, it was found that the comparative light receiving member is not satisfactory in the prevention of the occurrence of a coarse image and insufficient in the toner transferring efficiency.

Comparative Example A4

There were prepared six cylindrical electrophotographic light receiving members each comprising a photoconductive layer and a surface layer disposed in the named order on a mirror-polished surface of an aluminum cylinder in accordance with the procedures employed in the preparation of electrophotographic light receiving member in Experiment A1 and under film-forming conditions shown in Table A10, wherein immediately before the completion of the formation of their surface layers, $B_2H_6$ gas was into the reaction chamber at a flow rate of 100 ppm (against $SiH_4$; see, Table A10) to thereby introduce B element into their surface layers. By this, there were obtained six comparative cylindrical electrophotographic light receiving members. One of these comparative light receiving members was randomly selected, and the distribution state of the B element at the outermost surface of the light receiving member was examined byway of two-dimensional mapping by means of X-ray microanalysis. As result, it was found that the B element is uniformly distributed on the surface of the light receiving member without taking such two-dimensional distribution configuration as in Example A2.

This comparative light receiving member was evaluated with respect its electrophotographic characteristics in the same manner as in Experiment A1. As a result, it was found that the comparative light receiving member is not satisfactory in the prevention of the occurrence of a coarse image and insufficient in the toner transferring efficiency.

Comparative Example A5

There were prepared six cylindrical electrophotographic light receiving members each comprising a photoconductive layer and a surface layer disposed in the named order on a mirror-polished surface of an aluminum cylinder in accordance with the procedures employed in the preparation of electrophotographic light receiving member in Experiment A1 and under film-forming conditions shown in Table A11, wherein immediately before the completion of the formation of their surface layers, $PH_3$ gas was into the reaction chamber at a flow rate of 100 ppm (against $SiH_4$; see, Table A11) to thereby introduce P element into their surface layers. By this, there were obtained six comparative cylindrical electrophotographic light receiving members. One of these comparative light receiving members was randomly selected, and the distribution state of the P element at the outermost surface of the light receiving member was examined by way of two-dimensional mapping by meads of X-ray microanalysis. As result, it was found that the P element is uniformly distributed on the surface of the light receiving member without taking such two-dimensional distribution configuration as in Example A2.

This comparative light receiving member was evaluated with respect its electrophotographic characteristics in the same manner as in Experiment A1. As a result, it was found that the comparative light receiving member is not satisfactory in the prevention of the occurrence of a coarse image and insufficient in the toner transferring efficiency.

Example A3

There were prepared six cylindrical electrophotographic light receiving members each comprising a charge injection inhibition layer, a photoconductive layer and a surface layer disposed in the named order on a mirror-polished surface of an aluminum cylinder in accordance with the procedures employed in the preparation of electrophotographic light receiving member in Experiment A1 and under film-forming conditions shown in Table A12.

Of the six light receiving members, one light receiving member was randomly selected. As for the light receiving member selected, a two-dimensional distribution configuration was formed at the outermost surface thereof as will be described below.

That is, by conducting the vacuum evaporation process using the vacuum evaporation apparatus shown in FIG. 11 and using the Al material as an evaporation metal source which was described in the foregoing Experiment A3, an aluminum (Al) thin film was formed on the surface of the right receiving member. Then, the Al-thin film on the light receiving member in the vacuum evaporation apparatus was subjected to thermal diffusion treatment to diffuse Al-element into the dopant-free surface layer of the light receiving member, whereby forming a plurality of Al-containing island-like regions having a size of about 2000 Å in diameter in a state of being spacedly distributed at the outermost surface of the light receiving member. The area rate for the Al-containing island-like regions was found to be about 40%.

The light receiving member thus treated was subjected to surface polishing treatment using the polishing apparatus shown in FIG. 16 to remove the residual metal thin film. By this, there was obtained a cylindrical electrophotographic light receiving member belonging to the present invention.

The light receiving member obtained was evaluated with respect its electrophotographic characteristics in the same manner as in Experiment A1. As a result, the light receiving member excels in electrophotographic characteristics as well as the light receiving member obtained in Example A1.

Example A4

There were prepared six functionally-divided cylindrical electrophotographic light receiving members each comprising a charge injection inhibition layer, a charge transportation layer, a charge generation layer and a surface layer disposed in the named order on a mirror-polished surface of an aluminum cylinder in accordance with the procedures employed in the preparation of electrophotographic light receiving member in Experiment A1 and under film-forming conditions shown in Table A13.

Of the six light receiving members, one light receiving members was randomly selected. As for the light receiving member selected, a two-dimensional distribution configuration was formed at the outermost surface thereof as will be described below.

That is, by conducting the vacuum evaporation process using the vacuum evaporation apparatus shown in FIG. 11 which was described in the foregoing Experiment 1 while using a Pb material as an evaporation metal source, a Pb thin film was formed on the surface of the light receiving member. Then, the Pb-thin film on the light receiving member in the vacuum evaporation apparatus was subjected to thermal diffusion treatment to diffuse Pb-element into the dopant-free surface layer of the light receiving member, whereby forming a plurality of Pb-containing island-like regions having a size of about 3500 Å in diameter in a state of being spacedly distributed at the outermost surface of the light receiving member. The area rate for the Pb-containing island-like regions was found to be about 30%.

The light receiving member thus treated was subjected to surface polishing treatment using the polishing apparatus shown in FIG. 16 to remove the residual metal thin film. By this, there was obtained a functionally-divided cylindrical electrophotographic light receiving member belonging to the present invention.

The light receiving member obtained was evaluated with respect its electrophotographic characteristics in the same manner as in Experiment A1. As a result, the light receiving member excels in electrophotographic characteristics as well as the light receiving member obtained in Example A1.

Example A5

There was prepared a cylindrical electrophotographic light receiving member comprising a charge injection inhibition layer, a photoconductive layer and a surface layer disposed in the named order on a mirror polished surface of an aluminum cylinder as a substrate in accordance with the previously described film-forming procedures using the RF plasma CVD apparatus shown in FIG. 15 under film-forming conditions shown in Table A14.

As for the light receiving member, a two-dimensional distribution configuration was formed at the outermost surface thereof as will be described below.

That is, by conducting the vacuum evaporation process using the vacuum evaporation apparatus shown in FIG. 11 which was described in the foregoing Experiment A1 while using an indium (In) material as an evaporation metal source, an In thin film was formed on the surface of the light receiving member. Then, the In thin film on the light receiving member in the vacuum evaporation apparatus was subjected to thermal diffusion treatment to diffuse In-element into the dopant-free surface layer of the light receiving member, whereby forming a plurality of In-containing island-like regions having a size of about 1500 Å in diameter in a state of being spacedly distributed at the outermost surface of the light receiving member. The area rate for the In-containing island-like regions was found to be 10%.

The light receiving member thus treated was subjected to surface polishing treatment using the polishing apparatus shown in FIG. 16 to remove the residual metal thin film. By this, there was obtained a cylindrical electrophotographic light receiving member belonging to the present invention.

The light receiving member obtained was evaluated with respect its electrophotographic characteristics in the same manner as in Experiment A1. As a result, the light receiving member excels in electrophotographic characteristics as well as the light receiving member obtained in Example A1.

Example A6

There were prepared six cylindrical electrophotographic light receiving members each comprising a photoconductive layer and a surface layer disposed in the named order on a mirror polished surface of an aluminum cylinder as a substrate by repeating the procedures employed in the preparation of electrophotographic light receiving member in Experiment A1.

Of the six light receiving members, five light receiving members were randomly selected. As for each light receiving member, a two-dimensional distribution configuration was formed at the outermost surface thereof as wall be described below.

That is, by conducting the vacuum evaporation process using the vacuum evaporation apparatus shown in FIG. 11 which was described in the foregoing Experiment A1 while using a combination of two different materials shown in Table A15 as an evaporation metal source, a metal thin film comprised of two different metal elements was formed on the surface of the light receiving member. Then, the metal thin film on the light receiving member in the vacuum evaporation apparatus was subjected to thermal diffusion treatment to diffuse the two elements constituting the metal thin film into the dopant-free surface layer of the light receiving member, whereby forming a plurality of two elements-containing island-like regions having a size of about 1000 Å in diameter in a state of being spacedly distributed at the outermost surface of the light receiving member. The area rate for the In-containing island-like regions was found to be 20%.

The light receiving member thus treated was subjected to surface polishing treatment using the polishing apparatus shown in FIG. 16 to remove the residual metal thin film. By this, there were obtained five cylindrical electrophotographic light receiving members belonging to the present invention.

Each of the five light receiving members obtained was evaluated with respect its electrophotographic characteristics in the same manner as in Experiment A1. The evaluated results obtained are shown in Table A15. From the results shown in Table A15, it is understood that any of the five light receiving members excels in electrophotographic characteristics.

Example A7

The electrophotographic light receiving member obtained in Example A1 was evaluated with respect to the evaluation items (1) to (4) described in the foregoing Experiment A1 by setting it to the electrophotographic apparatus shown in FIG. 18 provided with the roller charger shown in FIG. 19(*a*). The image-forming process was conducted by rotating the roller charger in the forward direction at the same rotation speed as that for the light receiving member to be rotated (that is, the rotation speed of the roller charger relative to that of the light receiving member was made to be 0%) while impressing a D.C. voltage of 1.5 kV to the roller charger. The evaluation of each of the evaluation items (1) to (4) was conducted in he same manner as in the foregoing Experiment A1. The evaluated results obtained are shown in Table A16.

In addition, evaluation was conducted with respect to (a) evenness in the charging efficiency and (b) evenness in surface potential at halftone exposure.

The evaluation of each of the evaluation items (a) and (b) was conducted as will be described below.

Evaluation of the evaluation item (a):

This evaluation was conducted in the following manner. That is, the light receiving member is set to an electrophotographic apparatus used for experimental purposes which has the same constitution as that of the electrophotographic apparatus shown in FIG. 18 and is provided with the roller charger shown in FIG. 19(*a*) (produced by Canon Kabushiki Kaisha). Then, a predetermined D.C. voltage is continuously impressed to the roller charger under condition of not conducting light exposure while continuously reading a surface potential of the light receiving member in the peripheral direction by an electrostatic voltmeter, wherein the surface potential values read are recorded on a recorder. For the surface potential values thus recorded, there are obtained (i) a difference between the maximum surface potential and the minimum surface potential value and (ii) a mean value among the surface potential values. The difference (i) is divided by the mean vale (ii) to obtain a value corresponding to a reference which serves to evaluate the light receiving member with respect to evenness in the charging efficiency.

Evaluation of the evaluation item (b):

This evaluation was conducted using the same electrophotographic apparatus described in the evaluation of the evaluation item (a) in the following manner. That is, after positioning a white paper on the original table, the light receiving member is charged to a predetermined surface potential in dark (for example, 400 V) under condition of not conducting light exposure, and immediately after this, halogen lamp light (light having a wavelength of more than 600 nm having been excluded through the filter in the lens system) is irradiated to the light receiving member while controlling the quantity (luminous energy) of the halogen lamp light so that the light receiving member has a surface potential in light of 50 V. Then, the white paper on the original table is replaced by a halftone chart and the halogen lamp light in a quantity corresponding to ½ of the above light quantity is continuously irradiated to the light receiving member while continuously reading a surface potential of the light receiving member by an electrostatic voltmeter, wherein the surface potential values read are recorded on a recorder. For the surface potential values thus recorded, there are obtained (i) a difference between the maximum surface potential and the minimum surface potential value and (ii) a mean value among the surface potential values. The difference (i) is divided by the mean vale (ii) to obtain a value corresponding to a reference which serves to evaluate the light receiving member with respect to evenness in surface potential at halftone exposure.

The valuated results obtained in the evaluation of the evaluation items (a) and (b) are shown in Table A16 based on the following criteria.

⊙: a case wherein no unevenness in the charging efficiency is substantially found, ○: a case wherein a certain unevenness in the charging efficiency is found but the situation is superior to that in the case of the corona charging, Δ: a case wherein there is found an unevenness in the charging efficiency at the same level in the case of the corona charging, and X: a case wherein there is found an unevenness in the charging efficiency which is inferior to that in the case of the corona charging.

From the results shown in Table A16, it is understood that the electrophotographic light receiving member obtained in Example A1 exhibits excellent electrophotographic characteristics even in the case of using in the electrophotographic apparatus provided with the roller charger while effectively preventing the occurrence of an unevenness in not only the charging efficiency but also the surface potential at halftone exposure.

Example A8

The electrophotographic light receiving member obtained in Example A2 was evaluated with respect to the evaluation items (1) to (4) described in the foregoing Experiment A1 by setting it to the electrophotographic apparatus shown in FIG. 18 provided with the wire brush charger shown in FIG. 19(*b*). The image-forming process was conducted by rotating the wire brush charger in the direction reverse to the direction for the light receiving member to rotate at the same rotation speed as that for the light receiving member to be rotated (that is, the rotation speed of the roller charger relative to that of the light receiving member was made to be 200%) while impressing a D.C. voltage of 800 V to the wire brush charger. The evaluation of each of the evaluation items (1) to (4) was conducted in the same manner as in the foregoing Experiment A1. The evaluated results obtained are shown in Table A16.

In addition, evaluation was conducted with respect to (a) evenness in the charging efficiency and (b) evenness in surface potential at halftone exposure in the same manner as in Example A7. The evaluated results obtained are shown in Table A16.

From the results shown in Table A16, it is understood that the electrophotographic light receiving member obtained in Example A2 exhibits excellent electrophotographic characteristics even in the case of using in the electrophotographic apparatus provided with the roller charger while effectively preventing the occurrence of an unevenness in not only the charging efficiency but also the surface potential at halftone exposure.

Example A9

The electrophotographic light receiving member obtained in Example A4 was evaluated with respect to the evaluation items (1) to (4) described in the foregoing Experiment A1 by setting it to the electrophotographic apparatus shown in FIG. 18 provided with the magnetic brush charger shown in FIG. 19(*c*). The image-forming process was conducted by rotating the magnetic brush charger in the direction reverse to the direction for the light receiving member to rotate at a rotation speed corresponding to ½ of the rotation speed for the light receiving member to be rotated (that is, the rotation speed of the roller charger relative to that of the light receiving member was made to be 150%) while impressing a D.C. voltage of 800 V to the magnetic brush charger. The evaluation of each of the evaluation items (1) to (4) was conducted in the same manner as in the foregoing Experiment A1. The evaluated results obtained are shown in Table A16.

In addition, evaluation was conducted with respect to (a) evenness in the charging efficiency and (b) evenness in surface potential at halftone exposure in the same manner as in Example A7. The evaluated results obtained are shown in Table A16.

From the results shown in Table A16, it is understood that the electrophotographic light receiving member obtained in Example A4 exhibits excellent electrophotographic characteristics even in the case of using in the electrophotographic apparatus provided with the roller charger while effectively preventing the occurrence of an unevenness in not only the charging efficiency but also the surface potential of halftone exposure.

Example A10

Each of the electrophotographic light receiving members obtained in Examples A1 to A6 was evaluated by setting the light receiving member to a full-color electrophotographic apparatus, wherein a portrait and a landscape photograph were reproduced to obtain reproduced images. As for the reproduced images obtained, evaluation was conducted with respect to reproduction clearness of delicate color vision of a human skin, human hairs, and blue sky. The evaluated results obtained are shown in Table A17 based on the following criteria:

◎: a case wherein the reproduction clearness is excellent,

○: a case wherein the reproduction clearness is good enough,

Δ: a case wherein the reproduction clearness is not good but practically acceptable, X: a case wherein the reproduction clearness is inferior but seems problematic in practical use.

From the results shown in Table A17, it is understood that any of the electrophotographic light receiving members obtained in Examples A1 to A6 excels in color reproduction.

Example A11

Each of the electrophotographic light receiving members obtained in Examples A1 to A6 was evaluated by setting the light receiving member to a full-color electrophotographic apparatus, wherein after having subjected to the endurance test of continuously conducting 100000 copying shots, a portrait and a landscape photograph were reproduced to obtain reproduced images. As for the reproduced images obtained, evaluation was conducted with respect to reproduction clearness of delicate color vision of a human skin, human hairs, and blue sky in the same manner as in Example A10. The evaluated results obtained are shown in Table A18.

From the results shown in Table A18, it is understood that any of the electrophotographic light receiving members obtained in Examples A1 to A6 still excels or good enough in color reproduction even after the endurance test.

Example A12

The procedures of Example A2 were repeated, except that as the aluminum cylinder as the substrate, an aluminum cylinder of 30 mm in diameter and having a mirror-polished surface was used, to thereby obtain a cylindrical electrophotographic light receiving member belonging to the present invention.

The light receiving member was evaluated with respect to its electrophotographic characteristics by setting it to the laser beam printer shown in FIG. 20 provided with the magnetic brush charger shown in FIG. 19(*c*), wherein a halftone original was continuously reproduced to obtain reproduced images. As a result of evaluating the resultant reproduced images, it was found that they are accompanied by neither a coarse image nor an uneven image and excel in clearness.

Then, under high temperature and high humidity environmental condition of 30° C./80%, after having subjected the light receiving member to the endurance test of continuously conducting 10000 copying shots in the laser beam printer, the halftone original was continuously reproduced to obtain reproduced images. As a result of evaluating the resultant reproduced images, it was found that they are good enough in quality.

Based on the results obtained in the above examples, it is understood that according to the electrophotographic light receiving member of the present invention, even in the case of conducting the electrophotographic image-forming process using a contact electrification device without using a heater for heating the light receiving member, a high quality reproduced image with neither a coarse image nor a smeared image is stably and continuously obtained while preventing the generation of ozone and while saving the electric power consumed.

Example B1

There was prepared a cylindrical electrophotographic light receiving member comprising a photoconductive layer disposed on a mirror-polished surface of an aluminum cylinder as a substrate by repeating the procedures by the RF plasma CVD process employed in the preparation of electrophotographic light receiving member in the foregoing Experiment B1, except for changing the film-forming conditions employed in said Experiment B1 to those shown in Table B7.

Herein, as previously described, it should be noted to the fact that in the case of forming an amorphous silicon series light receiving layer with a relatively great thickness on a substrate by the glow discharge process (such as the RF plasma CVD process, the μW plasma CVD process, or the like) in order to obtain an electrophotographic light receiving member, the resulting light receiving member is liable to have an uneven outermost surface having an irregular structure comprising protrusions and recesses due to said amorphous series light receiving layer formed by the glow discharge process, wherein dangling bonds are present in the recesses. Therefore, it should be understood that the light receiving member obtained in the above has an uneven outermost surface having an irregular structure comprising protrusions and recesses containing dangling bonds present therein.

As for the light receiving member obtained in the above, a two-dimensional distribution configuration was formed at the outermost surface thereof as wall be described below.

That is, by conducting the vacuum evaporation process using the vacuum evaporation apparatus shown in FIG. 11 and using the aluminum (Al) material as an evaporation metal source which was described in the foregoing Experiment B1, an aluminum (Al) thin film was formed on the surface of the light receiving member, whereby a plurality of Al-containing island-like regions having a size of about 5000 Å in diameter in a state of being spacedly distributed at the outermost surface of the light receiving member. The area rate for the Al-containing island-like regions was found to be about 20%.

By this, there was obtained an electrophotographic light receiving member belonging to the present invention.

The light receiving member obtained was evaluated with respect its electrophotographic characteristics in the same manner as in Experiment B1. The evaluated results obtained are shown in Table B8.

Further, as a result of observing the outermost surface of the light receiving member by way of the two-dimensional mapping by means of X-ray microanalysis, it was found that A1 element is two-dimensionally distributed such that it is convergently present in every recess present at the outermost.

From the results shown in Table B8, it is understood that the light receiving member excels in electrophotographic characteristics.

Comparative Example B1

The procedures of Example B1 were repeated, except that the surface treatment conducted in Example B1 was not conducted, to thereby obtain a comparative cylindrical electrophotographic light receiving member.

The Comparative light receiving member obtained was evaluated with respect its electrophotographic characteristics in the same manner as in Experiment B1. The evaluated results obtained are shown in Table B8.

From the results shown in Table B8, it is understood that the light receiving member obtained in Example B1 is apparently surpassing the comparative light receiving member obtained in Comparative Example B1.

Comparative Example B2

There was firstly obtained an ectrophotographic light receiving member comprising a photoconductive layer formed on a mirror-polished surface of an aluminum cylinder in the same manner as in Example B1. As for the light receiving member thus obtained, its surface was subjected to surface polishing treatment in accordance with the surface polishing manner described in Japanese Unexamined Patent Publication No. 231558/1986 and using an aluminum (Al) material as an abrasive material, wherein a reaction product produced as a result of the solid phase reaction between the surface of the light receiving member and the abrasive material was mechanically removed. By this, there was obtained a comparative cylindrical electrophotographic light receiving member. The distribution state of Al element at the outermost surface of the light receiving member was examined by way of the two-dimensional mapping by means of X-ray microanalysis. As result, it was found that the Al element is uniformly distributed on the surface of the light receiving member without taking such two-dimensional distribution configuration as in Example B1.

The comparative light receiving member obtained was evaluated with respect its electrophotographic characteristics in the same manner as in Experiment B1. The evaluated results obtained are shown in Table B8.

From the results shown in Table B8, it is understood that the light receiving member obtained in Example B1 is apparently surpassing the comparative light receiving member obtained in Comparative Example B2.

Example B2

There was prepared a cylindrical electrophotographic light receiving member comprising a photoconductive layer disposed on a mirror-polished surface of an aluminum cylinder in accordance with the procedures by the RF plasma CVD process employed in the preparation of electrophotographic light receiving member in Experiment B1 and under film-forming conditions shown in Table B9.

As for the light receiving member, a two-dimensional distribution configuration was formed at the outermost surface thereof as will be described below.

That is, by conducting the vacuum evaporation process using the vacuum evaporation apparatus shown in FIG. 11 and using a Se material as an evaporation metal source, a Se thin film was formed on the surface of the light receiving member, whereby forming a plurality of Se-containing island-like regions having a size of about 3000 Å in diameter in a state of being spacedly distributed at the outermost surface of the light receiving member. The area rate for the So-containing island-like regions was found to be about 25%.

By this, there was obtained a cylindrical electrophotographic light receiving member belonging to the present invention.

The light receiving member obtained was evaluated with respect its electrophotographic characteristics in the same manner as in Experiment B1. The evaluated results obtained in Table B10.

Further, as a result of observing the outermost surface of the light receiving member by way of the two-dimensional mapping by means of X-ray microanalysis, it was found that Se element is two-dimensionally distributed such that it is convergently present in every recess present at the outermost.

From the results shown in Table B10, it is understood that the light receiving member excels in electrophotographic characteristics.

Comparative Example B3

There was prepared a cylindrical electrophotographic light receiving member comprising a two-layered photoconductive layer (comprising a first photoconductive layer region 1 and a second photoconductive layer region 2) disposed on a mirror-polished surface of an aluminum cylinder in accordance with the procedures by the RF plasma CVD process employed in the preparation of electrophotographic light receiving member in Experiment B1 and under film-forming conditions shown in Table B11, wherein immediately before the completion of the formation of the second photoconductive layer region 2, selenium (Se) powder having a particle size of an micron order was introduced together with Ar gas as a carrier gas into the reaction chamber in accordance with the technique described in Japanese Unexamined Patent Publication No. 28658/1985 to thereby introduce Se element into the second photoconductive layer region. By this, there was obtained a comparative cylindrical electrophotographic light receiving member. As for the comparative light receiving member thus obtained, the distribution state of the Se element at the outermost surface of the light receiving member was examined by way of the two-dimensional mapping by means of X-ray microanalysis. As result, it was found that the Se element is uniformly distributed on the surface of the light receiving member without taking such two-dimensional distribution configuration as in Example B2.

This comparative light receiving member was evaluated with respect its electrophotographic characteristics in the same manner as in Experiment B1. The evaluated results obtained are shown in Table B10. From the results shown in Table B10, it is understood that the comparative light receiving member is not satisfactory in the prevention of the occurrence of a coarse image and insufficient in not only the toner transferring efficiency but also the lubricating property.

Comparative Example B4

There was prepared a cylindrical electrophotographic light receiving member comprising a two-layered photoconductive layer (comprising a first photoconductive layer region 1 and a second photoconductive layer region 2) disposed on a mirror-polished surface of an aluminum cylinder in accordance with the procedures by the RF plasma CVD process employed in the preparation of electrophotographic light receiving member in Experiment B1 and under film-forming conditions shown in Table B12, wherein immediately before the completion of the formation of the second photoconductive layer region 2, $B_2H_6$ gas was introduced into the reaction chamber at a flow rate of 100 ppm (against $SiH_4$; see, Table B12) to thereby introduce B element into the second photoconductive layer region. By this, there was obtained a comparative cylindrical electrophotographic light receiving member. As for the comparative light receiving member obtained, the distribution state of the B element at the outermost surface of the light receiving member was examined by way of the two-dimensional mapping by means of X-ray microanalysis. As result, it was found that the B element is uniformly distributed on the surface of the light receiving member without taking such two-dimensional distribution configuration as in Example B2.

This comparative light receiving member was evaluated with respect its electrophotographic characteristics in the same manner as in Experiment B1. The evaluated results obtained in Table B10, it is understood that the comparative light receiving member is not satisfactory in the prevention of the occurrence of a coarse image and insufficient in the toner transferring efficiency.

Comparative Example B5

There was prepared a cylindrical electrophotographic light receiving member comprising a two-layered photoconductive layer (comprising a first photoconductive layer region 1 and a second photoconductive layer region 2) disposed on a mirror-polished surface of an aluminum cylinder in accordance with the procedures by the RF plasma CVD process employed in the preparation of electrophotographic light receiving member in Experiment B1 and under film-forming conditions shown in Table B13, wherein immediately before the completion of the formation of the second photoconductive layer region 2, $PH_3$ gas was introduced into the reaction chamber at a flow rate of 100 ppm (against $SiH_4$; see, Table B13) to thereby introduce P element into their surface layers. By this, there was obtained a comparative cylindrical electrophotographic light receiving member. As for the comparative light receiving member thus obtained, the distribution state of the P element at the outermost surface of the light receiving member was examined by way of the two-dimensional mapping by means of X-ray microanalysis. As result, it was found that the P element is uniformly distributed on the surface of the light receiving member without taking such two-dimensional distribution configuration as in Example B2.

This comparative light receiving member was evaluated with respect its electrophotographic characteristics in the same manner as in Experiment B1. The evaluated results obtained are shown in Table B10. From the results shown in B10, it is understood that the comparative light receiving member is not satisfactory in the prevention of the occurrence of a coarse image and insufficient in the toner transferring efficiency.

Example B3

In accordance with the procedures by the RF plasma CVD process employed in the preparation of electrophotographic light receiving member in Experiment B1 and under film-forming conditions shown in Table B14, there were prepared nine cylindrical electrophotographic light receiving members each comprising a photoconductive layer disposed on a mirror-polished surface of an aluminum cylinder.

As for each of the light receiving members thus obtained, a two-dimensional distribution configuration was formed at the outermost surface thereof as will be described below.

That is, by conducting the vacuum evaporation process using the vacuum evaporation apparatus shown in FIG. 11 which was described in the foregoing Experiment B1 while using a combination of two different materials shown in Table A15 as an evaporation metal source, a metal thin film comprised of two different metal elements was formed on the surface of the light receiving member, whereby forming a plurality of two elements-containing island-like regions having a size of about 4000 Å in diameter in a state of being spacedly distributed at the outermost surface of the light receiving member. The area rate for the In-containing island-like regions was found to be 50%. By this, there were obtained nine cylindrical electrophotographic light receiving members belonging to the present invention.

Each of the nine light receiving members obtained was evaluated with respect its electrophotographic characteristics in the same manner as in Experiment B1. The evaluated results obtained are shown in Table B15. From the results shown in Table B15, it is understood that any of the five light receiving members excels in electrophotographic characteristics.

Example B4

There was prepared a cylindrical electrophotographic light receiving member comprising a photoconductive later and a surface layer (composed of a-SiC material) disposed in the named order on a mirror-polished surface of an aluminum cylinder in accordance with the procedures by the RF plasma CVD process employed in the preparation of electrophotographic light receiving member in Experiment B1 and under film-forming conditions shown in Table B16.

As for the light receiving member, a two-dimensional distribution configuration was formed at the outermost surface thereof as will be described below.

That is, by conducting the vacuum evaporation process using the vacuum evaporation apparatus shown in FIG. 11 and using a Pb material as an evaporation-metal source, a Pb thin film was formed on the surface of the light receiving member, whereby forming a plurality of Pb-containing island-like regions having a size of about 2500 Å in diameter in a state of being spacedly distributed at the outermost surface of the light receiving member. The area rate for the Pb-containing island-like regions was found to be about 60%.

By this, there was obtained a cylindrical electrophotographic light receiving member belonging to the present invention.

The light receiving member obtained was evaluated with respect its electrophotographic characteristics in the same manner as in Experiment B1. The evaluated results obtained in Table B17.

Further, as a result of observing the outermost surface of the light receiving member byway of the two-dimensional mapping by means of X-ray microanalysis, it was found that Pb element is two-dimensionally distributed such that it is convergently present in every recess present at the outermost.

From the results shown in Table B17, it is understood that the light receiving member excels in electrophotographic characteristics.

Example B5

As for the electrophotographic light receiving member obtained in Example B4, after having subjected to the endurance test of continuously conducting 100000 copying shots under high temperature and high humidity environmental condition of 40° C./85%, it was evaluated with respect its electrophotographic characteristics in the same manner as in Experiment B1. The evaluated results obtained in Table B17. From the results shown in Table B17, it is understood that the light receiving member is still satisfactory in electrophotographic characteristics even after the endurance test.

Example B6

In accordance with the foregoing manner of producing an electrophotographic light receiving member using the μW plasma CVD apparatus shown in FIGS. 13(*a*) and 13(*b*) and under film-forming conditions shown in Table B18, there were prepared six cylindrical electrophotographic light receiving members each comprising a photoconductive layer and a surface layer (composed of an a-SiC material) disposed in the named order on a mirror-polished surface of an aluminum cylinder.

Of the six light receiving members thus obtained, one light receiving member was randomly selected. As for the light receiving member selected, a two-dimensional distribution configuration was formed at the outermost surface thereof as will be described below.

That is, by conducting the vacuum evaporation process using the vacuum evaporation apparatus shown in FIG. 11 and using a sulfur (S) material as an evaporation metal source, a sulfur (S) thin film was formed on the surface of the light receiving member, whereby forming a plurality of S-containing island-like regions having a size of about 1500 Å in diameter in a state of being spacedly distributed at the outermost surface of the light receiving member. The area rate for the S-containing island-like regions was found to be about 10%.

By this, there was obtained a cylindrical electrophotographic light receiving member belonging to the present invention.

The light receiving member obtained was evaluated with respect its electrophotographic characteristics in the same manner as in Experiment B1. The evaluated results obtained in Table B17.

Further, as a result of observing the outermost surface of the light receiving member by way of the two-dimensional mapping by means of X-ray microanalysis, it was found that S element is two-dimensionally distributed such that it is convergently present in every recess present at the outermost.

From the results shown in Table B17, it is understood that the light receiving member excels in electrophotographic characteristics.

Example B7

As for the electrophotographic light receiving member obtained in Example B6, after having subjected to the endurance test of continuously conducting 100000 copying shots under high temperature and high humidity environmental condition of 40° C./85%, it was evaluated with respect its electrophotographic characteristics in the same manner as in Experiment B1. The evaluated results obtained in Table B17. From the results shown in Table B17, it is understood that the light receiving member is still satisfactory in electrophotographic characteristics even after the endurance test.

Example B8

In accordance with the foregoing manner of producing an electrophotographic light receiving member using the μW plasma CVD apparatus shown in FIGS. 13(*a*) and 13(*b*) and under film-forming conditions shown in Table B19, there were prepared six functionally divided cylindrical electrophotographic light receiving members each comprising a charge transportation layer, a charge generation layer, and a surface layer (composed of an a-SiC material) disposed in the named order on a mirror-polished surface of an aluminum cylinder.

Of the six light receiving members thus obtained, one light receiving member was randomly selected. As for the light receiving member selected, a two-dimensional distribution configuration was formed at the outermost surface thereof as will be described below.

That is, by conducting the vacuum evaporation process using the vacuum evaporation apparatus shown in FIG. 11 and using a combination of a Sn material and a Pb material as an evaporation metal source, a Sn-Pb thin film was formed on the surface of the light receiving member, whereby forming a plurality of Sn-Pb-containing island-like regions having a size of about 2000 Å in diameter in a state of being spacedly distributed at the outermost surface of the light receiving member. The area rate for the Sn-Pb-containing island-like regions was found to be about 30%.

By this, there was obtained a cylindrical electrophotographic light receiving member belonging to the present invention.

The light receiving member obtained was evaluated with respect its electrophotographic characteristics in the same manner as in Experiment B1. The evaluated results obtained in Table B17.

Further, as a result of observing the outermost surface of the light receiving member by way of the two-dimensional mapping by means of X-ray microanalysis, it was found that a combination of Sn and Pb elements is two-dimensionally distributed such that it is convergently present in every recess present at the outermost.

From the results shown in Table B17, it is understood that the light receiving member excels in electrophotographic characteristics.

Example B9

The electrophotographic light receiving member obtained in Example B1 was evaluated with respect to the evaluation items (1) to (4) described in the foregoing Experiment B1 by setting it to the electrophotographic apparatus shown in FIG. 18 provided with the roller charger shown in FIG. 19(*a*). The image-forming process was conducted by rotating the roller charger in the forward direction at the same rotation speed as that for the light receiving member to be rotated (that is, the rotation speed of the roller charger relative to that of the light receiving member was made to be 0%) while impressing a D.C. voltage of 1.5 kV to the roller charger. The evaluation of each of the evaluation items (1) to (4) was conducted in the same manner as in the foregoing Experiment B1. The evaluated results obtained are shown in Table B20.

In addition, as for the light receiving member, evaluation was conducted with respect to (a) evenness in the charging efficiency and (b) evenness in surface potential at halftone exposure in the same manner as in Example A7. The evaluated results obtained are shown in Table B20. From the results shown in Table B20, it is understood that the electrophotographic light receiving member obtained in Example B1 exhibits excellent electrophotographic characteristics even in the case of using in the electrophotographic apparatus provided with the roller charger while preventing the occurrence of an unevenness in not only the charging efficiency but also the surface potential at halftone exposure.

Example B10

The electrophotographic light receiving member obtained in Example B4 was evaluated with respect to the evaluation items (1) to (4) described in the foregoing Experiment B1 by setting it to the electrophotographic apparatus shown in FIG. 18 provided with the wire brush charger shown in FIG. 19(*b*). The image-forming process was conducted by rotating the wire brush charger in the direction reverse to the direction for the light receiving member to rotate at the same rotation speed as that for the light receiving member to be rotated (that is, the rotation speed of the roller charger relative to that of the light receiving member was made to be 200%) while impressing a D.C. voltage of 800 V to the wire brush charger. The evaluation of each of the evaluation items (1) to (4) was conducted in the same manner as in the foregoing Experiment B1. The evaluated results obtained are shown in Table B20.

In addition, evaluation was conducted with respect to (a) evenness in the charging efficiency and (b) evenness in surface potential at halftone exposure in the same manner as in Example A7. The results obtained are shown in Table B20.

From the results shown in Table B20, it is understood that the electrophotographic light receiving member obtained in Example B4 exhibits excellent electrophotographic characteristics even in the case of using in the electrophotographic apparatus provided with the roller charger while effectively preventing the occurrence of an unevenness in not only the charging efficiency but also the surface potential at halftone exposure.

Example B11

The electrophotographic light receiving member obtained in Example B8 was evaluated with respect to the evaluation items (1) to (4) described in the foregoing Experiment B1 by setting it to the electrophotographic apparatus shown in FIG. 18 provided with the magnetic brush charger shown in FIG. 19(*c*). The image-forming process was conducted by rotating the magnetic brush charger in the direction reverse to the direction for the light receiving member to rotate at a rotation speed corresponding to ½ of the rotation speed for the light receiving member to be rotated (that is, the rotation speed of the roller charger relative to that of the light receiving member was made to be 150%) while impressing a D.C. voltage of 800 V to the magnetic brush charger. The evaluation of each of the evaluation items (1) to (4) was conducted in the same manner as in the foregoing Experiment B1. The evaluated results obtained are shown in Table B20.

In addition, evaluation was conducted with respect to (a) evenness in the charging efficiency and (b) evenness in surface potential at halftone exposure in the same manner as in Example A7. The evaluated results obtained are shown in Table B20.

From the results shown in Table B20, it is understood that the electrophotographic light receiving member obtained in Example B8 exhibits excellent electrophotographic characteristics even in the case of using in the electrophotographic apparatus provided with the roller charger while effectively preventing the occurrence of an unevenness in not only the charging efficiency but also the surface potential at halftone exposure.

Example B12

Each of the electrophotographic light receiving members obtained in Examples B1, B2, B3, B4, B6, and B8 was evaluated by setting the light receiving member to a full-color electrophotographic apparatus, wherein a portrait and a landscape photograph were reproduced to obtain reproduced images. As for the reproduced images obtained, evaluation was conducted with respect to reproduction clearness of delicate color vision of a human skin, human hairs, and blue sky in the same manner as in Example A10. The evaluated results obtained are shown in Table B21.

From the results shown in Table B21, it is understood that any of the above electrophotographic light receiving members excels in color reproduction.

Example B13

Each of the electrophotographic light receiving members obtained in Examples B1, B2, B3, B4, B6, and B8 was evaluated by setting the light receiving member to a full-color electrophotographic apparatus, wherein after having subjected to the endurance test of continuously conducting 100000 copying shots, a portrait and a landscape photograph were reproduced to obtain reproduced images. As for the reproduced images obtained, evaluation was conducted with respect to reproduction clearness of delicate color vision of a human skin, human hairs, and blue sky in the same manner as in Example A10. The evaluated results obtained are shown in Table B22.

From the results shown in Table B22, it is understood that any of the above electrophotographic light receiving members still excels or good enough in color reproduction even after the endurance test.

Example B14

The procedures of Example B6 were repeated, except that as the aluminum cylinder as a substrate, an aluminum cylinder of 30 mm in diameter and having a mirror-polished surface was used, to thereby obtain a cylindrical electrophotographic light receiving member belonging to the present invention.

The light receiving member was evaluated with respect to its electrophotographic characteristics by setting it to the laser beam printer shown in FIG. 20 provided with the magnetic brush charger shown in FIG. 19(*c*), wherein a halftone original was continuously reproduced to obtain reproduced images. As a result of evaluating the resultant reproduced images, it was found that they are accompanied by neither a coarse image nor an uneven image and excel in clearness.

Then, under high temperature and high humidity environmental condition of 30° C./80%, after having subjected the light receiving member to the endurance test of continuously conducting 10000 copying shots in the laser beam printer, the halftone original was continuously reproduced to obtain reproduced images. As a result of evaluating the resultant reproduced images, it was found that they are good enough in quality.

Based on the results obtained in the above examples, it is understood that according to the electrophotographic light receiving member of the present invention, even in the case of conducting the electrophotographic image-forming process using a contact electrification device without using a heater for heating the light receiving member, a high quality reproduced image with neither a coarse image nor a smeared image is stably and continuously obtained while preventing the generation of ozone and while saving the electric power consumed.

TABLE A1

| film-forming conditions | layer constitution photoconductive layer |
|---|---|
| raw material gas & its flow rate | |
| $SiH_4$ | 500 sccm |
| $B_2H_6$ (against $SiH_4$) | 1 ppm→0 ppm |
| He | 500 sccm |
| inner pressure | 8 mTorr |
| microwave power applied | 800 W |
| bias electric power (DC) | 400 W |
| substrate temperature | 250° C. |
| layer thickness | 20 μm |

TABLE A2

| area rate for the metal-element containing region (%) | occurrence of a coarse image | toner transfer-ring efficiency | color reproduc-tion | occurrence of a ghost | total evaluation |
|---|---|---|---|---|---|
| 1 | Δ | Δ | ◎ | ◎ | Δ |
| 3 | Δ | Δ | ◎ | ◎ | Δ |
| 5 | ○ | ○ | ◎ | ◎ | ○ |
| 10 | ◎ | ◎ | ◎ | ◎ | ◎ |
| 30 | ◎ | ◎ | ◎ | ◎ | ◎ |
| 50 | ◎ | ◎ | ◎ | ◎ | ◎ |
| 60 | ◎ | ◎ | ○ | ○ | ○ |
| 70 | ◎ | ◎ | Δ | Δ | Δ |
| 100 | ◎ | ◎ | x | x | x |
| Comparative Example A1 | Δ | Δ | ○ | ◎ | Δ |

TABLE A3

| Sample No. | occurrence of a coarse image | toner transfer-ring efficiency | color reproduc-tion | occurrence of a ghost | total evaluation |
|---|---|---|---|---|---|
| Sample A1 | ◎ | ◎ | ◎ | ◎ | ◎ |
| Sample A2 | ◎ | ◎ | ◎ | ◎ | ◎ |
| Sample A3 | ◎ | ◎ | ○ | ○ | ○ |
| Sample A4 | ◎ | ◎ | ○ | ○ | ○ |

TABLE A4

| the diameter of the metal-containing region (Å) | occurrence of a coarse image | toner transfer-ring efficiency | color reproduc-tion | occurrence of a ghost | total evaluation |
|---|---|---|---|---|---|
| 150 | Δ | Δ | ◎ | ◎ | ◎ |
| 200 | ○ | ○ | ◎ | ◎ | ○ |
| 500 | ◎ | ◎ | ◎ | ◎ | ◎ |
| 1000 | ◎ | ◎ | ◎ | ◎ | ◎ |
| 2000 | ◎ | ◎ | ◎ | ◎ | ◎ |
| 5000 | ◎ | ◎ | ○ | ○ | ○ |
| 10000 | ◎ | ◎ | Δ | Δ | Δ |

TABLE A5

| the metal element contained in the island-like region | occurrence of a coarse image | toner transfer-ring efficiency | color reproduc-tion | occurrence of a ghost | total evaluation |
|---|---|---|---|---|---|
| Al | ◎ | ◎ | ◎ | ◎ | ◎ |
| Ga | ○ | ○ | ◎ | ◎ | ○ |
| Se | ◎ | ◎ | ◎ | ◎ | ◎ |
| In | ○ | ○ | ◎ | ◎ | ○ |
| Sn | ◎ | ◎ | ◎ | ◎ | ◎ |
| Sb | ○ | ○ | ◎ | ◎ | ○ |
| Te | ◎ | ◎ | ◎ | ◎ | ◎ |
| Pb | ◎ | ◎ | ◎ | ◎ | ◎ |
| Mg | Δ | Δ | ◎ | ◎ | Δ |
| Sr | x | x | ◎ | ◎ | x |
| Mn | Δ | Δ | ◎ | ◎ | Δ |
| Fe | Δ | Δ | ◎ | ◎ | Δ |
| Ni | Δ | Δ | ◎ | ◎ | Δ |
| Cu | Δ | Δ | ◎ | ◎ | Δ |
| Au | Δ | Δ | ◎ | ◎ | Δ |

TABLE A6

| the concentration of the metal element in a metal element-containing region (atomic ppm) | occur-rence of a coarse image | toner transfer-ring efficiency | color reproduc-tion | occur-rence of a ghost | total evalua-tion |
|---|---|---|---|---|---|
| 7 | Δ | Δ | ◎ | ◎ | Δ |
| 10 | ○ | ○ | ◎ | ◎ | ○ |
| 50 | ◎ | ◎ | ◎ | ◎ | ◎ |
| 500 | ◎ | ◎ | ◎ | ◎ | ◎ |
| 2000 | ◎ | ◎ | ◎ | ◎ | ◎ |
| 10000 | ◎ | ◎ | ○ | ○ | ○ |
| 13000 | ◎ | ◎ | Δ | Δ | Δ |

TABLE A7

| | Example A1 | Comparative Example A1 | Comparative Example A2 |
|---|---|---|---|
| initial characteristic | | | |
| occurrence of a coarse image | ◎ | ○ | ○ |
| toner transferring efficiency | ◎ | ○ | ○ |
| color reproduction | ◎ | ◎ | ◎ |
| occurrence of a ghost | ◎ | ◎ | ◎ |
| after having endured | | | |
| occurrence of a coarse image | ○ | Δ | Δ |
| toner transferring efficiency | ○ | Δ | Δ |
| color reproduction | ◎ | ○ | ○ |
| occurrence of a ghost | ◎ | ○ | ○ |
| total evaluation | excellent | substantially not problematic in practical use | substantially not problematic in practical use |

TABLE A8

| film-forming conditions | layer constitution: photoconductive layer | layer constitution: surface layer |
|---|---|---|
| raw material gas & its flow rate | | |
| $SiH_4$ | 500 sccm | 70 sccm |
| $CH_4$ | 0 sccm | 300 sccm |
| $B_2H_6$ (against $SiH_4$) | 1 ppm | 0 ppm |
| He | 500 sccm | 500 sccm |
| inner pressure | 8 mTorr | 9 mTorr |
| microwave power applied | 800 W | 800 W |
| bias electric power (DC) | 400 W | 400 W |
| substrate temperature | 25° C. | 250° C. |
| layer thickness | 20 μM | 0.5 μm |

TABLE A9

| film-forming conditions | layer constitution: photoconductive layer | layer constitution: surface layer |
|---|---|---|
| raw material gas & its flow rate | | |
| $SiH_4$ | 500 sccm | 70 sccm |
| $CH_4$ | 0 sccm | 300 sccm |
| $B_2H_6$ (against $SiH_4$) | 1 ppm | 0 ppm |
| He | 500 sccm | 500 sccm |
| the amount of a powdery-Al introduced (Ar flow rate) | 0 sccm | 50 sccm |
| inner pressure | 8 mTorr | 9 mTorr |
| microwave power applied | 800 W | 800 W |
| bias electric power (DC) | 400 W | 400 W |
| substrate temperature | 250° C. | 250° C. |
| layer thickness | 20 μm | 0.5 μm |

TABLE A10

| film-forming conditions | layer constitution: photoconductive layer | layer constitution: surface layer |
|---|---|---|
| raw material gas & its flow rate | | |
| $SiH_4$ | 500 sccm | 70 sccm |
| $CH_4$ | 0 sccm | 300 sccm |
| $B_2H_6$ (against $SiH_4$) | 1 ppm | 100 ppm |
| He | 500 sccm | 500 sccm |
| inner pressure | 8 mTorr | 9 mTorr |
| microwave power applied | 800 W | 800 W |
| bias electric power (DC) | 400 W | 400 W |
| substrate temperature | 250° C. | 250° C. |
| layer thickness | 20 μm | 0.5 μm |

TABLE A11

| film-forming conditions | layer constitution: photoconductive layer | layer constitution: surface layer |
|---|---|---|
| raw material gas & its flow rate | | |
| $SiH_4$ | 500 sccm | 70 sccm |
| $CH_4$ | 0 sccm | 300 sccm |
| $B_2H_6$ (against $SiH_4$) | 1 ppm | 100 ppm |
| He | 500 sccm | 500 sccm |
| $PH_3$ (against $SiH_4$) | 0 ppm | 100 ppm |
| inner pressure | 8 mTorr | 9 mTorr |

TABLE A11-continued

| film-forming conditions | layer constitution: photoconductive layer | surface layer |
|---|---|---|
| microwave power applied | 800 W | 800 W |
| bias electric power (DC) | 400 W | 400 W |
| substrate temperature | 250° C. | 250° C. |
| layer thickness | 20 μm | 0.5 μm |

TABLE A12

| film-forming conditions | layer constitution: charge injection inhibition layer | photoconductive layer | surface layer |
|---|---|---|---|
| raw material gas & its flow rate | | | |
| $SiH_4$ | 350 sccm | 350 sccm | 100 sccm |
| $CH_4$ | 35 sccm | 0 sccm | 300 sccm |
| $B_2H_6$ (against $SiH_4$) | 1000 ppm | 1 ppm | 0 ppm |
| $H_2$ | 500 sccm | 500 sccm | 500 sccm |
| inner pressure | 9 mTorr | 10 mTorr | 10 mTorr |
| microwave power applied | 900 W | 900 W | 900 W |
| bias electric power (DC) | 500 W | 500 W | 500 W |
| substrate temperature | 250° C. | 250° C. | 250° C. |
| layer thickness | 3 μm | 25 μm | 0.3 μm |

TABLE A13

| film-forming conditions | layer constitution: charge injection inhibition layer | charge transportion layer | charge generation layer | surface layer |
|---|---|---|---|---|
| raw material gas & its flow rate | | | | |
| $SiH_4$ | 350 sccm | 350 sccm | 350 sccm | 100 sccm |
| $CH_4$ | 35 sccm | 35 sccm | 0 sccm | 300 sccm |
| He | 500 sccm | 500 sccm | 500 sccm | 500 sccm |
| $B_2H_6$ (against $SiH_4$) | 1000 ppm | 0 ppm | 0 ppm | 0 ppm |
| inner pressure | 11 mTorr | 11 mTorr | 10 mTorr | 10 mTorr |
| microwave power applied | 1000 W | 1000 W | 1000 W | 1000 W |
| bias electric power (DC) | 500 W | 500 W | 500 W | 500 W |
| substrate temperature | 250° C. | 250° C. | 250° C. | 250° C. |
| layer thickness | 3 μm | 20 μm | 5 μm | 0.5 μm |

TABLE A14

| film-forming conditions | layer constitution: charge injection inhibition layer | photoconductive layer | surface layer |
|---|---|---|---|
| raw material gas & its flow rate | | | |
| $SiH_4$ | 250 sccm | 350 sccm | 20 sccm |
| $CH_4$ | 0 sccm | 0 sccm | 500 sccm |
| He | 250 sccm | 350 sccm | 500 sccm |
| NO | 10 sccm | 0 sccm | 0 sccm |
| $B_2H_6$ (against $SiH_4$) | 1000 ppm | 1 ppm | 0 ppm |
| inner pressure | 0.3 Torr | 0.5 Torr | 0.4 Torr |
| RF power applied | 300 W | 400 W | 500 W |
| frequency | 13.56 MHz | 13.56 MHz | 13.56 MHz |
| substrate temperature | 250° C. | 250° C. | 250° C. |
| layer thickness | 4 μm | 20 μm | 0.5 μm |

TABLE A15

| metal elements contained in the island-like region | occurrence of a coarse image | toner transferring efficiency | color reproduction | occurrence of a ghost | total evaluation |
|---|---|---|---|---|---|
| Al, Se | ◎ | ◎ | ◎ | ◎ | ◎ |
| In, Ga | ○ | ○ | ◎ | ◎ | ○ |
| Se, Sn | ◎ | ◎ | ◎ | ◎ | ◎ |
| In, Pb | ○ | ○ | ◎ | ◎ | ○ |
| Sn, Pb | ◎ | ◎ | ◎ | ◎ | ◎ |

TABLE A16

| | Example A7 | Example A8 | Example A9 |
|---|---|---|---|
| initial characteristic | | | |
| occurrence of a coarse image | ◎ | ◎ | ◎ |
| toner transferring efficiency | ◎ | ◎ | ◎ |
| color reproduction | ◎ | ◎ | ◎ |
| occurrence of a ghost | ◎ | ◎ | ◎ |
| evenness in the charging efficiency | ◎ | ◎ | ◎ |
| evenness in surface potential at halftone exposure | ◎ | ◎ | ◎ |
| after having endured | | | |
| occurrence of a coarse image | ○ | ○ | ○ |
| toner transferring efficiency | ○ | ○ | ○ |
| color reproduction | ◎ | ◎ | ◎ |
| occurrence of a ghost | ◎ | ◎ | ◎ |
| evenness in the charging efficiency | ◎ | ◎ | ◎ |
| evenness in surface potential at halftone exposure | ◎ | ◎ | ◎ |
| total evaluation | ◎ | ◎ | ◎ |

TABLE A17

| | reproduction of human skin | reproduction of human hair | reproduction of blue sky | total evaluation |
|---|---|---|---|---|
| Example A1 | ◎ | ◎ | ◎ | ◎ |
| Example A2 | ◎ | ◎ | ◎ | ◎ |
| Example A3 | ◎ | ◎ | ◎ | ◎ |
| Example A4 | ◎ | ◎ | ◎ | ◎ |

TABLE A17-continued

| | reproduction of human skin | reproduction of human hair | reproduction of blue sky | total evaluation |
|---|---|---|---|---|
| Example A5 | ◎ | ◎ | ◎ | ◎ |
| Example A6 | ◎ | ◎ | ◎ | ◎ |

TABLE A18

| | reproduction of human skin | reproduction of human hair | reproduction of blue sky | total evaluation |
|---|---|---|---|---|
| Example A1 | ○ | ○ | ○ | ○ |
| Example A2 | ◎ | ◎ | ◎ | ◎ |
| Example A3 | ◎ | ◎ | ◎ | ◎ |
| Example A4 | ◎ | ◎ | ◎ | ◎ |
| Example A5 | ◎ | ◎ | ◎ | ◎ |
| Example A6 | ○ | ○ | ○ | ○ |

TABLE B1

| layer constitution film-forming conditions | photoconductive layer |
|---|---|
| raw material gas & its flow rate | |
| $SiH_4$ | 300 sccm |
| $B_2H_6$ (against $SiH_4$) | 1 ppm→0 ppm |
| $H_2$ | 500 sccm |
| inner pressure | 350 mTorr |
| RF electric power | 400 W |
| substrate temperature | 250° C. |
| layer thickness | 20 μm |

TABLE B2

| | area rate for the metal element-containing-region (%) | occurrence of a coarse image | toner transferring efficiency | lubricating property by cleaning means | occurence of a smeared image | total evaluation |
|---|---|---|---|---|---|---|
| experiment B1 | 1 | Δ | Δ | ◎ | ◎ | Δ |
| | 3 | Δ | Δ | ◎ | ◎ | Δ |
| | 5 | ○ | ○ | ◎ | ◎ | ○ |
| | 10 | ◎ | ◎ | ◎ | ◎ | ◎ |
| | 30 | ◎ | ◎ | ◎ | ◎ | ◎ |
| | 50 | ◎ | ◎ | ◎ | ◎ | ◎ |
| | 60 | ◎ | ◎ | ◎ | ○ | ○ |
| | 65 | ◎ | ◎ | ○ | Δ | Δ |
| | 70 | ◎ | ◎ | ○ | Δ | Δ |

TABLE B3

| | Sample No. | occurrence of a coarse image | toner transferring efficiency | lubricating property by cleaning means | occurrence of a smeared image | total evaluation |
|---|---|---|---|---|---|---|
| experiment B3 | B1 | ◎ | ◎ | ◎ | ◎ | ◎ |
| | B2 | ◎ | ◎ | ◎ | ◎ | ◎ |

TABLE B3-continued

| | Sample No. | occurrence of a coarse image | toner transferring efficiency | lubricating property by cleaning means | occurrence of a smeared image | total evaluation |
|---|---|---|---|---|---|---|
| | B3 | ◎ | ◎ | ◎ | ◎ | ◎ |
| | B4 | ◎ | ◎ | ◎ | ◎ | ◎ |

(evaluation before endurance)

TABLE B4

| | Sample No. | occurrence of a coarse image | toner transferring efficiency | lubricating property by cleaning means | occurrence of a smeared image | total evaluation |
|---|---|---|---|---|---|---|
| experiment B3 | B1 | ○ | ○ | ◎ | ◎ | ○ |
| | B2 | ○ | ○ | ◎ | ◎ | ○ |
| | B3 | ○ | Δ | ◎ | ○ | Δ |
| | B4 | ○ | Δ | ◎ | ○ | Δ |

(evaluation before endurance)

TABLE B5

| | the diameter of the metal element-containing region (Å) | occurence of a coarse image | toner transferring efficiency | lubricating property by cleaning means | occurrence of a smeared image | total evaluation |
|---|---|---|---|---|---|---|
| experiment B4 | 150 | Δ | Δ | ◎ | ◎ | Δ |
| | 200 | ○ | ○ | ◎ | ◎ | ○ |
| | 500 | ◎ | ◎ | ◎ | ◎ | ◎ |
| | 1000 | ◎ | ◎ | ◎ | ◎ | ◎ |
| | 2000 | ◎ | ◎ | ◎ | ◎ | ◎ |
| | 5000 | ◎ | ◎ | ◎ | ○ | ○ |
| | 10000 | ◎ | ◎ | ○ | Δ | Δ |

TABLE B6

| | metal element present at the surface | occurrence of a coarse image | toner transferring efficiency | lubricating property by cleaning means | occurrence of a smeared image | total evaluation |
|---|---|---|---|---|---|---|
| experiment B5 | Al | ◎ | ◎ | ◎ | ◎ | ◎ |
| | Ga | ○ | ○ | ○ | ◎ | ○ |
| | In | ○ | ○ | ○ | ◎ | ○ |
| | Sn | ◎ | ◎ | ◎ | ◎ | ◎ |
| | Pb | ◎ | ◎ | ◎ | ◎ | ◎ |
| | Bi | ○ | ○ | ○ | ◎ | ○ |
| | S | ◎ | ◎ | ◎ | ◎ | ◎ |
| | Se | ○ | ○ | ○ | ◎ | ○ |
| | Te | ○ | ○ | ○ | ◎ | ○ |
| | Fe | Δ | Δ | Δ | ◎ | Δ |
| | Cr | Δ | Δ | Δ | ◎ | Δ |
| | Mg | Δ | Δ | Δ | ◎ | Δ |
| | Zn | Δ | Δ | Δ | ◎ | Δ |
| | Ti | Δ | Δ | Δ | ◎ | Δ |

TABLE B7

| layer constitution film-forming conditions | photoconductive layer |
|---|---|
| raw material gas & its flow rate | |
| $SiH_4$ | 250 sccm |

TABLE B7-continued

| layer constitution film-forming conditions | photoconductive layer |
|---|---|
| $B_2H_6$ (against $SiH_4$) | 1 ppm→0 ppm |
| $H_2$ | 250 sccm |
| inner pressure | 500 mTorr |

TABLE B7-continued

| layer constitution film-forming conditions | photoconductive layer |
|---|---|
| RF electric power | 300 W |
| substrate temperature | 250° C. |
| layer thickness | 20 μm |

TABLE B8

| | occurrence of a coarse image | toner transferring efficiency | lubricating property by cleaning means | occurrence of a smeared image | total evaluation |
|---|---|---|---|---|---|
| Example B1 | ⊙ | ⊙ | ⊙ | ⊙ | ⊙ |
| Comparative Example B1 | Δ | Δ | ⊙ | ○ | Δ |
| Comparative Example B2 | Δ | Δ | ⊙ | ○ | Δ |

TABLE B9

| film-forming conditions | layer constitution photoconductive layer |
|---|---|
| raw material gas & its flow rate | |
| $SiH_4$ | 500 sccm |
| $B_2H_6$ (against $SiH_4$) | 2 ppm→0 ppm |
| $H_2$ | 550 sccm |
| inner pressure | 500 mTorr |
| RF electric power | 500 W |
| substrate temperature | 250° C. |
| layer thickness | 20 μm |

TABLE B10

| | occurrence of a coarse image | toner transferring efficiency | lubricating property by cleaning means | occurrence of a smeared image | total evaluation |
|---|---|---|---|---|---|
| Example B2 | ⊙ | ⊙ | ⊙ | ⊙ | ⊙ |
| Comparative Example B3 | Δ | Δ | Δ | ○ | Δ |
| Comparative Example B4 | Δ | Δ | ⊙ | ○ | Δ |
| Comparative Example B5 | Δ | Δ | ⊙ | ○ | Δ |

TABLE B11

| film-forming conditions | layer constitution photoconductive layer | surface layer |
|---|---|---|
| raw material gas & its flow rate | | |
| $SiH_4$ | 500 sccm | 500 sccm |
| $B_2H_6$ (against $SiH_4$) | 2 ppm | 0 ppm |
| $H_2$ | 550 sccm | 550 sccm |
| the amount of a powdery-Se introduced (Ar flow rate) | 0 sccm | 50 sccm |
| inner pressure | 500 mTorr | 500 mTorr |
| RF electric power | 500 W | 500 W |
| substrate temperature | 250° C. | 250° C. |
| layer thickness | 19.5 μm | 0.5 μm |

TABLE B12

| film-forming conditions | layer constitution photoconductive layer | surface layer |
|---|---|---|
| raw material gas & its flow rate | | |
| $SiH_4$ | 500 sccm | 500 sccm |

TABLE B12-continued

| film-forming conditions | layer constitution photoconductive layer | surface layer |
|---|---|---|
| $B_2H_6$ (against $SiH_4$) | 2 ppm | 100 ppm |
| $H_2$ | 550 sccm | 550 sccm |
| inner pressure | 500 mTorr | 500 mTorr |
| RF electric power | 500 W | 500 W |
| substrate temperature | 250° C. | 250° C. |
| layer thickness | 19.5 μm | 0.5 μm |

TABLE B13

| film-forming conditions | layer constitution photoconductive layer 1 | photoconductive layer 2 |
|---|---|---|
| raw material gas & its flow rate | | |
| $SiH_4$ | 500 sccm | 500 sccm |
| $B_2H_6$ (against $SiH_4$) | 2 ppm | 0 ppm |
| $H_2$ | 550 sccm | 550 sccm |
| $PH_3$ (against $SiH_4$) | 0 ppm | 100 ppm |
| inner pressure | 500 mTorr | 500 mTorr |
| RF electric power | 500 W | 500 W |
| substrate temperature | 250° C. | 250° C. |
| layer thickness | 19.5 μm | 0.5 μm |

TABLE B14

| film-forming conditions | layer constitution photoconductive layer |
|---|---|
| raw material gas & its flow rate | |
| $SiH_4$ | 500 sccm |
| $B_2H_6$ (against $SiH_4$) | 1 ppm→0 ppm |
| $H_2$ | 350 sccm |
| inner pressure | 500 mTorr |
| RF electric power | 700 W |
| substrate temperature | 250° C. |
| layer thickness | 20 μm |

TABLE B15

| | metal element present at the surface | occurrence of a coarse image | toner transferring efficiency | lubricating property by cleaning means | occurrence of a smeared image | total evaluation |
|---|---|---|---|---|---|---|
| experiment B3 | Al, In | ◎ | ◎ | ◎ | ◎ | ◎ |
| | B, Al | ◎ | ◎ | ◎ | ◎ | ◎ |
| | In, Sn | ○ | ○ | ◎ | ◎ | ○ |
| | Se, Te | ○ | ○ | ◎ | ○ | ○ |
| | Bi, Pb | ○ | ○ | ◎ | ◎ | ○ |
| | Bi, Sn | ○ | ○ | ◎ | ◎ | ○ |
| | P, Al | ◎ | ◎ | ◎ | ◎ | ◎ |
| | Pb, Al | ◎ | ◎ | ◎ | ◎ | ◎ |
| | Sn, Al | ◎ | ◎ | ◎ | ◎ | ◎ |

TABLE B16

| film-forming conditions | layer constitution: photoconductive layer | layer constitution: surface layer |
|---|---|---|
| raw material gas & its flow rate | | |
| $SiH_4$ | 500 sccm | 70 sccm |
| $CH_4$ | 0 sccm | 300 sccm |
| $B_2H_6$ (against $SiH_4$) | 1 ppm | 0 ppm |
| $H_2$ | 500 sccm | 500 sccm |
| inner pressure | 350 mTorr | 200 mTorr |
| RF electric power | 500 W | 350 W |
| substrate temperature | 250° C. | 250° C. |
| layer thickness | 20 μm | 0.5 μm |

TABLE B17

| | occurrence of a coarse image | toner transferring efficiency | lubricating property by cleaning means | occurrence of a smeared image | total evaluation |
|---|---|---|---|---|---|
| Example B4 | ◎ | ◎ | ◎ | ○ | ◎ |
| Example B5 | ○ | ○ | ◎ | ○ | ○ |
| Example B6 | ◎ | ◎ | ◎ | ○ | ◎ |
| Example B7 | ○ | ○ | ◎ | ○ | ○ |
| Example B8 | ◎ | ◎ | ◎ | ○ | ◎ |

TABLE B18

| film-forming conditions | layer constitution: photoconductive layer | layer constitution: surface layer |
|---|---|---|
| raw material gas & its flow rate | | |
| $SiH_4$ | 500 sccm | 70 sccm |
| $CH_4$ | 0 sccm | 300 sccm |
| $B_2H_6$ (against $SiH_4$) | 1 ppm | 0 ppm |
| He | 500 sccm | 500 sccm |
| inner pressure | 10 mTorr | 10 mTorr |
| microwave power applied | 800 W | 800 W |
| bias electric power (DC) | 400 W | 400 W |
| substrate temperature | 250° C. | 250° C. |
| layer thickness | 20 μm | 0.5 μm |
| deposition rate | 200 Å/s | 20 Å/s |

TABLE B19

| film-forming condition | layer constitution: charge transportion layer | layer constitution: charge generation layer | layer constitution: surface layer |
|---|---|---|---|
| raw material gas & its flow rate | | | |
| $SiH_4$ | 600 sccm | 600 sccm | 70 sccm |
| $CH_4$ | 35 sccm | 0 sccm | 300 sccm |
| $B_2H_6$ (against $SiH_4$) | 1000 ppm | 1 ppm | 0 ppm |
| $H_2$ | 500 sccm | 500 sccm | 500 sccm |
| inner pressure | 9 mTorr | 10 mTorr | 10 mTorr |
| microwave power applied | 900 W | 900 W | 900 W |
| bias electric power (DC) | 500 W | 500 W | 500 W |
| substrate temperature | 250° C. | 250° C. | 250° C. |
| layer thickness | 3 μm | 25 μm | 0.3 μm |
| deposition rate | 150 Å/s | 150 Å/s | 20 Å/s |

TABLE B20

| | (1) | (2) | (3) | (4) | (5) | (6) | total evaluation |
|---|---|---|---|---|---|---|---|
| Example B9 | ◎ | ◎ | ◎ | ◎ | ◎ | ◎ | ◎ |
| Example B10 | ◎ | ◎ | ◎ | ◎ | ◎ | ◎ | ◎ |
| Example B11 | ◎ | ◎ | ◎ | ◎ | ◎ | ◎ | ◎ |

Note:
(1) occurrence of a coarse image
(2) toner trasferring efficiency
(3) lubricating property by cleaning means
(4) occurrence of a smeared image
(5) evenness in the charging efficiency
(6) evennes surface in potential at halftone exposure

TABLE B21

| | reproduction of human skin | reproduction of human hair | reproduction of blue sky | total evaluation |
|---|---|---|---|---|
| Example B1 | ◎ | ◎ | ◎ | ◎ |
| Example B2 | ◎ | ◎ | ◎ | ◎ |
| Example B3 | ◎ | ◎ | ◎ | ◎ |
| Example B4 | ◎ | ◎ | ◎ | ◎ |
| Example B6 | ◎ | ◎ | ◎ | ◎ |
| Example B8 | ◎ | ◎ | ◎ | ◎ |

TABLE B22

| | reproduction of human skin | reproduction of human hair | reproduction of blue sky | total evaluation |
|---|---|---|---|---|
| Example B1 | ○ | ○ | ○ | ○ |
| Example B2 | ○ | ○ | ○ | ○ |
| Example B3 | ○ | ○ | ○ | ○ |
| Example B4 | ◎ | ◎ | ◎ | ◎ |
| Example B6 | ◎ | ◎ | ◎ | ◎ |
| Example B8 | ○ | ○ | ○ | ○ |

What is claimed is:

1. An electrophotographic light receiving member having an outermost surface portion comprised of a non-single crystal material, characterized in that a region (a) containing at least a metal element selected from the group consisting of metal elements belonging to groups 13, 14, 15 and 16 of the periodic table and a region (b) substantially not containing said metal element are two-dimensionally distributed at said outermost surface of said light receiving layer.

2. An electrophotographic light receiving member according to claim 1, wherein the region (a) comprises a region containing said at least a metal element which is disposed on the surface of the light receiving member.

3. An electrophotographic light receiving member according to claim 2, wherein the light receiving member comprises a substrate and a light receiving layer disposed on said substrate, said light receiving layer being composed of a non-single crystal material containing silicon atoms as a matrix which has photoconductivity.

4. An electrophotographic light receiving member according to claim 2, wherein the non-single crystal material constituting the outermost surface portion of the light receiving member contains at least silicon atoms.

5. An electrophotographic light receiving member according to claim 2, wherein the outermost surface portion of the light receiving member is an outermost surface portion of a surface protective layer disposed on a photoconductive layer.

6. An electrophotographic light receiving member according to claim 5, wherein the surface protective layer contains at least an element selected from carbon, nitrogen and oxygen.

7. An electrophotographic light receiving member according to claim 2, wherein the region (a) has an area rate of 5% to 60%.

8. An electrophotographic light receiving member according to claim 2, wherein the region (a) is distributed in an island-like distribution state in the region (b) at the outermost surface portion of the light receiving member.

9. An electrophotographic light receiving member according to claim 19, wherein the region (a) comprises a plurality of island-like regions each containing said at least metal element which are spacedly distributed in the region (b).

10. An electrophotographic light receiving member according to claim 9, wherein each of the island-like regions is shaped in a form approximate to a round form which has a diameter of 200 Å to 5000 Å.

11. An electrophotographic light receiving member according to claim 9, wherein each of the island-like regions is shaped in a form approximate to an elliptic form which has a major axis of 200 Å to 5000 Å.

12. An electrophotographic light receiving member according to claim 2, wherein the non-single crystal material constituting the outermost surface portion of the light receiving member contains at least silicon atoms and the outermost surface portion of the light receiving member has an uneven structure provided with irregularities comprising protrusions and recesses, wherein the region (a) comprises a plurality of regions (a-i) each comprising said at least a metal element deposited in one of said recesses and the region (b) comprises a region (b-i) remained without substantially containing said at least metal element, and said regions (a-i) and said region (b-i) are two-dimensionally distributed at the outermost surface of the light receiving member.

13. An electrophotographic light receiving member according to claim 1, wherein the region (a) comprises a region containing said at least a metal element which is disposed in the surface of the light receiving member.

14. An electrophotographic light receiving member according to claim 13, wherein the light receiving member comprises a substrate and a light receiving layer disposed on said substrate, said light receiving layer being composed of a non-single crystal material containing silicon atoms as a matrix which has photoconductivity.

15. An electrophotographic light receiving member according to claim 13, wherein the non-single crystal material constituting the outermost surface portion of the light receiving member contains at least silicon atoms.

16. An electrophotographic light receiving member according to claim 13, wherein the outermost surface portion of the light receiving member is an outermost surface portion of a surface protective layer disposed on a photoconductive layer.

17. An electrophotographic light receiving member according to claim 16, wherein the surface protective layer contains at least an element selected from carbon, nitrogen and oxygen.

18. An electrophotographic light receiving member according to claim 13, wherein the region (a) has an area rate of 5% to 60%.

19. An electrophotographic light receiving member according to claim 13, wherein the region (a) is distributed in an island-like distribution state in the region (b) at the outermost surface portion of the light receiving member.

20. An electrophotographic light receiving member according to claim 19, wherein the region (a) comprises a plurality of island-like regions each containing said at least metal element which are spacedly distributed in the region (b).

21. An electrophotographic light receiving member according to claim 20, wherein each of the island-like regions is shaped in a form approximate to a round form which has a diameter of 200 Å to 5000 Å.

22. An electrophotographic light receiving member according to claim 20, wherein each of the island-like regions is shaped in a form approximate to an elliptic form which has a major axis of 200 Å to 5000 Å.

23. An electrophotographic light receiving member according to claim 1, wherein the light receiving member comprises a substrate and a light receiving layer disposed on said substrate, said light receiving layer being composed of a non-single crystal material containing silicon atoms as a matrix which has photoconductivity.

24. An electrophotographic light receiving member according to claim 1, wherein the non-single crystal material constituting the outermost surface portion of the light receiving member contains at least silicon atoms.

25. An electrophotographic light receiving member according to claim 1, wherein the outermost surface portion of the light receiving member is an outermost surface portion of a surface protective layer disposed on a photoconductive layer.

26. An electrophotographic light receiving member according to claim 25, wherein the surface protective layer contains at least an element selected from carbon, nitrogen and oxygen.

27. An electrophotographic light receiving member according to claim 1, wherein the region (a) has an area rate of 5% to 60%.

28. An electrophotographic light receiving member according to claim 1, wherein the region (a) is distributed in an island-like distribution state in the region (b) at the outermost surface portion of the light receiving member.

29. An electrophotographic light receiving member according to claim 28, wherein the region (a) comprises a plurality of island-like regions each containing said at least metal element which are spacedly distributed in the region (b).

30. An electrophotographic light receiving member according to claim 29, wherein each of the island-like regions is shaped in a form approximate to a round form which has a diameter of 200 Å to 5000 Å.

31. An electrophotographic light receiving member according to claim 29, wherein each of the island-like regions is shaped in a form approximate to an elliptic form which has a major axis of 200 Å to 5000 Å.

32. An electrophotographic light receiving member according to claim 1, wherein the non-single crystal material constituting the outermost surface portion of the light receiving member contains at least silicon atoms and the outermost surface portion of the light receiving member has an uneven structure provided with irregularities comprising protrusions and recesses, wherein the region (a) comprises a plurality of regions (a-i) each comprising said at least a metal element deposited in one of said recesses and the region (b) comprises a region (b-i) remained without substantially containing said at least metal element, and said regions (a-i) and said region (b-i) are two-dimensionally distributed at the outermost surface of the light receiving member.

33. An electrophotographic apparatus comprises an electrophotographic light receiving member, an exposure means, a charging means, and a development means, wherein said electrophotographic light receiving member has an outermost surface portion comprised of a non-single crystal material and a region (a) containing at least a metal element selected from the group consisting of metal elements belonging to groups 13, 14, 15 and 16 of the periodic table and a region (b) substantially not containing said metal element which are two-dimensionally distributed at said outermost surface of said light receiving layer.

34. An electrophotographic apparatus according to claim 33, wherein the region (a) comprises a region containing said at least a metal element which is disposed on the surface of the light receiving member.

35. An electrophotographic apparatus according to claim 34, wherein the light receiving member comprises a substrate and a light receiving layer disposed on said substrate, said light receiving layer being composed of a non-single crystal material containing silicon atoms as a matrix which has photoconductivity.

36. An electrophotographic apparatus according to claim 34, wherein the non-single crystal material constituting the outermost surface portion of the light receiving member contains at least silicon atoms.

37. An electrophotographic apparatus according to claim 34, wherein the outermost surface portion of the light receiving member is an outermost surface portion of a surface protective layer disposed on a photoconductive layer.

38. An electrophotographic apparatus according to claim 37, wherein the surface protective layer contains at least an element selected from carbon, nitrogen and oxygen.

39. An electrophotographic apparatus according to claim 34, wherein the region (a) has an area rate of 5% to 60%.

40. An electrophotographic apparatus according to claim 34, wherein the region (a) is distributed in an island-like distribution state in the region (b) at the outermost surface portion of the light receiving member.

41. An electrophotographic apparatus according to claim 40, wherein the region (a) comprises a plurality of island-like regions each containing said at least metal element which are spacedly distributed in the region (b).

42. An electrophotographic apparatus according to claim 41, wherein each of the island-like regions is shaped in a form approximate to a round form which has a diameter of 200 Å to 5000 Å.

43. An electrophotographic apparatus according to claim 41, wherein each of the island-like regions is shaped in a form approximate to an elliptic form which has a major axis of 200 Å to 5000 Å.

44. An electrophotographic apparatus according to claim 34, wherein the non-single crystal material constituting the outermost surface portion of the light receiving member contains at least silicon atoms and the outermost surface portion of the light receiving member has an uneven structure provided with irregularities comprising protrusions and recesses, wherein the region (a) comprises a plurality of regions (a-i) each comprising said at least a metal element deposited in one of said recesses and the region (b) comprises a region (b-i) remained without substantially containing said at least metal element, and said regions (a-i) and said region (b-i) are two-dimensionally distributed at the outermost surface of the light receiving member.

45. An electrophotographic apparatus according to claim 33, wherein the region (a) comprises a region containing said at least a metal element which is disposed in the surface of the light receiving member.

46. An electrophotographic apparatus according to claim 45, wherein the light receiving member comprises a substrate and a light receiving layer disposed on said substrate, said light receiving layer being composed of a non-single crystal material containing silicon atoms as a matrix which has photoconductivity.

47. An electrophotographic apparatus according to claim 45, wherein the non-single crystal material constituting the outermost surface portion of the light receiving member contains at least silicon atoms.

48. An electrophotographic apparatus according to claim 45, wherein the outermost surface portion of the light receiving member is an outermost surface portion of a surface protective layer disposed on a photoconductive layer.

49. An electrophotographic apparatus according to claim 48, wherein the surface protective layer contains at least an element selected from carbon, nitrogen and oxygen.

50. An electrophotographic apparatus according to claim 45, wherein the region (a) has an area rate of 5% to 60%.

51. An electrophotographic apparatus according to claim 45, wherein the region (a) is distributed in an island-like distribution state in the region (b) at the outermost surface portion of the light receiving member.

52. An electrophotographic apparatus according to claim 51, wherein the region (a) comprises a plurality of island-like regions each containing said at least metal element which are spacedly distributed in the region (b).

53. An electrophotographic apparatus according to claim 52, wherein each of the island-like regions is shaped in a form approximate to a round form which has a diameter of 200 Å to 5000 Å.

54. An electrophotographic apparatus according to claim 52, wherein each of the island-like regions is shaped in a form approximate to an elliptic form which has a major axis of 200 Å to 5000 Å.

55. An electrophotographic apparatus according to claim 33, wherein the light receiving member comprises a substrate and a light receiving layer disposed on said substrate, said light receiving layer being composed of a non-single crystal material containing silicon atoms as a matrix which has photoconductivity.

56. An electrophotographic apparatus according to claim 33, wherein the non-single crystal material constituting the outermost surface portion of the light receiving member contains at least silicon atoms.

57. An electrophotographic apparatus according to claim 33, wherein the outermost surface portion of the light receiving member is an outermost surface portion of a surface protective layer disposed on a photoconductive layer.

58. An electrophotographic apparatus to claim 57, wherein the surface protective layer contains at least an element selected from carbon, nitrogen and oxygen.

59. An electrophotographic apparatus according to claim 33, wherein the region (a) has an area rate of 5% to 60%.

60. An electrophotographic apparatus according to claim 33, wherein the region (a) is distributed in an island-like distribution state in the region (b) at the outermost surface portion of the light receiving member.

61. An electrophotographic apparatus to claim 60, wherein the region (a) comprises a plurality of island-like regions each containing said at least metal element which are spacedly distributed in the region (b).

62. An electrophotographic apparatus according to claim 61, wherein each of the island-like regions is shaped in a form approximate to a round form which has a diameter of 200 Å to 5000 Å.

63. An electrophotographic apparatus according to claim 61, wherein each of the island-like regions is shaped in a form approximate to an elliptic form which has a major axis of 200 Å to 5000 Å.

64. An electrophotographic apparatus according to claim 33, wherein the non-single crystal material constituting the outermost surface portion of the light receiving member contains at least silicon atoms and the outermost surface portion of the light receiving member has an uneven structure provided with irregularities comprising protrusions and recesses, wherein the region (a) comprises a plurality of regions (a-i) each comprising said at least a metal element deposited in one of said recesses and the region (b) comprises a region (b-i) remained without substantially containing said at least metal element, and said regions (a-i) and said region (b-i) are two-dimensionally distributed at the outermost surface of the light receiving member.

65. An electrophotographic apparatus according to claim 33, wherein the charging means comprises a member to be contacted with the light receiving member.

66. An electrophotographic apparatus according to claim 33, wherein the charging means is not contacted with the light receiving member.

67. An electrophotographic process comprising the steps of charging an electrophotographic light receiving member by means of a charging means of a contacting system or a non-contacting system, and conducting exposure, development, transferring, and cleaning in the named order, wherein said electrophotographic light receiving member has an outermost surface portion comprised of a non-single crystal material and a region (a) containing at least a metal element selected from the group consisting of metal elements belonging to groups 13, 14, 15 and 16 of the periodic table and a region (b) substantially not containing said metal element which are two-dimensionally distributed at said outermost surface of said light receiving layer.

68. An electrophotographic process according to claim 67, wherein the region (a) comprises a region containing said at least a metal element which is disposed on the surface of the light receiving member.

69. An electrophotographic process according to claim 68, wherein the light receiving member comprises a substrate and a light receiving layer disposed on said substrate, said light receiving layer being composed of a non-single crystal material containing silicon atoms as a matrix which has photoconductivity.

70. An electrophotographic process according to claim 68, wherein the non-single crystal material constituting the outermost surface portion of the light receiving member contains at least silicon atoms.

71. An electrophotographic process according to claim 68, wherein the outermost surface portion of the light receiving member is an outermost surface portion of a surface protective layer disposed on a photoconductive layer.

72. An electrophotographic process according to claim 71, wherein the surface protective layer contains at least an element selected from carbon, nitrogen and oxygen.

73. An electrophotographic process according to claim 68, wherein the region (a) has an area rate of 5% to 60%.

74. An electrophotographic process according to claim 68, wherein the region (a) is distributed in an island-like distribution state in the region (b) at the outermost surface portion of the light receiving member.

75. An electrophotographic process according to claim 74, wherein the region (a) comprises a plurality of island-like regions each containing said at least metal element which are spacedly distributed in the region (b).

76. An electrophotographic process according to claim 75, wherein each of the island-like regions is shaped in a form approximate to a round form which has a diameter of 200 Å to 5000 Å.

77. An electrophotographic process according to claim 75, wherein each of the island-like regions is shaped in a form approximate to an elliptic form which has a major axis of 200 Å to 5000 Å.

78. An electrophotographic process according to claim 68, wherein the non-single crystal material constituting the outermost surface portion of the light receiving member contains at least silicon atoms and the outermost surface portion of the light receiving member has an uneven structure provided with irregularities comprising protrusions and recesses, wherein the region (a) comprises a plurality of regions (a-i) each comprising said at least a metal element deposited in one of said recesses and the region (b) comprises a region (b-i) remained without substantially containing said at least metal element, and said regions (a-i) and said region (b-i) are two-dimensionally distributed at the outermost surface of the light receiving member.

79. An electrophotographic process according to claim 67, wherein the region (a) comprises a region containing said at least a metal element which is disposed in the surface of the light receiving member.

80. An electrophotographic process according to claim 79, wherein the light receiving member comprises a substrate and a light receiving layer disposed on said substrate, said light receiving layer being composed of a non-single crystal material containing silicon atoms as a matrix which has photoconductivity.

81. An electrophotographic process according to claim 79, wherein the non-single crystal material constituting the outermost surface portion of the light receiving member contains at least silicon atoms.

82. An electrophotographic process according to claim 79, wherein the outermost surface portion of the light receiving member is an outermost surface portion of a surface protective layer disposed on a photoconductive layer.

83. An electrophotographic process according to claim 82, wherein the surface protective layer contains at least an element selected from carbon, nitrogen and oxygen.

84. An electrophotographic process according to claim 79, wherein the region (a) has an area rate of 5% to 60%.

85. An electrophotographic process according to claim 79, wherein the region (a) is distributed in an island-like distribution state in the region (b) at the outermost surface portion of the light receiving member.

86. An electrophotographic process according to claim 85, wherein the region (a) comprises a plurality of island-like regions each containing said at least metal element which are spacedly distributed in the region (b).

87. An electrophotographic process according to claim 86, wherein each of the island-like regions is shaped in a form approximate to a round form which has a diameter of 200 Å to 5000 Å.

88. An electrophotographic process according to claim 86, wherein each of the island-like regions is shaped in a form approximate to an elliptic form which has a major axis of 200 Å to 5000 Å.

89. An electrophotographic process according to claim 67, wherein the light receiving member comprises a substrate and a light receiving layer disposed on said substrate, said light receiving layer being composed of a non-single crystal material containing silicon atoms as a matrix which has photoconductivity.

90. An electrophotographic process according to claim 67, wherein the non-single crystal material constituting the outermost surface portion of the light receiving member contains at least silicon atoms.

91. An electrophotographic process according to claim 67, wherein the outermost surface portion of the light receiving member is an outermost surface portion of a surface protective layer disposed on a photoconductive layer.

92. An electrophotographic process according to claim 91, wherein the surface protective layer contains at least an element selected from carbon, nitrogen and oxygen.

93. An electrophotographic process according to claim 67, wherein the region (a) has an area rate of 5% to 60%.

94. An electrophotographic process according to claim 67, wherein the region (a) is distributed in an island-like distribution state in the region (b) at the outermost surface portion of the light receiving member.

95. An electrophotographic process according to claim 94, wherein the region (a) comprises a plurality of island-like regions each containing said at least metal element which are spacedly distributed in the region (b).

96. An electrophotographic process according to claim 95, wherein each of the island-like regions is shaped in a form approximate to a round form which has a diameter of 200 Å to 5000 Å.

97. An electrophotographic process according to claim 95, wherein each of the island-like regions is shaped in a form approximate to an elliptic form which has a major axis of 200 Å to 5000 Å.

98. An electrophotographic process according to claim 67, wherein the non-single crystal material constituting the outermost surface portion of the light receiving member contains at least silicon atoms and the outermost surface portion of the light receiving member has an uneven structure provided with irregularities comprising protrusions and recesses, wherein the region (a) comprises a plurality of regions (a-i) each comprising said at least a metal element deposited in one of said recesses and the region (b) comprises a region (b-i) remained without substantially containing said at least metal element, and said regions (a-i) and said region (b-i) are two-dimensionally distributed at the outermost surface of the light receiving member.

* * * * *

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

Title page, item
[30] FOREIGN APPLICATION PRIORITY DATA

"Mar. 17, 1995 [JP] Japan .... 7-084558"
(first occurrence) should read
--Mar. 17, 1995 [JP] Japan .... 7-084557--.

COLUMN 1

Line 21, "substantially" (second occurrence) should be deleted.
Line 59, "responsibility" should read --responsiveness-- and "composed" should read --composed of--.

COLUMN 4

Line 8, "use" should read --use of--.
Line 36, "can not" should read --cannot--.
Line 47, "cased" should read --caused--.
Line 66, "condition;" should read --conditions;--.

COLUMN 5

Line 4, "condition." should read --conditions.--.
Line 6, "desirable" should read --desirable and--.
Line 53, "nether" should read --neither--.
Line 61, "in the electrophotographic apparatus," should be deleted.
Line 66, "nether" should read --neither--.

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

COLUMN 6

Line 8, "can" should read --can be--.
Line 9, "is" should read --is to--.

COLUMN 7

Line 23, "cross sectional" should read --cross-sectional--.
Line 24, "cross sectional" should read --cross-sectional--.
Line 31, "cross sectional" should read --cross-sectional--.
Line 32, "cross" should read --cross---.

COLUMN 8

Line 52, "cross section" should read --cross-section--.
Line 53, "the" (second occurrence) should be deleted.
Line 67, "would" should read --would be--.

COLUMN 9

Line 10, "consider as will be" should be deleted.
Line 11, "described in the following." should read --believe as follows:--.

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

COLUMN 10

Line 28, "is occurred" should read --occurs--.
Line 41, "a" (second occurrence) should be deleted.
Line 55, "remained" should read --retained--.
Line 60, "inventors" should read --inventors conducted--.

COLUMN 11

Line 32, "suffer from a craze," should read --by cracking--.
Line 34, "craze." should read --cracking.--.
Line 52, "craze" should read --cracking--.
Line 60, "further" should read --further conducted--.

COLUMN 12

Line 34, "deposit" should read --deposits--.

COLUMN 13

Line 30, "can not" should read --cannot--.

COLUMN 17

Line 4, "a" should be deleted.
Line 6, "a" should be deleted.

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

COLUMN 18

Line 1, "purposes" should read --purpose--.

COLUMN 20

Line 4, "release" should read --be released--.
Line 38, "a" should read --an--.

COLUMN 21

Line 33, "later" should read --layer--.

COLUMN 24

Line 4, "end" should be deleted--.
Line 14, "he" should read --the--.
Line 63, "above described" should read --above-described--.

COLUMN 26

Line 51, "material" should read --materials--.
Line 61, "material" should read --materials--.
Line 63, "introducing" should read --introduce--.

COLUMN 27

Line 27, "can not" should read --cannot--.

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

COLUMN 29

Line 40, "then" should read --than--.

COLUMN 31

Line 62, "it" should read --it is--.

COLUMN 32

Line 1, "quarts" should read --quartz--.
Line 9, "cheer" should read --chamber--.
Line 49, "baas" should read --bias--.

COLUMN 33

Line 21, "The" should be deleted.
Line 29, "the" (second occurrence) should be deleted.

COLUMN 35

Line 11, "end" should read --and--.
Line 66, "cross sectional" should read --cross-sectional--.

COLUMN 36

Line 27, "end" should read --and--.
Line 42, "was occurred" should read --was conducted--.

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

COLUMN 39

Line 14, "reproduced" should read --reproduce--.
Line 46, "is occurred," should read --occurred,--.
Line 48, "is slightly occurred" should read --slightly occurred--.
Line 50, "is distinguishably occurred" should read --occurred--.
Line 52, "is remarkably occurred" should read --remarkably occurred--.

COLUMN 40

Line 1, "thin" (second occurrence) should be deleted.

COLUMN 41

Line 23, "thin" (second occurrence) should be deleted.
Line 60, "or" should read --or is--.

COLUMN 42

Line 9, "thin" (second occurrence) should be deleted.

COLUMN 43

Line 7, "was occurred" should read --was conducted--.
Line 53, "light," should read --light--.

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

COLUMN 45

Line 63, "thin" (second occurrence) should be deleted.

COLUMN 47

Line 22, "thin" (second occurrence) should be deleted.
Line 66, "member" should read --members--.

COLUMN 48

Line 65, "was" should read --way--.

COLUMN 49

Line 4, "respect" should read --respect to--.
Line 21, "members" should read --member--.
Line 47, "respect" should read --respect to--.

COLUMN 50

Line 11, "respect" should read --respect to--.
Line 26, "was into" should read --was introduced into--.
Line 34, "byway" should read --by way--.
Line 40, "respect" should read --respect to--.
Line 55, "was into" should read --was introduced into--.
Line 63, "meads" should read --means--.

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

COLUMN 51

Line 2, "respect" should read --respect to--.
Line 44, "respect" should read --respect to--.
Line 60, "members" should read --member--.

COLUMN 52

Line 19, "respect" should read --respect to--.
Line 58, "respect" should read --respect to--.

COLUMN 53

Line 8, "wall" should read --will--.

COLUMN 54

Line 12, "vale" should read --value--.

COLUMN 57

Line 30, "wall" should read --will--.
Line 45, "respect" should read --respect to--.
Line 64, "Comparative" should read --comparative--.

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

COLUMN 58

Line 23," As" should read --As a--.
Line 28, "respect" should read --respect to--.
Line 56, "So-containing" should read --Se-containing--.
Line 62, "respect" should read --respect to--.
Line 63, "obtained" should read --obtained are shown--.

COLUMN 59

Line 32, "As" should read --As a--.
Line 37, "respect" should read --respect to--.
Line 66, "As" should read --As a--.

COLUMN 60

Line 5, "respect" should read --respect to--.
Line 6, "The" should read --From the--.
Line 32, "As" should read --As a--.
Line 37, "respect" should read --respect to--.

COLUMN 61

Line 5, "respect" should read --respect to--.
Line 14, "later" should read --layer--.
Line 38, "respect" should read --respect to--.
Line 39, "obtained" should read --obtained are shown--.
Line 43, "byway" should read --by way--.
Line 58, "respect" should read --respect to--.
Line 59, "obtained" should read --obtained are shown--.

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

COLUMN 62

Line 27, "respect" should read --respect to--.
Line 28, "obtained" should read --obtained are shown--.
Line 47, "respect" should read --respect to--.
Line 48, "obtained" should read --obtained are shown--.

COLUMN 63

Line 18, "respect" should read --respect to--.
Line 19, "obtained" should read --obtained are shown--.

COLUMN 64

Line 67, "a" should be deleted.

COLUMN 65

Line 20, "a" should be deleted.

COLUMN 68

Table A8, "substrate temperature 25°C" should read --substrate temperature 250°C--.

UNITED STATES PATENT AND TRADEMARK OFFICE

CERTIFICATE OF CORRECTION

PATENT NO. : 5,670,286

DATED : September 23, 1997

INVENTOR(S) : TETSUYA TAKEI ET AL.

It is certified that error appears in the above-identified patent and that said Letters Patent is hereby corrected as shown below:

COLUMN 82

Line 65, "apparatus" should read --apparatus according--.

Signed and Sealed this

Twenty-eighth Day of July, 1998

*Attest:*

*Attesting Officer*

BRUCE LEHMAN

*Commissioner of Patents and Trademarks*